US010186407B2

(12) United States Patent
Berdnikov et al.

(10) Patent No.: US 10,186,407 B2
(45) Date of Patent: Jan. 22, 2019

(54) DEVICE FOR MANIPULATING CHARGED PARTICLES

(71) Applicant: Shimadzu Research Laboratory (Europe) Ltd.

(72) Inventors: Alexander Berdnikov, St. Petersburg (RU); Alina Andreyeva, Yorkshire (GB); Roger Giles, Yorkshire (GB)

(73) Assignee: Shimadzu Research Laboratory (Europe) Ltd., Manchester, Lancashire (GB)

( * ) Notice: Subject to any disclaimer, the term of this patent is extended or adjusted under 35 U.S.C. 154(b) by 0 days.

(21) Appl. No.: 15/704,366

(22) Filed: Sep. 14, 2017

(65) Prior Publication Data

US 2018/0005811 A1 Jan. 4, 2018

Related U.S. Application Data

(63) Continuation of application No. 15/299,665, filed on Oct. 21, 2016, now Pat. No. 9,812,308, which is a (Continued)

(30) Foreign Application Priority Data

May 5, 2011 (RU) ..... 2011119286
May 5, 2011 (RU) ..... 2011119296

(51) Int. Cl.
*H01J 49/00* (2006.01)
*H01J 49/06* (2006.01)

(52) U.S. Cl.
CPC ..... *H01J 49/0095* (2013.01); *H01J 49/06* (2013.01); *H01J 49/062* (2013.01); *H01J 49/065* (2013.01)

(58) Field of Classification Search
CPC .. H01J 49/00; H01J 49/02; H01J 49/06; H01J 49/061; H01J 49/062; H01J 49/063; (Continued)

(56) References Cited

U.S. PATENT DOCUMENTS 420,425 A 1/1890 Marshall
617,768 A 1/1899 Prideaux
(Continued)

FOREIGN PATENT DOCUMENTS

EP 1 956 635 A1 8/2008
GB 2 372 877 A 9/2002
(Continued)

OTHER PUBLICATIONS

International Search Report for PCT/EP2012/058310 dated Sep. 21, 2012.

*Primary Examiner* — Jason McCormack
(74) *Attorney, Agent, or Firm* — Sughrue Mion, PLLC

(57) ABSTRACT

The present invention is concerned with a device for charged particle transportation and manipulation. Embodiments provide a capability of combining positively and negatively charged particles in a single transported packet. Embodiments contain an aggregate of electrodes arranged to form a channel for transportation of charged particles, as well as a source of power supply that provides supply voltage to be applied to the electrodes, the voltage to ensure creation, inside the said channel, of a non-uniform high-frequency electric field, the pseudopotential of which field has one or more local extrema along the length of the channel used for charged particle transportation, at least, within a certain interval of time, whereas, at least one of the said extrema of the pseudopotential is transposed with time, at least within a certain interval of time, at least within a part of the length of the channel used for charged particle transportation.

16 Claims, 58 Drawing Sheets

Related U.S. Application Data continuation of application No. 14/115,134, filed as application No. PCT/EP2012/058310 on May 4, 2012, now Pat. No. 9,536,721.

(58) Field of Classification Search

CPC ..... H01J 49/065; H01J 49/066; H01J 49/421; H01J 49/422; H01J 49/4225; H01J 49/4245; H01J 49/426; H01J 49/4265; H01J 49/427; H01J 49/4275; H01J 49/4285

USPC ..... 250/281, 282, 283, 256, 288, 290

See application file for complete search history.

(56) References Cited

U.S. PATENT DOCUMENTS

| | | | | |
|---|---|---|---|---|
| 2,939,952 | A | 12/1954 | Paul et al. | |
| 4,963,736 | A | 10/1990 | Douglas et al. | |
| 5,179,278 | A | 1/1993 | Douglas | |
| 5,206,506 | A | 4/1993 | Kirchner | |
| 5,248,875 | A | 9/1993 | Douglas et al. | |
| 5,652,427 | A | 7/1997 | Whitehouse et al. | |
| 5,763,878 | A | 6/1998 | Franzen | |
| 5,818,055 | A | 10/1998 | Franzen | |
| 5,847,386 | A | 12/1998 | Thomson et al. | |
| 6,011,259 | A | 1/2000 | Whitehouse et al. | |
| 6,020,586 | A | 2/2000 | Dresch et al. | |
| 6,093,929 | A | 7/2000 | Javahery et al. | |
| 6,111,250 | A | 8/2000 | Thomson et al. | |
| 6,140,638 | A | 10/2000 | Tanner et al. | |
| 6,507,019 | B2 | 1/2003 | Chernushevich et al. | |
| 6,627,875 | B2 | 9/2003 | Afeyan et al. | |
| 6,800,846 | B2 | 10/2004 | Bateman et al. | |
| 6,812,453 | B2 | 11/2004 | Bateman et al. | |
| 6,894,286 | B2 | 5/2005 | Derrick et al. | |
| 7,193,207 | B1 | 3/2007 | Ding et al. | |
| 9,536,721 | B2 | 1/2017 | Berdnikov et al. | |
| 2003/0136905 | A1 | 7/2003 | Franzen et al. | |
| 2004/0026614 | A1* | 2/2004 | Bateman | H01J 49/065 250/281 |
| 2004/0079875 | A1 | 4/2004 | Ding | |
| 2004/0094709 | A1 | 5/2004 | Bateman | |
| 2004/0135080 | A1 | 7/2004 | Ouyang et al. | |
| 2005/0258364 | A1 | 11/2005 | Whitehouse et al. | |
| 2007/0080724 | A1 | 4/2007 | Wadhwa et al. | |
| 2007/0158545 | A1 | 7/2007 | Verentchikov | |
| 2008/0087815 | A1 | 4/2008 | Loucks et al. | |
| 2008/0156984 | A1 | 7/2008 | Makarov et al. | |
| 2008/0217527 | A1 | 9/2008 | Wang | |
| 2008/0272288 | A1 | 11/2008 | Guckenberger et al. | |
| 2008/0283742 | A1 | 11/2008 | Takeuchi et al. | |
| 2008/0315087 | A1 | 12/2008 | Wollnik et al. | |
| 2009/0050801 | A1 | 2/2009 | Fedorov | |
| 2009/0134321 | A1 | 5/2009 | Hoyes | |
| 2009/0278043 | A1* | 11/2009 | Satake | H01J 49/065 250/290 |
| 2009/0294655 | A1 | 12/2009 | Ding et al. | |
| 2009/0314935 | A1 | 12/2009 | Hoyes | |
| 2010/0073144 | A1 | 3/2010 | Huang | |
| 2010/0108879 | A1* | 5/2010 | Bateman | G01N 27/622 250/283 |
| 2010/0171035 | A1 | 7/2010 | Okumura et al. | |
| 2010/0301210 | A1 | 12/2010 | Bertsch et al. | |
| 2010/0327157 | A1 | 12/2010 | Green et al. | |
| 2011/0114835 | A1* | 5/2011 | Chen | H01J 49/0072 250/282 |
| 2011/0192969 | A1 | 8/2011 | Verentchikov | |
| 2011/0284738 | A1* | 11/2011 | Berg | H01J 49/0072 250/283 |

FOREIGN PATENT DOCUMENTS

| | | | |
|---|---|---|---|
| GB | 2 388 248 | A | 11/2003 |
| GB | 2 391 697 | A | 2/2004 |
| GB | 2 403 590 | A | 1/2005 |
| GB | 2 403 845 | A | 1/2005 |
| WO | 02/078046 | A2 | 10/2002 |
| WO | 2010/002819 | A1 | 1/2010 |
| WO | 2010/136779 | A1 | 12/2010 |

* cited by examiner

DEVICE FOR MANIPULATING CHARGED PARTICLES

CROSS REFERENCE TO RELATED APPLICATIONS

This application is a Continuation Application of U.S. patent application Ser. No. 15/299,665, filed Oct. 21, 2016, which is a Continuation Application of U.S. patent application Ser. No. 14/115,134, filed Nov. 1, 2013, issued as U.S. Pat. No. 9,536,721, which is a National Stage of International Application No. PCT/EP2012/058310 filed May 4, 2012, claiming priority based on Russian Patent Application Nos. 2011119286 filed May 5, 2011 and 2011119296 filed May 5, 2011, the contents of all of which are incorporated herein by reference in their entirety.

FIELD OF THE INVENTION

The present invention relates to charged-particle optics and mass spectrometry, and in particular to systems used for charged particle transportation and manipulation.

BACKGROUND

Ion sources used in mass spectrometry produce continuous or quasi-continuous beams of charged particles. Even in the case of pulsed operation of an ion source, accumulation of charged particles during several cycles of operation in a special storage device may be necessary. Therefore, in the case of pulsed operation of mass-analysers, special devices are used to ensure decomposition or breaking-up of a continuous beam of charged particles or the contents of a storage device, into separate portions and transportation thereof to the mass-analyser input. In recent devices used for transportation of charged particles, the tasks of cooling and spatial compression of charged particle packets for the purpose of a reduction of their emittance (the size of a packet of particles in phase-space coordinates) can also be solved efficiently, and additional manipulations can be performed with the charged particles during transportation (for example, fragmentation of charged particles, generation of secondary charged particles, selective extraction of charged particles to be subject to detailed analysis, etc.).

Several types of radio-frequency (RF) devices are used in mass spectrometry for charged particle manipulation. The first group of such devices includes mass analysers (as well as mass separators and mass filters). The purpose of such devices is the selection of those particles featuring particular mass-to-charge ratio, from the totality of charged particles. The main types of RF mass analysers include quadrupole mass filters and ion traps.

Radio-frequency quadrupole mass filters and ion traps proposed by Paul are known starting from about 1960s. Both types of mass analysers have been proposed in U.S. Pat. No. 2,939,952. Rather recently, linear ion traps were proposed, with radial ejection of charged particles from the trap (U.S. Pat. No. 5,420,425) and ejection of ions from the trap along the axis (U.S. Pat. No. 6,177,680). A detailed description of the principle of operation of said devices can be found, for example, in R. E. March, J. F. J. Todd, Quadrupole Ion Trap Mass Spectrometry, $2^{nd}$ edition, Wiley-Interscience, 2005; F. J. Major, V. N. Gheorghe, G. Werth, Charged Particle Traps, Springer, 2005; G. Werth, V. N. Gheorghe, F. J. Major, Charged Particle Traps II, Springer, 2009.

Functioning of quadrupole mass filters is based on the theory of solution stability of the Mathieu equation (see, for example, N. W. McLachlan, Theory and Application of Mathieu Functions, Claredon Press, Oxford, 1947 (chapter 4) or M. Abramovitz and I. Stegun, Handbook of Mathematical Functions with Formulas, Graphs and Mathematical Tables, 10ed., NBS, 1972 (chapter 20).). In the case of well-selected parameters of the intensity of quadrupole DC electric field, intensity of quadrupole RF field and the frequency of quadrupole RF field, charged particles having a particular mass-to-charge ratio would pass through the RF quadrupole mass filter. The other charged particles would lose the stability of their trajectories, and would be lost outside the boundaries of the channel of the mass filter.

Operation of mass analysers of the ion trap type is generally based on the theory of the Mathieu equation. In these mass analysers, a quadratic or nearly quadratic electric field is used, obtained through application of ideal hyperbolic electrodes, and the analysers are filled with a light gas at low enough pressure. In such devices, after slowing down the speed of motion of the charged particles due to multiple collisions with the molecules of neutral gas, the particles would then sequentially be extracted from the device by means of swinging/oscillating of the group of charged particles having the required mass-to-charge ratio, with the help of an RF electric field having the required frequency. The picture described above is somewhat approximate, since the practical ion trap mass spectrometry has developed and employed rather sophisticated methods for isolation, fragmentation and selective ejection of charged particles from ion traps by means of the action of specially configured RF fields on the particles.

Another important group of RF devices includes RF transporting devices for ion beams. The purpose of such devices is the confining of a beam of charged particles having different masses, within a bounded region inside the device (for example, near the axis of the device), and transfer of charged particles from one point within the space (point of inlet) to another point within the space (point of outlet).

A wide class of such devices is based on application of a two-dimensional multipole field, or approximate multipole field, extended along the third coordinate. The devices are used, for example, for transfer of ions from gas-filled ion sources operating at rather high gas pressures, into devices for mass-analysis of ions, operating at considerably lower pressure of gas, or in vacuum. Because of the fact that said linear multipole ion traps are not used directly for mass analysis, the requirements towards a strictly quadratic or strictly multipole field would not be vital, and for the purpose of simplification of the production technology while manufacturing such devices, hyperbolic and multipole electrodes, as a rule, would be replaced with cylindrical rods or even more coarsely shaped electrodes.

When charged particles are transferred into a linear multipole trap, collisions of the charged particles with gas molecules reduce their kinetic energy and force the particles to be groped near the axis of the device (U.S. Pat. No. 4,963,736). This ensures such an important function like beam cooling and spatial compressing of the beam of charged particle for the purpose of reduction of the beam emittance (i.e., the volume of an ensemble of charged particles, corresponding to the beam, in phase space). An RF electric field is capable of confining charged particles in a radial direction, at a stage where the reduction of kinetic energy of charged particles has not yet taken place, even in the case of relatively high kinetic energies, and "compresses" the particles towards the axis in the course of the loss of their kinetic energy.

The gas-filled linear multipole ion beam transporting devices described above are frequently used simultaneously, as collision cells for fragmentation of charged particles in tandem mass spectrometers (for example, see. U.S. Pat. No. 6,093,929). A DC electric field directed along the axis of the device, the field created by additional electrodes, can be used for forced transfer of charged particles along the channel of transfer (ion transporting device proposed in U.S. Pat. No. 5,847,386, collision cell for fragmentation of ions proposed in U.S. Pat. No. 6,111,250).

If the ends of a linear multipole ion transporting device are closed using barriers formed by an electric field, another type of RF device used in mass spectrometry is formed—a linear multipole ion trap, or a storage device for charged particles. Such traps are widely used to accumulate charged particles and pulse transmission of charged particles into an analysing device (U.S. Pat. No. 5,179,278, WO02078046, U.S. Pat. No. 5,763,878, U.S. Pat. No. 6,020,586, U.S. Pat. No. 6,507,019 and GB2388248). Multipole ion traps are also frequently used to initiate task-oriented ion-molecular reactions between charged particles and neutral particles (U.S. Pat. No. 6,140,638 and U.S. Pat. No. 6,011,259), or electrons (patent Nos. GB2372877, GB2403845 and GB2403590), or charged particles with opposite charges (U.S. Pat. No. 6,627,875), to provide additional fragmentation of charged particles due to exposure of the same to an impact, for example, of photons, or other external physical factors.

The RF ion trap proposed by Paul, or a linear trap, can also be used for the same purpose as a multipole linear trap, when the total amount of ions is injected at once from the trap into an analysing device due to a pulse of electric voltage, instead of consecutive resonance ejection of the desired groups of ions (patent Nos. WO2006/129068 and US2008/0035841). In a similar way, a multipole linear trap, wherein the injection into the analysing device is made mass-selective, can be used as a rough mass filter, which selects the required groups of charged particles for further detailed analysis (patent No. US2007/0158545).

There are devices known to have functions similar to the above-mentioned transporting devices, which include transporting devices and/or storage devices wherein electrodes are used, in the form of an array of plates with apertures, and to which electrodes RF voltages are applied, with phase shift between adjacent plates (U.S. Pat. No. 6,812,453, U.S. Pat. No. 6,894,286 and U.S. Pat. No. 5,818,055), or between the parts forming one plate (patent No. PCT/GB2010/001076). In that case, because of the symmetry of electrodes, the generated RF field near the axis of the device would be practically zero, whereas it would grow abruptly near the boundaries of the transporting channel. Therefore, like in the case of the linear multipole ion transporting devices, the charged particles would be repelled from the electrodes and confined by the RF field within a limited space surrounding the axis of the device, and in the course of reduction of their kinetic energy due to collisions with gas molecules, the charged particles would be grouped near the axis of the device.

One can see that in the case of an absence of additional electric fields in the vicinity of the axis of the device, the forces enabling the movement of charged particles along the axis of the transporting device would practically be absent due to symmetry of the electrodes and high frequency of the electric field (U.S. Pat. No. 5,818,055 and U.S. Pat. No. 6,894,286), and the transfer of charged particles along the length of the channel for transportation would not be very efficient. Indeed, the capture of charged particles moving along the axis of the device is not mentioned in U.S. Pat. No. 5,818,055 and U.S. Pat. No. 6,894,286; furthermore, the particles having different masses and different initial conditions (coordinates and velocities) move along the channel of transportation with different effective velocities, and as a result, there would be no separation of the beam of charged particles into individual spatially separated and synchronically transferred packets of charged particles.

The superposition of radially non-uniform RF electric field, which enables localisation of charged particles in the vicinity of the axis of the device along the radial direction, and quasi-static progressive wave of electric field along the axis of the device enabling splitting of the beam of charged particles having different masses into spatially separated packets and synchronous transportation of said packets along the axis of the device may be the most successful solution from among the above-mentioned solutions (U.S. Pat. No. 6,812,453 and PCT/GB2010/001076).

However, since the positively charged particles are grouped in the vicinities of minima of the progressive wave of potential of the quasi-static electric field, and negatively charged particles are grouped in the vicinities of maxima of the progressive wave of potential of the quasi-static electric field, it would not be possible to ensure transportation of positively and negatively charged particles in an integrated packet of charged particles using this method.

The functioning of the majority of RF mass-spectrometry devices is based on the property of an RF electric field to "eject" the charged particles, regardless of the polarity of their charge, from the area of high amplitude of electric field into the area with lower amplitude of electric field. This property has been the consequence of the inertia of motion of charged particles having non-zero masses, under the influence of a fast oscillating electric field.

This phenomena is described quantitatively with the help of the theory of effective potential or pseudopotential, first introduced by P. L. Kapitza (see L. D. Landau, E. M. Lifshitz, Mechanics, Ser. Theoretical Physics, M., Fizmatlit, 2004, p. 124-127; G. M. Zaslavsky and R. Z. Sagdeev, Introduction to nonlinear physics: from pendulum to turbulence and chaos, M., Nauka, 1988, p. 49-51 and p. 52-54; M. I. Yavor, Optics of Charged Particle Analysers, Ser. Advances of Imaging and Electron Physics, Vol. 157, Elsevier, 2009, p. 142-144). That is, suppose the frequency $\omega$ of oscillations of electric field $\vec{E}(x,y,z,t)$, which follows the law $\vec{E}(x,y,z,t)=\vec{E}_0(x,y,z)\cos(\omega t+\Phi)$, is high enough (where $\vec{E}_0(x,y,z)$ is the amplitude of oscillations of electric field in a point within the space (x,y,z), $\omega$—frequency of oscillations, $\varphi$—initial phase of oscillations, t—time), and the displacement of charged particle having the mass m and charge q, during one period of oscillations of the electric field is small, then the motion of the charged particle can be represented as an "averaged" or "slow" motion, with an added rapid oscillating motion, featuring, however, small amplitude. In that case, the equation for averaged motion would look like as if the averaged motion takes place within electric field having the potential $\overline{U}(x,y,z)=q|\vec{E}_0(x,y,z)|^2/(4m\omega^2)$, where the values q, $\vec{E}_0(x,y,z)$, m and $\omega$ characterizing the oscillating electric field and the charged particle, have been defined above. The details and substantiation of the theory can be found in the references cited above.

Due to the fact that the expression for potential $\overline{U}(x,y,z)$ includes charge q and mass m, the potential $\overline{U}(x,y,z)$ affects equally both positively and negatively charged particles, and the effect is also dependent on the mass of a charged particle. In case of a real electric potential U(x,y,z) positively charged particles would undergo a force directed reversely with respect to the gradient of electrical potential, and negatively charged particles would undergo a force directed along the gradient of electrical potential, whereas such force would not be dependent on the mass of a particle. From the expression for potential $\bar{U}(x,y,z)$ it follows, that a charged particle would be <<pushed out>> from the area where the amplitude of oscillations of the RF field is high, into the area where said amplitude of oscillations of the RF field is lower (that is, from the area where the potential $\bar{U}(x,y,z)$ has a higher value, the particle would move into the area where the potential $\bar{U}(x,y,z)$ has a lower value). The extracting action of the RF electric field is not dependent on the polarity of charged particle, and moves both positive and negative charged particles in the same direction. The extracting action of the RF electric field is weaker with respect to those charged particles having heavier masses, than with respect to lighter charged particles. The extracting action of the RF electric field can be controlled by varying the frequency of oscillations of the electric field.

The potential $\bar{U}(x,y,z)$ is called an effective potential, or a pseudopotential, and represents a useful mathematical tool for describing and analysing the averaged motion of a charged particle (though in fact, it does not actually correspond to any physical fields). We shall take for granted, some of its properties. For electric field $\vec{E}(x,y,z,t)$, which varies with time t under the law of harmonic oscillations $\vec{E}(x,y,z,t)=\vec{E}_0(x,y,z)\cos(\omega t+\varphi)$ with a constant amplitude $\vec{E}_0(x,y,z)$ at a point (x,y,z), with a constant frequency ω and with a constant phase shift φ=const, the pseudopotential $\bar{U}(x,y,z)$, which affects a charged particle having the charge q and mass m, is calculated using the above formula $\bar{U}(x,y,z)=q|\vec{E}_0(x,y,z)|^2/(4m\omega^2)$. If the phase of the RF field is not constant over the entire space, but varies from point to point in a predetermined manner $\varphi=\varphi(x,y,z)$, so that the law of variation of the RF electrical field with time t has a more sophisticated form $\vec{E}(x,y,z,t)=\vec{E}_0(x,y,z)\cdot\cos(\omega t+\varphi(x,y,z))=\vec{E}_c(x,y,z)\cdot\cos\omega t+\vec{E}_s(x,y,z)\cdot\sin\omega t$, where $\vec{E}_c(x,y,z)$ is the amplitude of harmonic component cos ωt in the point of space (x,y,z), $\vec{E}_s(x,y,z)$ is the amplitude of harmonic component sin ωt in the point of space (x,y,z), and the values $\vec{E}_0(x,y,z)$, ω and φ(x,y,z) were defined earlier, then the pseudopotential $\bar{U}(x,y,z)$ corresponding to the given RF electrical field would be calculated using the formula $\bar{U}(x,y,z)=q(|\vec{E}_c|^2+|\vec{E}_s|^2)/(4m\omega^2)$, where q is the charge of a particle, and m is its mass. If the RF field under consideration is a time-dependent periodic function, so that the electric filed intensity $\vec{E}(x,y,z,t)$ in the point of space (x,y,z) at the point of time t can be represented as a Fourier series in the form of $\vec{E}(x,y,z,t)=\Sigma\vec{E}_c^{(k)}(x,y,z)\cos(k\omega t)+\vec{E}_s^{(k)}(x,y,z)\sin(k\omega t)$, where $\vec{E}_c^{(k)}(x,y,z)$ is the amplitude of harmonic component cos kωt of electric field in the point of space (x,y,z), $\vec{E}_s^{(k)}(x,y,z)$ is the amplitude of harmonic component sin kωt of electric field in the point of space (x,y,z), k is the number of harmonic component, ω is fundamental frequency of the RF electric field, then the pseudopotential $\bar{U}(x,y,z)$ of such RF electric field would be calculated as a sum of contributions of individual harmonic components, using the formula $\bar{U}(x,y,z)=q\Sigma(|\vec{E}_c^{(k)}(x,y,z)|^2+|\vec{E}_s^{(k)}(x,y,z)|^2)/(4m\omega^2k^2)$, where q is the charge of a particle, and m is its mass. If in addition to the RF electric field $\vec{E}(x,y,z,t)$, there is an electrostatic field having potential of U(x,y,z), the electrostatic potential U(x,y,z) and the pseudopotential $\bar{U}(x,y,z)$ would be summed. If there are several different RF electric fields with essentially different frequencies, then individual pseudopotentials would be summed for these electric fields, however, if the difference between the frequencies of these RF fields is insignificant, this rule would not be valid. If, for the purpose of simulation of charged particle kinetic energy reduction as a result of collisions with gas molecules, an effective viscous friction is introduced, having an impact on the charged particle with a force $\vec{F}=-\gamma(\vec{v}-\vec{v}_0)$, where $\vec{v}(t)$ is the velocity of particle at time t, $\vec{v}_0(x,y,z)$ is the velocity of gas molecules in the point (x,y,z), and γ is the viscous friction coefficient, which does not depend on time, coordinates, and electric field, then the result of "slow" motion of charged particle would be as if all the three factors (electrostatic potential, pseudopotential and viscous friction) were affecting the charged particle simultaneously and independently.

It should be emphasised that the description of motion of a charged particle, using pseudopotential, only represents a mathematical approximation, obtained under certain assumptions as regards the motion of charged particle, and may not correspond to its actual motion. In this respect, for the purpose of analysis of charged particle motion in the above mentioned radio-frequency quadrupole mass filters and radio-frequency ion traps, it would be necessary to perform a rigorous analysis of motion of a charged particle in the actual electric fields (i.e., Mathieu equation theory), in order to obtain the correct structure of the zones of stability of motion. The approach based on the use of pseudopotential would not give a correct solution, because under the conditions where a charged particle moves near the boundary of the zone of stability, and a resonance takes place between "slow" oscillations of the charged particle and the RF electric field, the displacement of the charged particle during one period of the RF electric field under no conditions could be considered to be small.

The present inventors have considered the operation of the device of U.S. Pat. No. 6,812,453 in more detail.

The device under consideration contains a system of electrodes representing a series of coaxially positioned plates with apertures arranged to create internal space between the electrodes, the space directed along the longitudinal axis of the device, and intended for transmission of ions within the same. The device also includes a source of power supply, which provides supply voltage to be applied to the electrodes, including alternating high frequency voltage component, the positive and negative phases of which are applied alternately to the electrodes, and quasi-static voltage component, for creation of which, static or quasi-static voltages are applied to the electrodes successively and alternately, in particular, in the form of unipolar or bipolar pulses of a DC voltage.

The said device creates an electric field, the intensity of which $\vec{E}(x,y,z,t)$ is described by the expression $\vec{E}(x,y,z,t)=\vec{E}_a(x,y,z,t)+\vec{E}_0(x,y,z)f(t)$, where $\vec{E}_a(x,y,z,t)$ is a quasi-static electric field varying along the length of the channel for charged particles transportation, depending on the spatial coordinates (x,y,z) and time t, $\vec{E}_0(x,y,z)$ is time-independent and non-uniform, at least in a radial direction, amplitude of the RF electric field, depending on spatial coordinates (x,y,z)

and independent on time t, $f(t)=\cos(\omega t+\varphi)$ is the rapidly oscillating function of time t, which in this particular case describes strictly harmonic oscillations with the frequency $\omega$ and initial phase $\varphi$. Quasi-static behaviour of the function $\vec{E}_a(x,y,z,t)$ and the rapidness of oscillations of the function $f(t)$ are understood in the sense that during a period where the function $f(t)$ has time to perform several oscillations, the function $\vec{E}_a(x,y,z,t)$ remains practically unchanged. Mathematical notation of this condition is written in the form of inequality $|\partial\vec{E}_a/\partial t|^2/|\vec{E}_0|^2 \ll |df/dt|^2$, which should be satisfied, in order that the device would function properly. Thereby variation of the electric field $\vec{E}(x,y,z,t)$ with time would have two time scales: a "fast time", during which the value of the function $\vec{E}_0(x,y,z)\ f(t)$ would be noticeably changed, and a "slow time", during which the value of the function $\vec{E}_a(x,y,z,t)$ would be noticeably changed.

FIGS. 1 to 9 assist with understanding the operation of the device of U.S. Pat. No. 6,812,453. FIG. 1 demonstrates a round diaphragm used as a single electrode for the device according to U.S. Pat. No. 6,812,453. FIG. 2 shows the arrangement of the aggregate of round diaphragms with respect to the channel for charged particles transfer, according to U.S. Pat. No. 6,812,453. FIG. 3 shows the distribution of axial component of the intensity of electric field according to U.S. Pat. No. 6,812,453 along the length of the channel for charged particle transportation, for a series of close points in time t, t+δt, t+2δt, t+3δt, . . . (that is, in a "fast" time scale). FIG. 4 shows variation of the envelope of axial component of the electric field of U.S. Pat. No. 6,812,453 along the length of channel, for a number of points in time t and t+Δt, located sufficiently far from each other (that is, in a "slow" time scale). The radial component of the electric field equals zero at the axis of the device of U.S. Pat. No. 6,812,453 due to the symmetrical configuration of the electrodes. FIG. 5 shows a two-dimensional distribution of pseudopotential $\overline{U}_0(x,y,z)$ along the length of the channel for charged particle transportation, and in a radial direction of the channel for transportation, which corresponds to the RF electric field according to U.S. Pat. No. 6,812,453. FIG. 6 shows possible two-dimensional distribution (at some point in time) of the potential $U_a(x,y,z,t)$ of the quasi-static electric field $\vec{E}_a(x,y,z,t)$ of U.S. Pat. No. 6,812,453. FIG. 7 shows possible distribution of the potential $U_a(x,y,z,t)$ of quasi-static electric field $\vec{E}_a(x,y,z,t)$ of U.S. Pat. No. 6,812,453, along the length of the channel for charged particle transportation. FIG. 8 shows possible summary electric voltages, which can be applied to the first, second, third, fourth electrode, respectively, in each group of four repetitive electrodes, according to U.S. Pat. No. 6,812,453. (In these examples, the simplest possible case is considered, of the progressive wave of quasi-static potential $U_a(x,y,z,t)$, formed along the channel intended for the motion of charged particles, according to U.S. Pat. No. 6,812,453, viz., the case of a wave having purely sinusoidal waveform.)

According to U.S. Pat. No. 6,812,453 the charged particles are "forced" towards the axis of the device as a result of the action of the RF field and formation of the pseudopotential $\overline{U}_0(x,y,z)$ over the radius thereby forming a barrier farther from the axis of the device, and after damping of kinetic energy to equilibrium value, appear to be collected in the neighbourhood of the axis of the device. Due to the presence of the distribution of the quasi-static electric potential with alternating local minima and maxima along the axis of the device, positively charged particles are not just concentrated around the axis of the device, but are collected in local minima of the quasi-static electric potential, as soon as their kinetic energy proves to be lower than the local maxima of the quasi-static electric potential. Respectively, the negatively charged particles, after cooling as a result of collisions with gas molecules, are collected in local maxima of the quasi-static electric potential (the positively charged particles are affected by the force directed against the gradient of the electric potential, while negatively charged particles are affected by the force directed along the gradient of the electric potential).

The fact that at some interval along the length of the axis (in particular, in the neighbourhood of the minima of electric potential for positively charged particles and in the neighbourhood of the maxima of electric potential for negatively charged particles), while moving away from the axis, the radial electric field of quasi-static potential repels the charged particles from the axis of the device, is of no importance, since the repelling action of the RF field, returning the charged particles back to the axis of the device is overbalancing i.e. dominant. When the wave of the quasi-static potential $U_a(x,y,z,t)$ travels slowly along the axis of the device, it captures the charged particles, located near the axis of the device in the neighbourhood of local maxima and minima of the quasi-static potential, while forcing the particles having different masses and different kinetic energies to move synchronously. The process is shown schematically in FIG. 9. Note that this results in alternating groups of positively and negatively charged particles.

Numerical simulation by the present inventors of the actual motion of charged particles in the described electric fields confirms this qualitative picture of motion. For output devices operating in pulsed mode, this method of separation of a continuous flow of charged particles into discrete portions seems to be the most successful. With a correct setting of time intervals between arrivals of individual discrete portions of charged particles from the output of the transporting device and correspondingly, to the input of the next device (which, as a rule, represents a mass analyser operating in pulsed mode), and the time of the next analysis of arrived portion of charged particles, this method allows analysis of all the charged particles from the continuous beam into the analyser, practically without losses.

However, the device of U.S. Pat. No. 6,812,453 does not provide a capability of combining positively and negatively charged particles in a single transported packet.

SUMMARY OF THE INVENTION

At its most general, the present invention proposes that a device for manipulating charged particles contains a set of electrodes arranged to form a channel for transportation of charged particles, as well as a source of power supply that provides supply voltage to be applied to the electrodes, the voltage to ensure creation, inside the said channel, of a non-uniform electric field, the pseudopotential of which field has one or more local extrema along the length of the channel for charged particle transportation wherein at least one of the said extrema of the pseudopotential moves along the length of the channel with time for transportation of the charged particles. The non-uniform electric field can be an RF electric field.

Thus the present invention is distinguished from the device of U.S. Pat. No. 6,812,453 at least in that the pseudopotential of the electric field created inside the channel for charged particle transportation has one or more local extrema along the length of the channel for charged particle transportation, at least within a certain interval of time, whereas, at least one said extrema of the pseudopotential moves with time (i.e. moves within a certain interval of time along a certain part of the length of the channel for transportation of charged particles).

With reference to the device of the present invention, it can be stated that in applying the voltages specified in the above mentioned patents (U.S. Pat. No. 5,818,055 and U.S. Pat. No. 6,894,286), there would be no wave of pseudopotential propagating along the channel of transportation of charged particles and enabling capture of the charged particles into local zones of the pseudopotential minima. Indeed, transportation along the axis of the device could be achieved through applying of constant difference of voltages between adjacent plates, enabling the creation of an electrostatic field along the axis of the device by analogy with U.S. Pat. No. 5,847,386 and U.S. Pat. No. 6,111,250, however, extraction of charged particles from the device would still not be discrete and synchronised in time.

The device of the present invention is referred to herein as an "Archimedean device" and the movement of the extrema of the pseudopotential along the channel is referred to herein as an "Archimedean wave".

The present invention also includes an instrument/apparatus comprising the device, in particular a mass spectrometer comprising the device.

The present invention also includes methods corresponding to the device. In particular, the present invention provides a method of operating the device and also a method comprising steps corresponding to the functions referred to herein with respect to the operation of the device.

An advantage of the present invention is the capability of combining positively and negatively charged particles in a single transported packet.

Where the present application refers to "charged particle (s)", this includes a reference to ion(s), being a preferred charged particle with which the present application is concerned.

Where the present application refers to "with a certain interval of time", this includes a reference to a desired or predetermined or preselected interval or period of time.

The power supply can also encompass the generation and/or provision of additional voltages to the electrodes as discussed herein.

As discussed herein in more detail, the present inventors have found that further advantages are achievable when the voltages supplied by the power supply are generated using a digital method. That is, the supply voltages have the form of a digital waveform. The advantages associated with digital drive/digital method approach and the implementation of such an approach are discussed in more detail below.

The present inventors have also found that significant advantages can be achieved if the supply voltages are one or more selected from high-frequency harmonic voltages, periodic non-harmonic high-frequency voltages, high-frequency voltages having a frequency spectrum which contains two or more frequencies, high-frequency voltages having frequency spectrum which contains an infinite set of frequencies, and high-frequency pulsed voltages, wherein the said voltages are suitably converted into time-synchronised trains of high-frequency voltages and/or a superposition of the said voltages is used. The use of these waveforms, singly or in combination, optionally with the methods of modulation disclosed herein, allow the device to be configured to the wide range of applications described herein by adjusting the shape of the created pseudopotential. The shape of the pseudopotential is important for the optimizing the device for application to which it is being applied or the mode of operation within a particular device. For example by adjusting the harmonics provided by the voltage supply the device can be configured to provide optimum performance for a particular application, for example one or more of achieving a maximum mass range of transmission, maximum amount charge transmitted, allowing ions to be resonantly excited within certain regions, collecting ions with high energy spread, separating ions according to mass or mobility, and fragmenting ions by low energy electrons. Thus, this feature permits a wider range of applications to be achieved in a more flexible, reliable and efficient manner compared with prior art devices.

In embodiments, the pseudopotential has alternating maxima and minima, at least along a part of the length of the channel for transportation of charged particles.

In embodiments, the extremum (maximum or minimum), or extrema (maxima or minima) of the pseudopotential move with time (e.g. according to a specified law) at least along a part of the length of the channel, at least within a certain interval of time.

In embodiments, the direction of travelling of the extremum or extrema of the pseudopotential, at least for a part of the length of the said channel, changes its sign at a certain point or points in time.

In embodiments, relocation of the extremum or extrema of the pseudopotential, at least along a part of the length of the said channel, has an oscillatory behaviour at least within a certain interval of time. That is, the location of the extremum or extrema suitably oscillates, for example between first and second locations.

In embodiments, the pseudopotential is uniform along the length of the channel, at least within a certain interval of time, at least along a part of the transporting channel.

In embodiments, the consecutive extrema, or only the consecutive maxima, or only the consecutive minima of the pseudopotential are monotone increasing (increase monotonically), at least along a part of the channel, at least within a certain interval of time.

In embodiments, consecutive extrema, or only the consecutive maxima, or only the consecutive minima of the pseudopotential are monotone decreasing (decrease monotonically), at least along a part of the channel, at least within a certain interval of time.

In embodiments, the value of the pseudopotential at one or more points of the local maximum of the pseudopotential varies along the length of the channel, at least within a certain interval of time.

In embodiments, the value of the pseudopotential at one or more points of the local minimum of the pseudopotential varies along the length of the channel, at least within a certain interval of time.

In embodiments, additional DC voltages, and/or quasi-static voltages, and/or AC voltages, and/or pulsed voltages, and/or RF voltages are applied to the electrodes, the voltages providing the control of radial confinement of charged particles within the area (region) of the channel used for transportation of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the radial confinement of the charged particles. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing unlocking and/or locking the escaping of charged particles through the ends of the channel used for transportation of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to provide the said unlocking and/or locking (i.e. selective blocking of escape/exit of charged particles). The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing the control of spatial isolation of the packets of charged particles from each other along the length of the channel used for transportation of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the said spatial isolation. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing control of time synchronisation of transportation of the packets of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the said time synchronisation. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing additional control of the transportation of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the said transportation of charged particles. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing the control of motion of charged particles inside local zones of capture of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the said motion of charged particles. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing creation of additional potential or pseudopotential barriers, and/or potential or pseudopotential wells along the channel for transportation of charged particles, at least at one point of the charged particle path within the said channel, at least within some interval of time. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to provide the said potential or pseudopotential barriers. The said voltage supply means can be part of the power supply unit that provides the supply voltages to create the high frequency electric field.

In embodiments, the said potential or pseudopotential barriers, and/or potential or pseudopotential wells vary with time or travel with time along the transportation channel, at least within some interval of time.

In embodiments, additional DC voltages, and/or quasi-static voltages, and/or AC voltages, and/or pulsed voltages, and/or RF voltages are applied to the electrodes, the voltages providing creation of additional zones of stability and/or additional zones of instability along the channel used for transportation of charged particles, at least at one point of the charged particle path within the said channel, at least within some interval of time. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to control the said zones of stability and/or instability. The said voltage supply means can be part of the power supply unit that provides the supply voltages to create the high frequency electric field.

In embodiments, the said zones of stability and/or zones of instability vary with time or travel with time along the transportation channel, at least within some interval of time.

In embodiments, additional DC voltages, and/or quasi-static voltages, and/or AC voltages, and/or pulsed voltages, and/or RF voltages are applied to the electrodes, the voltages providing selective extraction of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to provide selective extraction of charged particles. The said voltage supply means can be part of the power supply unit that provides the supply voltages to create the high frequency electric field.

In embodiments, additional DC voltages, and/or quasi-static voltages, and/or AC voltages, and/or pulsed voltages, and/or RF voltages are applied to the electrodes, the voltages providing the control of essential dependence of the motion of charged particles on the mass of charged particles. Thus, in embodiments, the device comprises DC voltage supply means and/or quasi-static voltage supply means and/or AC voltage supply means and/or pulsed voltage supply means and/or RF voltage supply means configured to apply the said voltage to the electrodes so as to provide control of the dependence of the motion of the charged particles on the mass of the charged particles.

In embodiments, a supply voltage is applied to the electrodes, the frequency of which voltage varies at least within some interval of time. Thus, in embodiments, the device comprises supply voltage means configured to apply a voltage to the electrodes, the frequency of which varies with time.

In embodiments, the channel for charged particle transportation has a rectilinear orientation. That is, the channel is a rectilinear channel.

In embodiments, the channel for charged particle transportation has a curvilinear orientation. That is, the channel is a curvilinear channel.

In embodiments, the channel for charged particle transportation has variable profile along the length of the channel. That is, the cross-section of the channel varies along its length.

In embodiments, the channel for charged particle transportation is closed to form a loop or a ring. That is, the channel is a closed channel, suitably a loop channel or ring channel.

In embodiments, an additional electrode or electrodes are located in the central part of the channel for charged particle transportation.

In embodiments, the channel for charged particle transportation is subdivided into segments. That is, the channel comprises a plurality of segments.

In embodiments, the channel for charged particle transportation consists of a series of channels attached to each other, possibly, interfaced by additional zones or devices. That is, the device comprises a plurality of channels, which plurality of channels are attached or joined to each other.

In embodiments at least in a part of the channel, the channel is formed by a number of parallel channels for charged particle transportation.

In embodiments, at least in a part of the channel, the channel for charged particle transportation is split into a plurality of parallel channels.

In embodiments, a number of parallel channels for charged particle transportation are connected or joined together, suitably along a sector thereof, to form a single channel for charged particle transportation.

In embodiments, the channel for charged particle transportation contains a storage region/area, which storage region/area performs the function of a storage volume for charged particles, the said storage region/area being located at the inlet to the channel, and/or at the outlet from the channel, and/or inside the channel (that is, located in the channel between the inlet and outlet).

In embodiments, the channel for charged particle transportation is plugged/closed, at least, at either end, at least, within a certain interval of time. That is, the device is configured to (e.g. comprises channel closing means configured to) close one or both ends of the channel (inlet and/or outlet).

In embodiments, the channel for charged particle transportation has a stopper controlled by electric field, at least at one of the ends.

In embodiments, the channel for charged particle transportation contains a mirror controlled by electric field, the said mirror placed in the channel for charged particle transportation, at least at one of the ends. That is, the device comprises an electric field mirror in the channel for reflection of charged particles, the mirror suitably being located at one or both ends of the channel (inlet and/or outlet).

In embodiments, the device contains an inlet device for inlet (i.e. introduction) of charged particles to the channel, and located in the channel for charged particle transportation, wherein the said inlet device may operate in a continuous mode.

In embodiments, the device contains an inlet device used for inlet (i.e. introduction) of charged particles to the channel, and located in the channel for charged particle transportation, wherein the said inlet device may operate in a pulsed mode.

In embodiments, the device contains an inlet device used for inlet (i.e. introduction) of charged particles to the channel, and located in the channel for charged particle transportation, wherein the said inlet device is capable of switching between a continuous mode of operation and a pulsed mode of operation.

In embodiments, the device contains an outlet device for outlet (i.e. exit or ejection) of charged particles (from the channel), and located in the channel for charged particle transportation, wherein the said outlet device may operate in a continuous mode.

In embodiments, the device contains an outlet device for outlet (i.e. exit or ejection) of charged particles, and located in the channel for charged particle transportation, wherein the said outlet device may operate in a pulsed mode.

In embodiments, the device contains an outlet device for outlet (i.e. exit or ejection) of charged particles, and located in the channel for charged particle transportation, wherein the said outlet device is capable of switching between a continuous mode of operation and a pulsed mode of operation.

In embodiments, the device contains generation means (e.g. a generation device) for generation of charged particles, and located in the channel for charged particle transportation, wherein the said charged particle generating device may operate in a continuous mode.

In embodiments, the device contains generation means (e.g. a generation device) for generation of charged particles, and located in the channel for charged particle transportation, wherein the said charged particle generating device may operate in a pulsed mode.

In embodiments, the device contains generation means (e.g. a generation device) for generation of charged particles, and located in the channel for charged particle transportation, wherein the said charged particle generating device is capable of switching between a continuous mode of operation and a pulsed mode of operation.

In embodiments, the supply voltages used have the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, wherein the said voltages suitably undergo amplitude modulation and/or a superposition of the said voltages is used. That is, the device comprises voltage supply means configured to provide the above-mentioned frequency, amplitude and superposition characteristics. The said voltage supply means can be part of the said power supply unit.

In embodiments, the supply voltages used have the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, wherein the said voltages suitably undergo amplitude modulation and/or a superposition of the said voltages is used, and wherein the said voltages suitably undergo frequency modulation and/or a superposition of the said voltages is used. That is, the device comprises voltage supply means configured to provide the above-mentioned frequency, amplitude and superposition characteristics. The said voltage supply means can be part of the said power supply unit.

In embodiments, the supply voltages used have the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, wherein the said voltages suitably undergo phase modulation and/or a superposition of the said voltages is used. That is, the device comprises voltage supply means configured to provide the above-mentioned frequency, phase and superposition characteristics. The said voltage supply means can be part of the said power supply unit.

In embodiments, the supply voltages used have the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, wherein the said voltages suitably feature two or more neighbour fundamental frequencies and/or a superposition of the said voltages is used. That is, the device comprises voltage supply means configured to provide the above-mentioned frequency superposition characteristics. The said voltage supply means can be part of the said power supply unit.

In embodiments, the supply voltages used have the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, wherein the said voltages are suitably converted into time-synchronised trains of high-frequency voltages and/or a superposition of the said voltages is used. That is, the device comprises voltage supply means (e.g. the said power supply unit) configured to provide the above-mentioned frequency and superposition characteristics. As noted above and discussed in more detail below, the provision of the above-mentioned specific voltages is particularly preferred.

In embodiments, the supply voltages used have the form of high-frequency voltages synthesised using a digital method. That is the device includes digital voltage supply means configured to provide a digital waveform. The digital voltage supply means can be part of the said power supply unit. As noted above and discussed in more detail below, the provision of a digital waveform (i.e. generation of supply voltages using a digital method) is particularly preferred.

In embodiments, the electrodes forming the channel comprise a plurality, group or aggregate of electrodes.

In embodiments, the aggregate of electrodes represents repetitive electrodes. That is, the group or aggregate of electrodes comprises a series of electrodes, suitably arranged along the length of the channel.

In embodiments, the aggregate of electrodes represents repetitive cascades of electrodes, wherein configuration of electrodes in an individual cascade is not necessarily periodical, i.e. can be periodical or non-periodical. That is, the electrodes can be in the form of, or comprise a, plurality of sub-groups. Within each sub-group the electrodes can be periodical or non-periodical. Respective sub-groups or cascades can be the same or different.

In embodiments, some of the electrodes or all the electrodes can be solid (i.e. continuous), whereas the other electrodes or a part of the other electrodes are disintegrated (i.e. discontinuous) to form a periodic string/series of elements.

In embodiments, high-frequency voltages may not be applied to certain electrodes. That is, the supply voltage is applied to some but not all of the electrodes.

In embodiments, certain electrodes, or all the electrodes in the aggregate of electrodes have a multipole profile. That is, the electrodes form or are a multipole.

In embodiments, certain electrodes, or all the electrodes in the aggregate of electrodes have a multipole profile, e.g. a coarsened multipole profile, formed by plane, stepped, piecewise-stepped, linear, piecewise-linear, circular, rounded, piecewise-rounded, curvilinear, piecewise-curvilinear profiles, or by a combination of the said profiles.

In embodiments, certain electrodes, or all the electrodes in the aggregate of electrodes, are formed from thin metallic films deposited on a non-conductive substrates.

In embodiments, certain electrodes, or all the electrodes in the aggregate of electrodes are wire and/or mesh, and/or have slits and/or other additional apertures making the said electrodes transparent for gas flow, or enabling reduction of the resistance for the gas flow through the said electrodes. That is, some or all of the electrodes are configured (e.g. by provision of a slit or other aperture) to permit gas flow through the electrode.

In embodiments, vacuum is created in the channel used for charged particle transportation. That is, the device comprises vacuum generation means to provide a vacuum in the channel.

In embodiments, the channel for charged particle transportation is filled with a neutral gas, and/or (partly) ionised gas. That is, the device comprises gas supply means for supplying gas to the channel, suitably to achieve a gas flow in the channel.

In embodiments, a flow of neutral and/or (partly) ionised gas is created in the channel used for charged particle transportation.

In embodiments, several electrodes or all of the electrodes have slits and/or apertures intended for inlet of charged particles into the device, and/or outlet of charged particles from the device. That is, some or all of the electrodes are configured (e.g. by provision of a slit or other aperture) to permit inlet into and/or outlet from the channel of charged particles through the electrode.

In embodiments, the gap between the electrodes is used for inlet of charged particles into the device, and/or outlet of charged particles from the device. That is, the electrodes are configured such that a gap is provided between adjacent electrodes through which charged particles are delivered into or exit from the channel.

In embodiments, additional pulsed or stepwise voltages are applied, at least to a part of electrodes, at least within some interval of time, the said voltages enabling inlet of charged particles into the device, and/or outlet of charged particles from the device, and/or confinement of charged particles within the device. That is, the device comprises additional voltage supply means configured to provide the above-mentioned pulsed or stepwise characteristics so as to effect the said inlet and/or outlet and/or confinement. The additional voltage supply means can be part of the said power supply unit.

In the device of the present application, as opposed to the device of U.S. Pat. No. 6,812,453 described above, the behaviour of rapidly oscillating electric field, the said field being non-uniform along the channel used for transportation of charged particles, is governed by different regularities. This enables not only splitting of the existing ensemble of charged particles into spatially separated packets of charged particles and move them synchronously along the channel used for transportation regardless of their masses and kinetic energies, but additionally the combining of both positively charged and negatively charged particles, in a single packet.

We shall consider the features of behaviour of a high-frequency electric field used in the device of the present application, through a case study. We shall take an electric field having intensity $\vec{E}(x,y,z,t)$, which is described by the expression $\vec{E}(x,y,z,t)=\vec{E}_a(x,y,z,t)\,f(t)$, where $\vec{E}_a(x,y,z,t)$ is a quasi-static amplitude of oscillations of electric filed, varying along the length and along the radius of the channel for charged particle transportation, which amplitude is dependent on spatial coordinates (x,y,z) and time t, and $f(t)$ is a rapidly oscillating function of time with zero average value, in particular case, having the form of harmonic oscillations $f(t)=\cos(\omega t+\varphi)$, where $\omega$ is the frequency of harmonic oscillations, and $\varphi$ is the initial phase of harmonic oscillations. Quasi-static behaviour of the function $\vec{E}_a(x,y,z,t)$ and the rapidness of oscillations of the function $f(t)$ are understood in the sense that during a period where the function $f(t)$ has time to perform several oscillations, the function $\vec{E}_a(x,y,z,t)$ remains practically unchanged. Mathematical notation of this condition can be written in the form of inequality $|\partial\vec{E}_a/\partial t|^2/|\vec{E}_a|^2 \ll |df/dt|^2/|f(t)|^2$, and total derivative with respect to time t of the intensity of electric field $\partial\vec{E}(x,y,z,t)/\partial t=(\partial\vec{E}_a/\partial t)f(t)+\vec{E}_a(df(t)/dt)$, contribution of the term $\vec{E}_a(df(t)/dt)$ outbalances considerably contribution of the term $(\partial\vec{E}_a/\partial t)f(t)$.

Variation of the above electric field $\vec{E}(x,y,z,t)$ with time t has two time scales: "fast time", within which time the value of the function $f(t)$ would be noticeably changed, and "slow time", within which time the value of the function $\vec{E}_a(x,y,z,t)$ would be noticeably changed. In the first approximation "slow", or "averaged" motion of charged particle in such a field is described by "slowly" varying pseudopotential $\overline{U}(x,y,z,t)$ with time, where the term "slowly" means that characteristic time interval of noticeable variation of the pseudopotential $\overline{U}(x,y,z,t)$ is much greater than characteristic time interval required for a single oscillation is much greater than characteristic time interval necessary to perform a single oscillation of the high-frequency electric field according to the law $f(t)$.

For the case where the law of electric field variation with time has the form of $\vec{E}(x,y,z,t)=\vec{E}_a(x,y,z,t)\cos(\omega t+\varphi)$, where $\vec{E}_a(x,y,z,t)$ is a "slow" time-varying function, and $\cos(\omega t+\varphi)$ is a "fast" time-varying function, describing harmonic oscillations with the frequency $\omega$ and initial phase $\varphi$, the slowly varying pseudopotential $\overline{U}(x,y,z,t)$, affecting a charged particle having the charge q and mass m, is expressed through quasi-static amplitude $\vec{E}_a(x,y,z,t)$ of the oscillations of electric field, as $\overline{U}(x,y,z,t)=q|\vec{E}_a(x,y,z,t)|^2/(4m\omega^2)$. In a more general case, where the law of time-dependent variation of electric field is periodic, but not harmonic, and the intensity of electric field $\vec{E}(x,y,z,t)$ in the point of space (x,y,z) as a time-varying function of t is presented in a canonical form as Fourier series $\vec{E}(x,y,z,t)=\Sigma\vec{E}_c^{(k)}(x,y,z,t)\cos(k\omega t)+\vec{E}_s^{(k)}(x,y,z,t)\sin(k\omega t)$, where $\vec{E}_c^{(k)}(x,y,z,t)$ is a "slow" amplitude of "fast" harmonic component $\cos(k\omega t)$ of electric field $\vec{E}(x,y,z,t)$, $\vec{E}_s^{(k)}(x,y,z,t)$ is a "slow" amplitude of "fast" harmonic component $\sin(k\omega t)$ of electric field $\vec{E}(x,y,z,t)$, k is harmonic number, $\omega=2\pi/T$ is fundamental circular frequency of time-periodic function $\vec{E}(x,y,z,t)$, having the period T, then the pseudopotential $\overline{U}(x,y,z,t)$ varying slowly with time is calculated as $\overline{U}(x,y,z,t)=q\Sigma(|\vec{E}_c^{(k)}(x,y,z,t)|^2+|\vec{E}_s^{(k)}(x,y,z,t)|^2)/(4m\omega^2k^2)$, where q is the charge of a particle m is the mass of a particle. In the most general case, if the intensity of electric field $\vec{E}(x,y,z,t)$ in the point of space (x,y,z) at time t allows expression in the form of $\vec{E}(x,y,z,t)=\Sigma\vec{E}_c^{(k)}(x,y,z,t)\cos(\omega_k t)+\vec{E}_s^{(k)}(x,y,z,t)\sin(\omega_k t)$, where $\vec{E}_c^{(k)}(x,y,z,t)$ and $\vec{E}_s^{(k)}(x,y,z,t)$ are "slow" functions of time t, and where $\cos(\omega_k t)$ and $\sin(\omega_k t)$ are "fast" harmonic oscillations with frequencies $\omega_k$, far enough from each other, then the pseudopotential varying slowly with time would be calculated as $\overline{U}(x,y,z,t)=q\Sigma(|\vec{E}_c^{(k)}(x,y,z,t)|^2+|\vec{E}_s^{(k)}(x,y,x,t)|^2)/(4m\omega_k^2)$, where q is the charge of a particle and m is the mass of a particle.

For the purpose of subdivision of the time-varying functions into "slow" and "fast", the upper boundary $\delta$ is introduced for "slow" frequencies and the lower boundary $\Delta$ is introduced for "fast" frequencies, where $\Delta \gg \delta$. The function h(t) is referred to as "slow", if its spectrum is zero (or is negligibly small) outside the frequency interval $\omega\in(-\delta, +\delta)$. The function H(t) is referred to as "fast", if its spectrum is zero (or is negligibly small) within the frequency interval $\omega\in(-\Delta, +\Delta)$. The above restriction on the spectrum of the functions necessitate the inequalities, valid "on the average" $|dh(t)/dt|^2/|h(t)|^2\leq\delta^2$ and $|dH(t)/dt|^2/|H(t)|^2\geq\Delta^2$. The condition that the frequency $\omega_k$ is considered to be "fast", would be equivalent to the inequality $|\omega_k|\geq\Delta$. The condition that the frequencies $\omega_m$ and $\omega_n$ are located "far enough" from each other, would be equivalent to the inequality $|\omega_m-\omega_n|\geq\Delta$. In order to represent the electric field in the form of $\Sigma(\vec{E}_c^{(k)}(x,y,z,t)\cos(\omega_k t)+\vec{E}_s^{(k)}(x,y,z,t)\sin(\omega_k t))$, it would be enough that the voltages applied to the electrodes vary as $f(t)=\Sigma p_k(t)\cos(\omega_k t)+q_k(t)\sin(\omega_k t)$, where $p_k(t)$ and $q_k(t)$ are "stow" functions, and $\omega_k$ are "fast" frequencies, which are "far from each other". In this way, in order that the signal $f(t)$ could be represented in such canonical form, it would be required that after Fourier transformation, the spectrum of the signal should be broken up into intervals, which intervals should be far from each other, and short enough, outside which intervals the spectral function $F(\omega)$ could be considered to be equal to zero (see FIG. 10). Technically, such signals can be generated, for example, using amplitude modulation, and/or phase modulation, and/or frequency modulation of high-frequency signals, and/or as a superposition of several high-frequency voltages with a number of close frequencies, and/or as a trains of high-frequency voltages of predetermined waveform, time-synchronised. A detailed description of the theory of slowly varying pseudopotentials goes beyond the scope of this description.

We shall consider a particular case of the claimed device, where the radial OZ component of electric field is identically zero, and the axial component $E_z(z,t)$ of electric field varies with time t under the law $E_z(z,t)=E_0\cos(z/L-t/T)\cdot\cos(\omega t)$, where $E_0$ is the amplitude of alternating maxima and minima of the axial distribution of electric field, z is the spatial coordinate along the axis of the device, L is characteristic spatial scale along the axis of the device, T is characteristic time scale for "slow" time, ω is the "fast" frequency of harmonic oscillations of electric field. The condition of quasi-static behaviour of the amplitude of oscillations of the electric field is reduced to the condition $\omega T >> 1$. FIG. 11 shows distribution of the axial component of intensity of the electric field along the length of the channel for charged particle transportation, for a series of close points in time t, t+δt, t+2δt, t+3δt, . . . (that is, in a "fast" time scale). FIG. 12 shows variation of the envelope of axial component of intensity of the electric field along the channel, for a number of points in time t and t+Δt located far enough from each other (that is, in a "slow" time scale). Such a law of time variation of the axial component of electric field is different to that shown in the graphs in FIG. 3 and FIG. 4.

Two-dimensional plot of the pseudopotential of this high-frequency electric field is shown in FIG. 13. Behaviour of the pseudopotential $\overline{U}_*(z,t)$ along the axis OZ is described by the formula $\overline{U}_*(z,t)=(E_0^2/8m\omega^2)(1+\cos(2z/L-2t/T))$, where $E_0$ is the amplitude of the high-frequency field; m is the mass of an ion; ω is the frequency of the high-frequency field; L and T are characteristic length and time, respectively; that is, $\overline{U}_*(z,t)$ represents a sinusoidal wave moving slowly along the axis OZ (see FIG. 14). In the same way as the high-frequency electric field of the device of U.S. Pat. No. 6,812,453, the pseudopotential of which is shown in FIG. 5, the charged particles are repelled from the electrodes by the high-frequency electric field with pseudopotential and concentrated near the axis of the device, as shown in FIG. 13. However, just as the charged particles are repelled by the pseudopotential barrier from the electrodes and concentrated near the axis, the maxima of the pseudopotential repel the charged particles and force them to concentrate in the neighbourhood of the points of the axis where the rapidly changing electric field is characterised by minima of the pseudopotential. Unlike the case of quasi-static electric potential, the charged particles with charges of both polarities are similarly concentrated near the minima of the pseudopotential. In case of "slow" movement of a minimum of the pseudopotential along the axis OZ, the charged particles would be compelled to move synchronously with the minima of the pseudopotential. This process is illustrated in FIG. 15.

Thus, a substantial difference between the electric fields used in U.S. Pat. No. 6,812,453, and the electric fields used in the device of the present invention consists in qualitatively different laws of time-dependent variation of electric fields, which is clearly illustrated by FIGS. 3-4 and FIGS. 11-12. Quantitatively this is defined by the difference in behaviour of the pseudopotentials of the respective high-frequency fields, as shown in FIG. 5 and FIGS. 13-14.

Numerical simulation of the motion of charged particles in the mentioned high-frequency electric field in the presence of neutral gas confirms the qualitative pattern of motion described above. FIGS. 16-18 show the solutions of the respective differential equations for a set of charged particles uniformly distributed at initial moment of time along some interval of the length of the channel used for charged particle transportation, with a certain displacement in radial direction with respect to the axis. FIG. 16 shows the dependence of the coordinate z(t) (which corresponds to the axis of the device), with respect to the time t. FIG. 17 shows the dependence of z(t)−vt, where v is the velocity of the movement of the pseudopotential minima along the transportation channel, which characterises the high-frequency electric field. FIG. 18 shows time dependence of the coordinate r(t) (which corresponds to radial direction), with respect to the time t. One can clearly see that decomposition of the aggregate of charged particles takes place, into spatially separated packets, which are then synchronously transported at a constant velocity v along the transportation channel, according to the movement of minima of the pseudopotential of rapidly oscillating electric field.

The above situation would exist both in the case of transportation of charged particles in vacuum, and in the case of transportation of charged particles in rarefied gas, where scattering of charged particles due to collisions with the molecules of neutral gas is simulated using the Monte-Carlo method. The difference is in the presence of damping gas, those charged particles, not occurred initially in the zone of stability in the neighbourhood of the pseudopotential minimum would skip into one of the preceding zones of stability, then would be captured by the same and continue moving synchronously along the transportation channel with the respective constant displacement of the packet of charged particles along the transportation channel (this process can be seen clearly in FIG. 17). In the absence of a damping action of the gas, those particles occurred within the zone of instability, would skip successively backwards along the transportation channel, from one instability zone to another, while simultaneously oscillating in radial direction, until they finally occur outside the boundaries of the device or collide with the electrodes.

The example shown above illustrates the general principle which forms the basis of the operation of the device of the present invention. If the high-frequency field of some device is characterised by a time-varying pseudopotential having a minimum along the transportation channel for charged particles, the minimum moving with time along the transportation channel, then the charged particles, as a result of action of the said high-frequency field, would be grouped in the neighbourhood of the minimum of the pseudopotential, and while the minimum moves along the transportation channel, time-synchronised movement of thus formed packet of charged particles would take place (FIG. 19). In exactly the same way, in the presence of minimum of the pseudopotential moving along the transportation channel, "pushes" those charged particles located in front of the maximum, out from the transportation channel (FIG. 20). In case where the pseudopotential has alternating maxima and minima along the transportation channel, as in the above example, decomposition would take place, of the ensemble of charged particles entered the transportation channel, into spatially localised separated packets of charged particles, synchronously transferred from the inlet to the outlet (FIG. 21). Due to specific features of the pseudopotential, the said packets of charged particles would combine both positively charged and negatively charged particles having different masses and kinetic energies (kinetic energy should not be so high that the charged particles can overcome the pseudopotential barriers confining the spatially separated packets of charged particles).

Thus, a technical result achieved through the implementation of the present invention is the provision of a capability of combining of positively and negatively charged particles in a single transported packet.

In this way, the device of the present invention, as will be shown below, provides vast capabilities for charged particle manipulation.

In the device of the present invention, the presence of buffer gas in the channel used for transportation of charged particles, for the purpose of damping of their kinetic energies would not be absolutely necessary, and the process of movement of charged particles can be realised in vacuum, if the pseudopotential barriers are high enough.

The electric fields implemented in the device of the present invention and the device of U.S. Pat. No. 6,812,453, are used to perform two different functions: confinement of charged particles in the neighbourhood of the transporting channel and movement of charged particles along the transportation channel. If we were to subdivide the high-frequency voltages applied to the electrodes of the device as described in the U.S. Pat. No. 6,812,453, into confining voltages (that is, primarily those providing confinement of charged particles in radial direction), and control voltages (that is, primarily those providing movement of charged particles along the channel used for transportation of the charged particles), then the control voltages and the electric field thus created in the device of the present invention would be principally different as compared to those used in the device of U.S. Pat. No. 6,812,453, as regards the form and the action of the same on the charged particles. The same would be true in the case of the complete electric field, which represents a sum of the controlling electric field and the confining electric field.

Generally speaking, the availability of additional confining fields in the device of the present invention is not actually necessary, since this function could be successfully performed by the same electric fields, which provide transportation of charged particles. In the case where confining electric fields are provided in the device of the present invention (see below) the confining fields would mostly have the same form as for the device of U.S. Pat. No. 6,812,453. However whereas for the device of U.S. Pat. No. 6,812,453 the presence of confining high-frequency electric fields forms an inherent component of the device, the device of the present invention would not necessarily need the presence of separate confining high-frequency fields, provided that the pseudopotential barriers formed by the controlling high-frequency field are high enough.

To identify that the particular high frequency electric field is related to the claimed class of high-frequency electric fields, it would be necessary to determine the method of calculation of the value of slowly varying pseudopotential as per the prescribed high-frequency electric field. By definition, the pseudopotential $\overline{U}(x,y,z,t)$ is such a scalar function to be calculated according to certain rules through the high-frequency field existing in the system, that the averaged motion of charged particle in the given high-frequency electric field is described by the equation of motion of charged particle in pseudoelectric field $\overline{U}(x,y,z,t)$ accurate within the correction terms of small order. When the voltages $U_n(t)=U_{n0}\cdot f_n(t)$, applied to the electrodes, vary with time like $f_n(t)=\Sigma p_{nk}(t)\cos(\omega_k t)+q_{nk}(t)\sin(\omega_k t)$, where $p_{nk}(t)$ and $q_{nk}(t)$ are the "slow" functions, and $\omega_k$ are "fast" and "located far from each other" frequencies, high-frequency electric field $\vec{E}(x,y,z,t)$ in the point of space (x,y,z) at the point of time t can be represented in the form of $\vec{E}(x,y,z,t)=\Sigma \vec{E}_c^{(k)}(x,y,z,t)\cos(\omega_k t)+\vec{E}_s^{(k)}(x,y,z,t)\sin(\omega_k t)$, where the functions $\vec{E}_c^{(k)}(x,y,z,t)$ and $\vec{E}_s^{(k)}(x,y,z,t)$ are the "slow" time functions, and $\cos(\omega_k t)$ and $\sin(\omega_k t)$ are the "fast" frequencies $\omega_k$, oscillating according to harmonic law, being far from each other. In that case, the pseudopotential varying slowly with time $\overline{U}(x,y,z,t)$, which describes averaged motion of charged particle, shall be calculated according to the formula $\overline{U}(x,y,z,t)=q\Sigma(|\vec{E}_c^{(k)}(x,y,z,t)|^2+|\vec{E}_s^{(k)}(x,y,z,t)|^2)/(4m\omega_k^2)$, where q is the charge of a particle, and m is the mass of a particle. In order that the signals denoted as $f_n(t)$ could be presented in the required canonical form, it would be required that after Fourier transformation, the spectrum of the signal should be broken up into intervals, which should be far enough from each other, and short enough, outside which intervals the spectral function could be considered to be equal to zero (see FIG. 10). This mathematical expression for the pseudopotential is derived based on its physical meaning, where the physical meaning is determinative. For the case of pulsed functions, the formula to be used for calculations of the pseudopotential is constructed in a similar way, with replacing of continuous harmonic components with discrete harmonic components. The generalisation of the theory of pseudopotential onto the class of slowly varying pseudopotentials is believed to be novel, and has not been used before.

Breaking-up of charged particles into local spatially separated packets and transportation thereof from the inlet of the device to the outlet of the device is far from being the only possibility to control behaviour of charged particles with the help of the said high-frequency electric fields.

If, instead the axial high-frequency electric field, varying according to the law $E_z(z,t)=E_0\cos(z/L-t/T)\cdot\cos(\omega t)$, where $E_0$ is the amplitude of the high-frequency field; ω is the frequency of the high-frequency field; L and T are characteristic length and time scales, respectively, we synthesise a high-frequency electric field, the axial component of which would vary under the law $E_z(z,t)=E_0\cos(z/L-g(t))\cdot\cos(\omega t)$, where g (t) is a specified quasi-static function of time, slowly varying with time as compared against the function ωt, then we would thus ensure movement of the centres of packets of charged particles according to the law $z_k(t)=L\cdot g(t)-\pi L(k+½)$ along the transportation channel, instead of a uniform movement. In particular, we would thus obtain a capability to transfer the charged particles to the inlet of the next device at specified points in time, synchronised in time with the pulsed mode of operation of the output device, if necessary.

If, instead of the function z/L in this formula, we use an arbitrary function h(z), we would then obtain a capability of controlling the locations of the centres of packets of charged particles B during the course of transportation, and, for example, intentionally concentrate and/or rarefy the packets along the transportation channel, within certain sectors at certain points in time.

The function g(t), mentioned above, shall not necessarily be a monotone function of time. If it has an oscillating behaviour, then the movement of packets of charged particles along the transportation channel would feature an oscillating pattern. In particular, this could be used to organise cyclic transposition of the packets of charged particles from the inlet to the outlet and back, thus creating a trap for charged particles or a storage volume for intentional manipulations with charged particles.

A purposeful construction of high-frequency electric fields with the values of pseudopotential at the points of minimum and maximum, complying with certain additional requirements, offers additional capabilities for manipulations with charged particles on the basis of the specified general principle. Let us consider, for example, a device, wherein the law of variation of the axial component $E_z(z,t)$ of high-frequency electric field as a function of time t is defined as $E_z(z,t)=E_0(\pi/2+\arctan(z/H))\cdot\cos(z/L-t/T)\cdot\cos(\omega t)$, where $E_0$ is characteristic scale of variation of the amplitude of axial distribution of electric field, z is spatial coordinate along the axis of the channel of transposition of charged particles, H is characteristic spatial scale of "damping" of the oscillations of the pseudopotential, L is characteristic spatial scale of single oscillation of the pseudopotential, T is characteristic "slow" time scale of the transposition of oscillations of the pseudopotential along the axis of the device, ω if "fast" frequency of the high-frequency harmonic oscillations of electric field, where $H \gg L$ and $\omega T \gg 1$, as shown in FIG. 22. Then with $-\infty < z < -2H$, the amplitude of high-frequency electric field would practically be zero, and extremely low local maxima and minima of its pseudopotential shown in FIG. 23 would not have an effect on the movement of charged particles along the axis OZ within the given sector of length of the channel for charged particle transportation. This, with $-\infty < z < 2H$ we would have a zone of storage of charged particles instead of a zone of transportation of charged particles. However, in the course of approach to the point $z=0$, one can observe monotone increasing maxima of the pseudopotential, which form a growing wave, moving along the axis towards $z=+\infty$. Such a structure provides "evacuation" of charged particles from the storage device and consistent transposition towards the outlet from the device, in the form of a set of spatially separated and time-synchronised packets of charged particles.

When supplementing the structure of the pseudopotential described above, with a high-frequency field with distribution along the axis of the device in the form of $E_z(z,t) = 0.45E_0(\pi/2 - \arctan(z/H)) \cdot \sin(\omega t)$, where $E_0$ is characteristic scale of variation of the amplitude of axial distribution of the electric field, z is spatial coordinate on the axis of the charged particles' transfer channel, H is characteristic spatial scale of "damping" of the oscillations of the pseudopotential, ω is "fast" frequency of the high-frequency harmonic oscillations of electric field; we obtain a segment with monotonically decreasing maxima and minima, as shown in FIG. 24, thus enhancing the efficiency of trapping and evacuation of both positively and negatively charged particles. In such a scheme, there would be a rather unpleasant atonement for the enhancement of charged particles' evacuation efficiency, which would consist in the existence of an appreciably nonzero high-frequency field within the storage region, the field continuously "swinging" the charged particles and increasing their average kinetic energy.

A similar addition to the pseudopotential could be organised with the help of a DC electric field to provide the potential $U(z) = U_0(\pi/2 - \arctan(z/H))^2$, where $U_0 = qE_0^2/4m\omega^2$ is the scale of electrostatic potential jump, H is characteristic spatial scale of the "damping" of oscillations of the pseudopotential of high-frequency electric field, $E_0$ is characteristic scale of variation of the amplitude of axial distribution of the electric field, q is the charge of a particle, m is the mass of a particle. However, in that case, attracting of the charged particles having only one polarity of their charges into the trapping zone would take place (FIG. 25 shows the summary attracting potential function acting on positively charged particles, and FIG. 26 shows the summary retracting potential function acting on negatively charged particles). FIG. 27 and FIG. 28 show similar effect, attainable by applying a DC electric field. The structure of electrodes capable of creating a high-frequency field for coupling the zone of storage and regular evacuation of discrete packets of charged particles from the edge of the zone is shown in FIG. 29.

Dynamic decrease, at a certain point of time in the course of transportation of charged particles, of the amplitude of pseudopotential at the point of maximum of the pseudopotential, the point separating two adjacent minima of the pseudopotential, offers new additional capabilities for purposeful manipulations of charged particles. With such an operation, it becomes possible to combine the content of two adjacent packets of charged particles into a single packet of charged particles. In this way, depending on the level to which the maximum of the pseudopotential is decreased, a possibility would exist, of complete integration of the adjacent packets of charged particles, as well as partial transition of charged particles from one packet to the other. In particular, considering the fact that the same distribution of high-frequency field creates different pseudopotentials with different height of barriers for different masses, it is possible to provide a mass-selective exchange of charged particles between adjacent packets.

Instead of variation of the pseudopotential value in the point of maximum, or in parallel with variations of the pseudopotential value in the point of maximum, it is possible to intentionally vary the pseudopotential value in the point of minimum. With an increase of the value of the selected minimum of the pseudopotential above a certain threshold, it would be possible to selectively destroy individual packets of charged particles. Using the same scheme, it would be possible to "transfer" the content of a packet of charged particles into an adjacent packet of charged particles by means of synchronised drop of the maximum of the pseudopotential, located between two minima of the pseudopotential, and rise of one of the two minima of the pseudopotential, and then, restoration of the used area of capture of the charged particles to the previous state, but with no charged particles inside the area. Due to the fact, that the pseudopotential value depends on the mass of a charged particle, and would differ for different particles, this process can be mass-selective.

For the purpose of particularly reliable radial containment of charged particles in the neighbourhood of the transportation channel, the existence of a basic high-frequency electric field characterised by slowly varying pseudopotential with an extremum or extrema travelling along the transportation channel may be supplemented. For provision of particularly reliable radial containment of charged particles, an additional high-frequency or pulsed electric field can be used, the pseudopotential of which has no extremum or extrema travelling along the transportation channel, but which forms an RF barrier for charged particles in case of their retreat from the axis of the device while approaching the electrodes. In the case where it is necessary to temporarily of permanently block the escape of charged particles through an end or both ends of the channel used for transportation of charged particles, the said high-frequency electric fields and RF barriers created by the same may be localised on the axis of the transportation channel, near the respective end or ends of the transportation channel.

In place of high-frequency electric fields, static or quasi-static electric fields can be used for the same purpose. In this way, radial confinement of the beam can be provided using the system of a series of electrostatic lenses, and blocking of the exit of charged particles through an end or ends of the transportation device can be provided using an additional potential barrier, created by means of DC voltage, for example applied to the end electrodes of the transportation channel.

Additional high-frequency or pulsed electric fields, as well as additional static or quasi-static fields can be used in the device for manipulations of charged particles, for purposes other than the enhancement of radial containment of charged particles and/or blocking of the escape of charged particles through the ends of the transportation channel.

These purposes include: a) improved spatial isolation of individual packets of charged particles from each other, and/or b) enhancement of time synchronisation of movement of the packets of charged particles along the transportation channel and/or time synchronisation of extraction of the packets of charged particles from the device and/or time synchronisation of arrival of charged particles into the device, and/or c) additional control of the transportation of charged particles in the device.

A particular case of additional control of the transportation of charged particles is the creation of local potential barriers and/or local potential wells along the route of transportation of charged particles. The said potential barriers and/or potential wells can be created by high-frequency electric fields, as well as static and quasi-static electric fields. High-frequency barriers and/or wells can be used, in particular, for introduction of mass-selective effects into the process of transportation of charged particles. Static and quasi-static barriers and/or wells can be used, in particular, for separation of positively charged particles from negatively charged particles. Potential barriers and/or wells of one type, as well as another type, can be used for blocking and/or unblocking of the transfer of charged particles, variation of kinetic energies of charged particles, etc. The specified potential barriers and/or wells can exist permanently, be switched on and/or switched off within a certain interval or at certain points in time, alter the parameters (height and/or depth), move along the channel of transportation or along a part of length of the transportation channel.

A particular case of additional control of the transportation of charged particles represents the creation of local zones of stability and/or local zones of instability of motion of charged particles along length of the transportation channel. The specified local zones of stability and/or local zones of instability of motion can exist permanently, be switched on and/or switched off within a certain interval or at certain points in time, alter the parameters (height and/or depth), move along the transportation channel, or along a part of length of the transportation channel.

For example, a superposition of static or quasi-static field and a high-frequency field, as it occurs in quadrupole mass-filters, allows creating separate zones, through which zones, only those particles having a defined controllable mass range could be transported. Another way to control the stability of motion, and in particular, to readjust the mass range, corresponding to stable motion of charged particles, consists in readjusting of carrier frequency of the high-frequency voltage, and/or applying of additional high-frequency voltages with multiple frequencies (which corresponds, in the theory of quadrupole RF mass-filters and ion traps, to transition from Mathieu equation to more general Hill equation, thus offering wider capabilities in terms of configuration of the zones of stability).

The local areas of capture of charged particles, limited maxima of the pseudopotential, travelling along the transportation channel, actually represent a set of local ion traps, and these can be treated the same way as in ion traps mass spectrometry. Application of resonance swinging high-frequency voltages to slowly moving along the axis, local areas of capture of charged particles, concentrated around the minima of the pseudopotential of the basic high-frequency field, enables selective extraction of charged particles of certain mass, as it takes place in RF ion traps, as well as realisation of other operations of selective control of the ensemble of charged particles, the operations being well-developed in the mass spectrometry of RF ion traps. The advantage of these operations with local capture areas, rather than with an individual device of the type of a radio-frequency ion trap, is in that these rather time-consuming operations in this case would not cause special pauses in operation of an ion source and ion-analysing device. Really, the specified operations only slow down the time required for transportation of a particular group of particles from the inlet to the outlet, because during the course of operations with a local capture zone, new packets of charged particles continue to enter the device for transportation of charged particles, and the already processed packets of charged particles enter the analysing device.

For the purpose of creation of the above high-frequency, pulsed, static, quasi-static and AC electric fields, one can use additional electrodes of the device, as well as already existing electrodes of the device, to which electrodes, the respective additional voltages can be applied.

The channel for transportation of charged particles can be rectilinear or curvilinear (see FIG. 30 and FIG. 31). The channel for transportation can be closed to form a ring, permanently or within a certain interval of time, or the device can perform bidirectional cyclic shifting of charged particles from the inlet to the outlet and back, continuously or within a certain interval of time (in these cases an ion trap and/or storage device, and/or isolated space for charged particle manipulation would be formed).

The profile of the section of the transportation channel can vary along the length of the channel. A particular case of varying profile is the profile of transportation channel having configuration of funnel, and performs compression of the beam of charged particles in the course of transportation (see FIG. 32).

The channel for transportation can have an additional electrode in the section of the central part, thus performing transportation of annular-shaped packets of charged particles. Thus, the device can be configured to provide transportation of annular-shaped pockets of charged particles, suitably achieved by an annular cross-section profile, for example the provision of a central electrode. For example, FIG. 33 shows single aperture with an additional electrode in the centre, and FIG. 34 shows a channel formed by similar apertures aligned with common axis, thus providing formation of the packets of charged particles, having a structure with annular cross-section.

Instead of creation of the packets of charged particles with annular cross-section, the additional electrode or additional system of electrodes in the centre of the channel for charged particle transportation can be used to subdivide the main channel into a number of uncoupled areas of capture of charged particles, i.e., a number of daughter channels for charged particle transportation. An example of single aperture which provides such electrode configuration is shown in FIG. 35. Despite the fact that geometrical area used for the transportation of charged particles, shown in FIG. 35, represents a connected ring, due to the features of the structure of the high-frequency electric fields created within the space of the channel, this area disintegrates into a number of mutually uncoupled areas of capture of charged particles. The charged particles move independently within each capture area, and in each capture area a possibility exists, of independent control of the motion of charged particles with the help of additional electric fields created by additional voltage applied to the respective parts of periodical series of apertures.

The channel for transportation can be can be subdivided into separate segments, with transportation of charged particles in each of the segments having its own specificity, i.e. operating independently. The channel for transportation can comprise a series of transportation channels separated by transition zones and/or devices.

The transportation channel can comprise a number of channels, which channels can operate in parallel. The channel for transportation can split into a number of parallel/daughter channels (see FIG. 36). For example, each channel is adjusted to transport a well-defined mass range, "drawn" from the common transportation channel. Similarly, a number of parallel/daughter channels for charged particle transportation can be united/merged into an integrated/common channel for charged particle transportation (see FIG. 37). For example, this arrangement can be used to perform dynamic switching between different sources of charged particles and/or mixing of different beams of charged particles into an integrated/common beam of charged particles. The method, with which the channel becomes split into several daughter channels, and/or integration of several daughter channels into an integrated channel, can be implemented using a specially arranged high-frequency electric field instead of a rigid structure formed using additional electrodes, as referred to earlier in respect of FIG. 35. Finally, the structure of transportation channel can contain an area performing the function of storage volume for charged particles (see FIG. 38).

In the case of alternately-bidirectional transportation of charged particles, or in the case where the charged particles are used, and/or analysed directly within the channel of transportation, one or both the ends of the channel of transportation can be plugged (i.e. blocked or closed). The plug can have a form of a permanent design feature, or can be controlled by electric field. For reflection of charged particles towards the opposite direction, and for creation of a delay required for readjustment of the control voltages for transportation of charged particles in the opposite direction, the plug can be arranged as an electron-optical mirror, using both static and quasi-static electric fields, as well as high-frequency electric fields. Thus, the device can comprise one or more mirrors, suitably at one or both ends (inlet and outlet) of the channel.

For the charged particles to enter the channel for transportation of charged particles, an input device for charged particles can be arranged, operating in a continuous mode, or in pulsed mode, or capable of switching between pulsed mode and continuous mode of operation. For the purpose of extraction of charged particles from the channel of transportation of charged particles, there can be a extraction device for extraction of charged particles, operating in a continuous mode, or in pulsed mode, or capable of switching between pulsed mode and continuous mode of operation. For the purpose of generation of charged particles directly in the channel for transportation of the charged particles, there can be a generation device, generating charged particles, operating in a continuous mode, or in a pulsed mode, or capable of switching between pulsed mode and continuous mode of operation. In particular, for the purpose of generation of charged particles directly in the channel for transportation of the charged particles, the process of fragmentation of the primary charged particles, the process of formation of secondary charged particles as a result of interaction with neutral or oppositely charged particles, ionization of the charged particles with the help of this or that process of ionisation can be used.

For the purpose of creation of the required high-frequency electric field within the space of the channel for transportation of charged particles, electric voltages of different types can be used.

As an example, we shall consider a channel for transportation of charged particles, using axial high-frequency electric field in the form of $E_z(z,t)=(U_0/L)\cos(z/L-t/T)\cdot\cos(\omega t)$, where $U_0$—amplitude; $\omega$—frequency of the high-frequency field; L, T—characteristic length and time, respectively; defined by electric potential $U(z,r,t)=U_0\sin(z/L-t/T)\cdot(1+r^2/4L^2+r^4/64L^4+\ldots)\cos(\omega t)$ (the value r is determined as $r=\sqrt{x^2+y^2}$). A pseudopotential having the value of $\overline{U}(z,t)=(U_0^2/(2L)^2)(1+\cos(2z/L-2t/T))$ on the axis (see FIG. 39), and generating spatial areas of capture of charged particles, the areas moving slowly along the axis of the device (see FIG. 40), corresponds to this field. The amplitude of high-frequency field $E_*(z,t)=(U_0/L)\cos(z/L-t/T)$ is defined by the amplitude of high-frequency potential $U_*(z,r,t)=U_0\sin(z/L-t/T)=U_0\sin(z/L)\cos(t/T)\ U_0\cos(z/L)\sin(t/T)$, i.e., the given potential represents a superposition of static potentials $U_0\sin(z/L)$ and $U_0\cos(z/L)$, varying with time in a quasi-static manner, according to the law cos(t/T) and sin(t/T).

Good approximation of axially symmetric electrostatic field having axial distribution $U_0\sin(z/L)$, (where $U_0$ is amplitude; L, is characteristic length), can be organised as follows. We shall consider a series of coaxial annular apertures having radius R, combined in the groups of four electrodes, placed in a succession along the length of the transportation channel, with a period of $2\pi L$, (see FIG. 1 and FIG. 2, or used further as an example of the invention FIG. 55). Of course, other electrode arrangements could also be used should the first and the second electrodes receive the potentials $+U_R$ (where $U_R=U_0(1\pm R^2/4L^2+R^4/64L^4+\ldots)$, where $U_0$ is amplitude; L, is characteristic length, R is radius of annular apertures), and the third and the fourth electrode receive the potentials $-U_R$, then, with a large enough radius R, in the points on the symmetry axis, distribution of potential of the kind of $U_0\sin(z/L)$ would be formed. Respectively, should the first and the fourth electrodes receive the potentials $+U_R$, and the second and the third electrodes receive the potentials $-U_R$, then, distribution of potential in the form of $U_0\cos(z/L)$ would be generated on the symmetry axis. An alternative variant for creation the distributions of potential, close to the ones required, along the axis of the device, is to apply potentials $(0, +U_R, 0, -U_R)$ for sine, and potentials $(+U_R, 0, -U_R, 0)$ for cosine, to the four electrodes.

It remains necessary to calculate superposition of the specified electric fields. Thus, the first electrode in each group of four, shall be supplied with high-frequency electric voltage in the form of $\cos(\omega t+\varphi)$, amplitude-modulated according to the law $U_R(\cos(t/T)-\sin(t/T))=\sqrt{2}U_R\cos(t/T+\pi/4)$, the second one shall be supplied with amplitude-modulated voltage, according to $U_R(\cos(t/T)+\sin(t/T))=\sqrt{2}U_R\sin(t/T+\pi/4)$, the third one shall be supplied with amplitude-modulated voltage, according to $U_R(-\cos(t/T)+\sin(t/T))=-\sqrt{2}U_R\cos(t/T+\pi/4)$, the third electrode shall be supplied with amplitude-modulated voltage, according to $U_R(-\cos(t/T)-\sin(t/T))=-\sqrt{2}U_R\sin(t/T+\pi/4)$.

Graphs of the voltages applied to the first, the second, the third and the fourth electrode in each group of four are presented in FIG. 41. For the purpose of comparison, FIG. 8 earlier demonstrated the graphs of voltages, which should be applied to these electrodes for creation, within the transportation channel, of electric field, corresponding to the device of U.S. Pat. No. 6,812,453. Since amplitude modulation of the electric voltages applied to the first and the third electrodes (as well as to the second and the fourth) would be the same, and difference of phases of the high-frequency voltages applied to the adjacent electrodes, in this case proves to be insufficient, the period of recurrence of electric voltages applied to the electrodes could be shortened from 4 to 2 with a simultaneous double compression of the sequence of the packets of charged particles.

With the help of the technique shown above, it would be possible to synthesise easily the electric voltage required for the periodically located systems of apertures, in order to create high-frequency electric field, featuring the pseudopotential having the form of $\overline{U}_*(z,t)=U_*[1-\cos(z/L-t/T)]^n$, where $U_*$is the amplitude of the pseudopotential, L is the characteristic length between consecutive minima of the pseudopotential, T is the characteristic time of moving of minima of the pseudopotential along the length of the channel, n is a positive whole number, characterising the steepness of the walls of thus formed pseudopotential areas of capture of charged particles. For example, FIG. 42 shows electric voltages, which are required to be applied to the repetitive groups of six annular electrodes for the purpose of creation of high-frequency electric field possessed of axial distribution of the pseudopotential on the form of $\overline{U}_*(z,t)=U_*[1-\cos(z/L-t/T)]^3$ (FIG. 43) and the respective areas of capture of charged particles (FIG. 44) moving slowly along the axis of the device.

Mathematically, the equivalent electric field can also be created using different technology, without the use of amplitude modulation of high-frequency voltage. Suppose, high-frequency voltages with a shift of frequencies are given as $U_1(t)=U_R\ \cos((w-1/T)t+\varphi)$, $U_2(t)=U_R\ \sin((w-1/T)t+\varphi)$, $U_3(t)=U_R\ \cos((w+1/T)t+\varphi)$, $U_4(t)=U_R\ \sin((w+1/T)t+\varphi)$, where $U_R=U_0(1+R^2/4L^2+R^4/64L^4+\ldots)$, where $U_0$ is the amplitude; L, is the characteristic length, R is the radius of annular aperture; T is characteristic time; w is the frequency of high-frequency voltage; co is the initial phase of the high-frequency voltage. Should the first electrode be supplied with the sum of electric voltages $(U_1+U_2+U_3-U_4)/2$, the second electrode be supplied with the sum of electric voltages $(U_1-U_2+U_3+U_4)/2$, the third electrode be supplied with the sum of electric of voltages $(-U_1-U_2-U_3+U_4)/2$, and the fourth electrode be supplied with the sum of electric $(-U_1+U_2-U_3-U_4)/2$, then we shall obtain electric voltages on each of the electrodes, identically the same as previous ones. In the place of high-frequency voltages featuring closely located frequencies and differing from each other by phase difference of $\pi/2$, one can use high-frequency voltages with closely located frequencies and other nonzero phase shift for summing of voltages.

In return for the amplitude modulation of high-frequency voltages, or combining of a number of high-frequency voltages, differing from each other due to a constant frequency shift and phase shift, one can use phase-modulated high-frequency voltages, frequency-modulated high-frequency voltages, trains of high-frequency voltages, time-synchronised in a proper manner. Finally, the required electric voltages can be synthesised using digital method with the help of computer, microprocessor or programmable impulse device. FIGS. 45-54 presents the various methods for obtaining of the required high-frequency voltages: a) FIG. 45—amplitude modulation of high-frequency voltage $\cos(\omega t)$ with the help of the function $\sin(t/T)$, b) FIG. 46—amplitude modulation of high-frequency voltage $\cos(\omega t)$ with the help of the function $\sin^2(t/T)=(1-\cos(2t/T))/2$, c) FIG. 47—amplitude modulation of high-frequency voltage $\cos(\omega t)$ with the help of the function $(1-\gamma t/T)\sin(t/T)$, d) FIG. 48—the sum of four high-frequency voltages with different frequencies $\sin((\omega+1/T)t)-\sin((\omega-1/T)t)+\cos((\omega+1/T)t)+\cos((\omega-1/T)t)$, phase shifted for $\pi/4$, e) FIG. 49—superposition of phase-modulated high-frequency voltages, which is defined by the formula $\cos(\omega t+\cos(t/T))+\cos(\omega t-\cos(t/T))-\cos(\omega t)$, f) FIG. 50—superposition of phase-modulated high-frequency voltages, which is defined by the formula $\cos(\omega t+\sin(\cos(t/T)))+\cos(\omega t-\sin(\cos(t/T)))-1.3\cos(\omega t)$, g) FIG. 51—frequency modulation of high-frequency voltage $\cos(\omega t)$ with the help of the function $\sin(t/T)/(t/T)$, h) FIG. 52—frequency modulation of high-frequency voltage $\cos(\omega t)$ with the help of oscillating function. It is understood, that the required electric voltages to be applied to the electrodes can also be created using other techniques, whereas the behaviour of the effective potential created by high-frequency electric field would be the determining factor here.

The voltages applied to the electrodes need not be strictly periodic (see FIG. 47). All the methods specified for synthesis of the voltages to be applied to electrodes of the transportation system provide creation of high-frequency electric field, featuring the required properties, in the transportation channel.

It would not be absolutely necessary to use exactly harmonic voltage varying as per the law of $\cos(\omega t+\varphi)$ as a basic high-frequency voltage, which undergoes amplitude modulation, phase modulation, frequency modulation and so on. For this voltage, one could use periodic non-harmonic high-frequency voltages, and/or high-frequency voltages containing two or more frequencies in the frequency spectrum, and/or high-frequency voltages containing an infinite set of frequencies in the frequency spectrum, and/or pulsed high-frequency voltages, as well.

For the purpose of creation of the required high-frequency electric field within the space of the channel for transportation of charged particles, different types of electrode configurations can be used.

The configuration of repetitive circular apertures shown in FIG. 1 and FIG. 2 is neither the only possible, nor necessarily the optimal configuration of electrodes, though it is possibly the most sparing and constructively simple. FIG. 53 shows a single diaphragm with a square aperture; later on this will be used as an example, for particular case of implementation of the claimed invention. FIG. 54 shows quadrupole-like configuration, calculated analytically for the purpose of avoiding the use of an additional radio-frequency voltage, required in case of round apertures for more efficient compression of charged particles to the axis of the device (profiles of the electrodes of this single diaphragm would no longer be exact hyperboles corresponding to square-law electric field, their approximate description is presented by quartic curves, and the exact equation contains higher transcendental functions). FIG. 55, FIG. 56 and FIG. 57 show coarsened profiles of electrodes, approximating the aforementioned analytically calculated shape with the help of rectangular, triangular and trapezoidal profiles. Configurations of electrodes using higher multipole components as a basis are designed in a similar way. For example, FIG. 58 shows the system of electrodes composed from split circular rods, used for creation of high-frequency electric field in the transportation channel, consisting of higher multipole (sextupole) components. FIG. 59 shows a series of alternating single diaphragms with rectangular apertures, turned (rotated) with respect to each other, which also creates the required multipole components of the pseudopotential, non-uniform along the channel for charged particle transportation (this configuration of electrodes will be discussed later on as an example). FIG. 60 shows plane split diaphragms with curvilinear profile, in aggregate with solid electrode with curvilinear profile, which can also create the required multipole components of the pseudopotential along the channel for charged particle transportation. This configuration of electrodes in the aggregate creates a quadrupole-like structure of electrodes, and the structure of electric field inside the device can be so, that is would not be necessary to apply high-frequency voltage to the solid electrode (this configuration of electrodes will be discussed later on as an example).

In terms of construction, the electrodes of the device can be manufactured in the form of three-dimensional objects, thin continuous surfaces; they can be conducting layers of metal deposited on dielectric substrate, or reticulate. Reticulate electrodes are useful where the transportation of charged particles is performed in a flow of gas, and it is required to ensure configuration of electrodes to minimise resistance to the flow of gas. The same task can be solved, for example, using wire electrodes and electrodes with slots and/or specially arranged holes having no effect, of minimal effect on the electric field created by the electrodes. The device can be used for transportation of charged particles, and for manipulation of charged particles in vacuum, as well as in neutral or partly ionised gas. Such an arrangement would be useful where the transportation of charged particles takes place in gas flow, since this situation corresponds to an interface between a gas-filled ion source and an analysing device operating in vacuum. For the purpose of injection of charged particles into, and/or extraction from the device, some of the electrodes can have additional apertures or slits. Injection of charged particles into, and/or extraction from the device can also be provided via the gaps between electrodes. For the purpose of injection of charged particles into, and/or extraction from the device, it could be necessary to apply additional pulsed or stepwise voltages, not associated directly with transportation of charged particles inside the device.

FURTHER DESCRIPTION OF THE INVENTION

Figure 61:
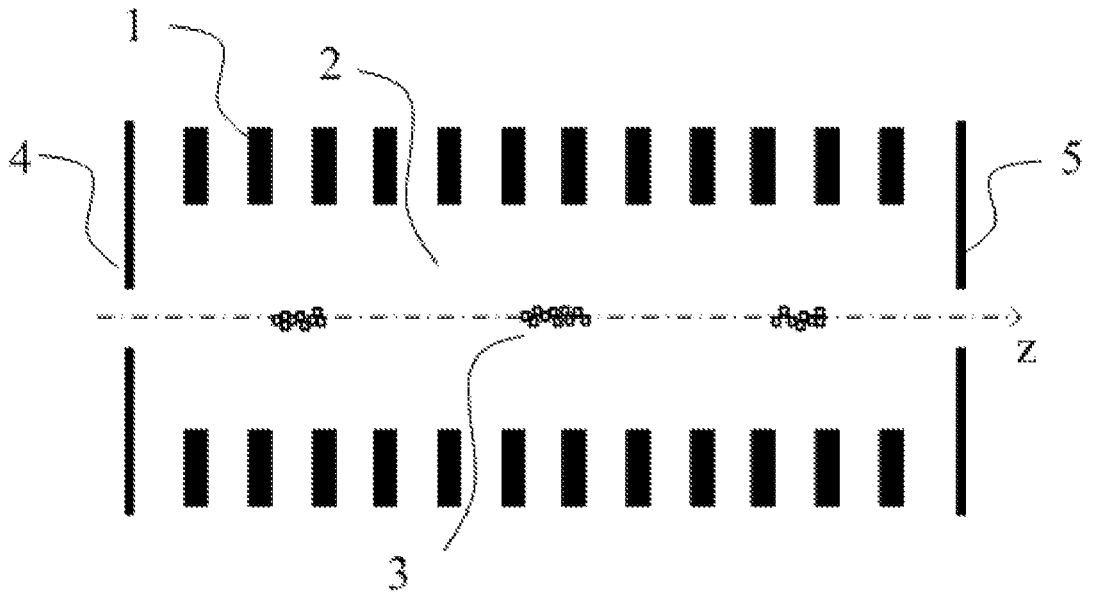
FIG. 61. General view of a device of the present invention.
Figure 62:
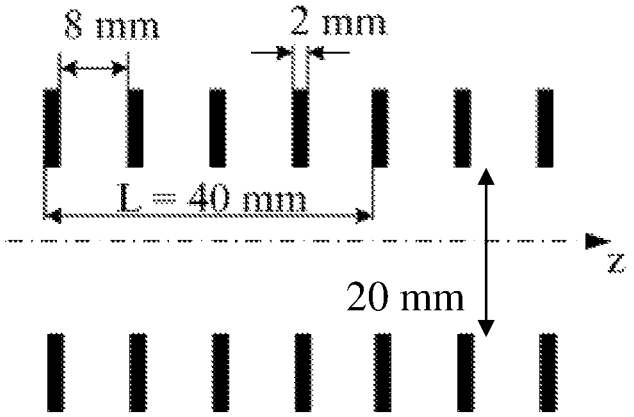
FIG. 62. An individual option of the arrangement of electrodes of the device of the present invention, representing a periodic sequence of rectangular or round diaphragms.

In embodiments the device for manipulation of charged particles (see FIG. 61) contains a system of electrodes 1, located so as to create a channel 2, oriented along the longitudinal axis of the device (z-axis in the drawing), and intended for the transportation of charged particles 3. In particular, the device shown in FIG. 62 contains 8 sections of 4 in each, located in series along the longitudinal axis of the device, coaxial annular electrodes 1 having internal diameters of apertures of 20 mm and distances of 2 mm between the adjacent electrodes; the overall length of the device makes 320 mm. End areas 4 and 5 of the channel 2, form the inlet and the outlet areas of the device, respectively.

The device also includes an arrangement (not shown in the drawing), which generates electrical supply voltages to be applied to the electrodes 1, thus providing creation of a non-uniform high-frequency electric field within the said channel, the pseudopotential of which field has one or more local extrema along the length of the channel for transportation of charged particles, at least, within a certain interval of time, whereas, at least one of the extrema of the pseudopotential is transposed with time, at least within a certain interval of time, at least within a part of the length of the channel for transportation of charged particles.

Figure 63:
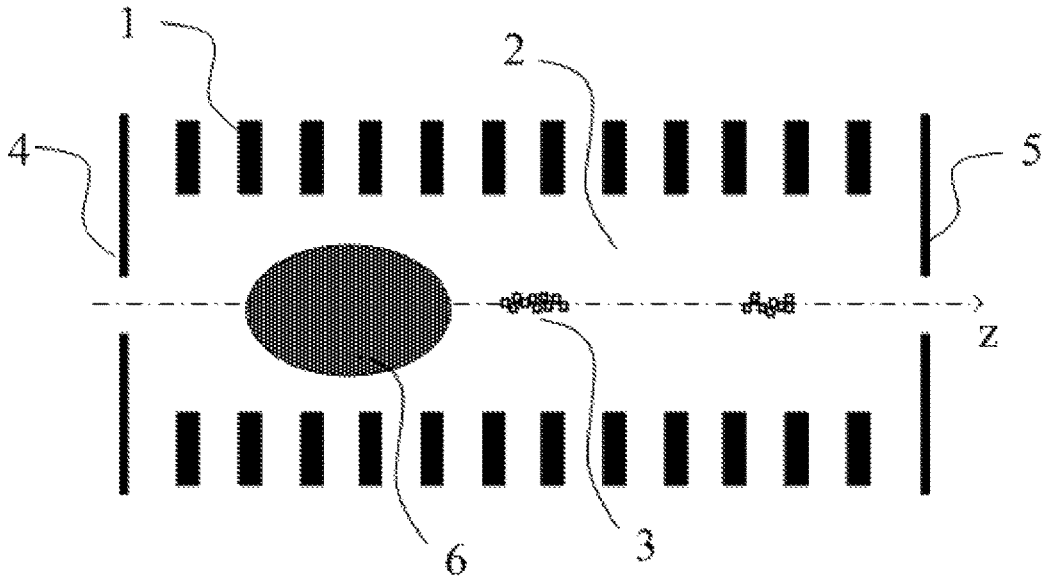
FIG. 63. The device of the present invention, operating in combination with additional devices, to provide an additional effect on the packets of charged particles in the course of their movement within the given device.

FIG. 63 presents a particular form of the device, operating in combination with devices used to provide an additional effect on the packets of charged particles in the course of their movement within the given device, said effect being realised in the zone 6 within the device. For the purpose of implementation of such devices, one can use, for example, devices for ionization of charged particles, devices for fragmentation of charged particles, devices for generation of secondary charged particles, devices for excitation of internal energy of charged particles, devices for selective extraction of charged particles. In that case, said additional device may not be an individual constructive unit in the structure of the device, but represent a specific and intentionally organised physical process taking place within the space of the device.

Figure 64:
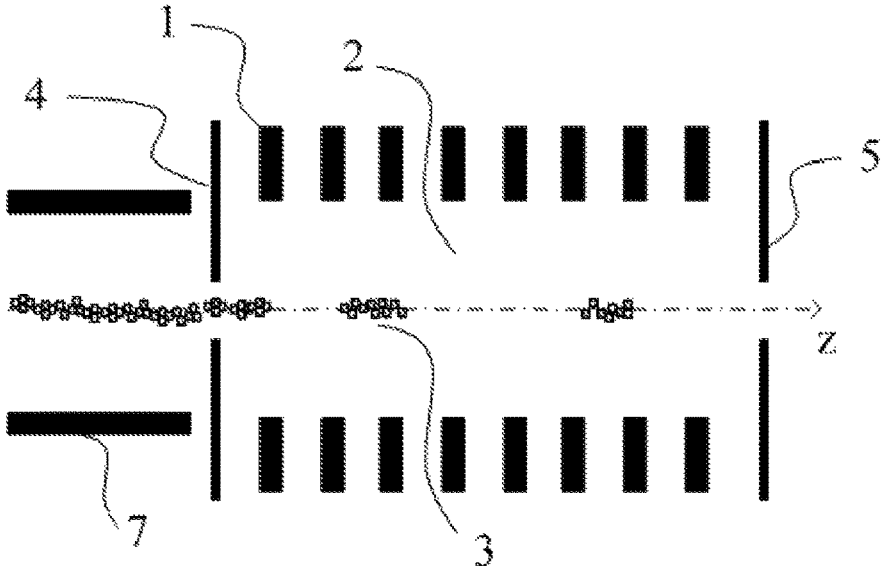
FIG. 64. The device of the present invention, operating in combination with a source of charged particles, or with a charged particle storage device.

FIG. 64 presents a particular form of the device, functioning in conjunction with the source of charged particles 7. For the sources of charged particles, for example, one can use devices for generation of charged particles and/or inlet intermediate devices listed hereunder in the description of FIG. 68.

Figure 65:
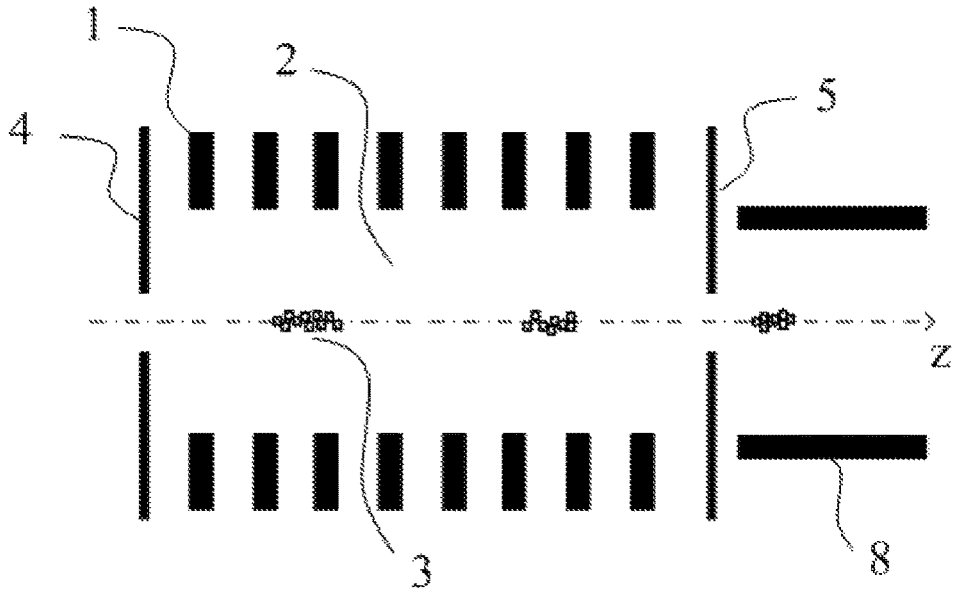
FIG. 65. The device of the present invention, operating as a source of charged particles for some output device.

FIG. 65 presents a particular form of the device, functioning as a source of charged particles for a certain outlet device 8. For the outlet devices one can use, for example, analysers of charged particles and/or outlet intermediate devices listed hereunder in the description of FIG. 68.

Figure 66:
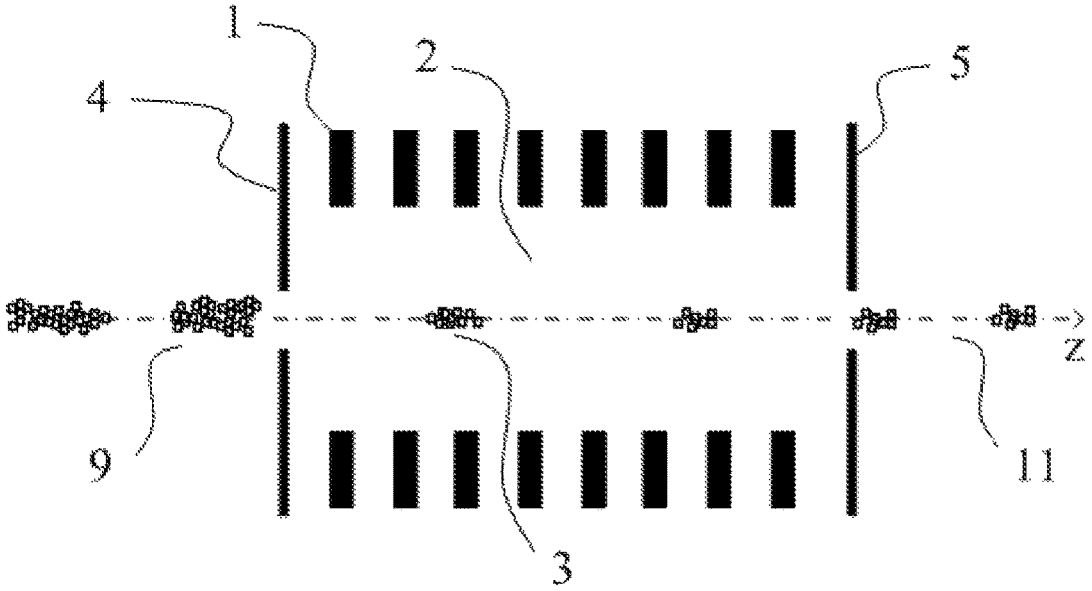
FIG. 66. The device of the present invention, converting a pulsed beam of charged particles at the inlet into quasi-continuous beam of the packets of charged particles at the outlet.

FIG. 66 presents a particular form of the device, converting pulsed beam of charged particles 9 at the inlet into a flow of packets of charged particles 11 at the outlet of the device. Pulsed beam of charged particles 9 can enter the device, arriving from some external device, or be formed within the space of the claimed device.

Figure 67:
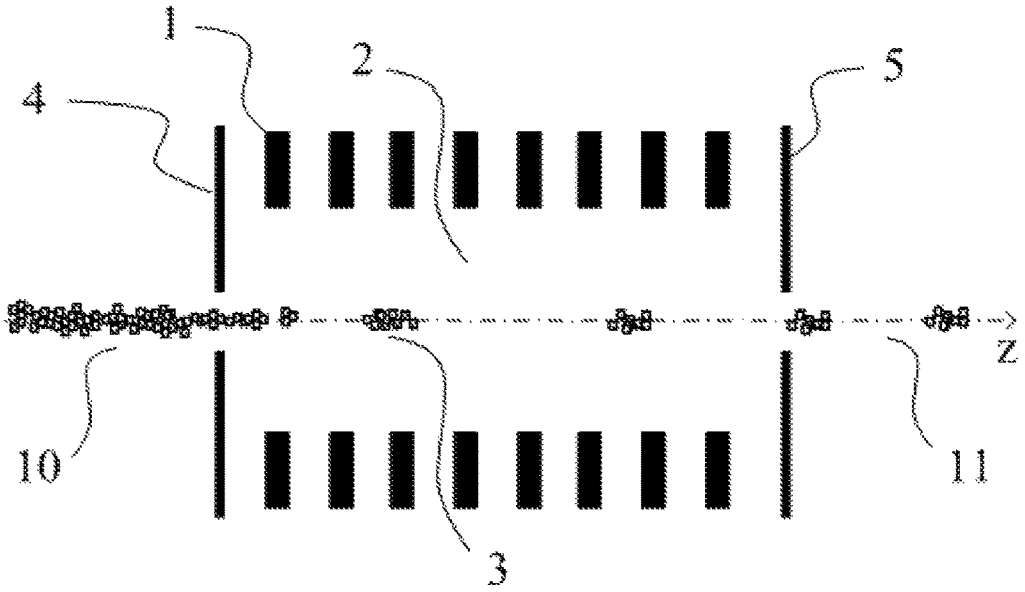
FIG. 67. The device of the present invention, converting a continuous or quasicontinuous beam of charged particles at the inlet into discrete beam of the packets of charged particles at the outlet.

FIG. 67 presents a particular form of the device, converting a continuous or quasicontinuous beam of charged particles 10 at the inlet into a flow of the packets of charged particles 11 at the outlet from the device. A continuous or quasicontinuous beam of charged particles 10 can enter the device, arriving from some external device, or be formed within the space of the claimed device.

Figure 68:
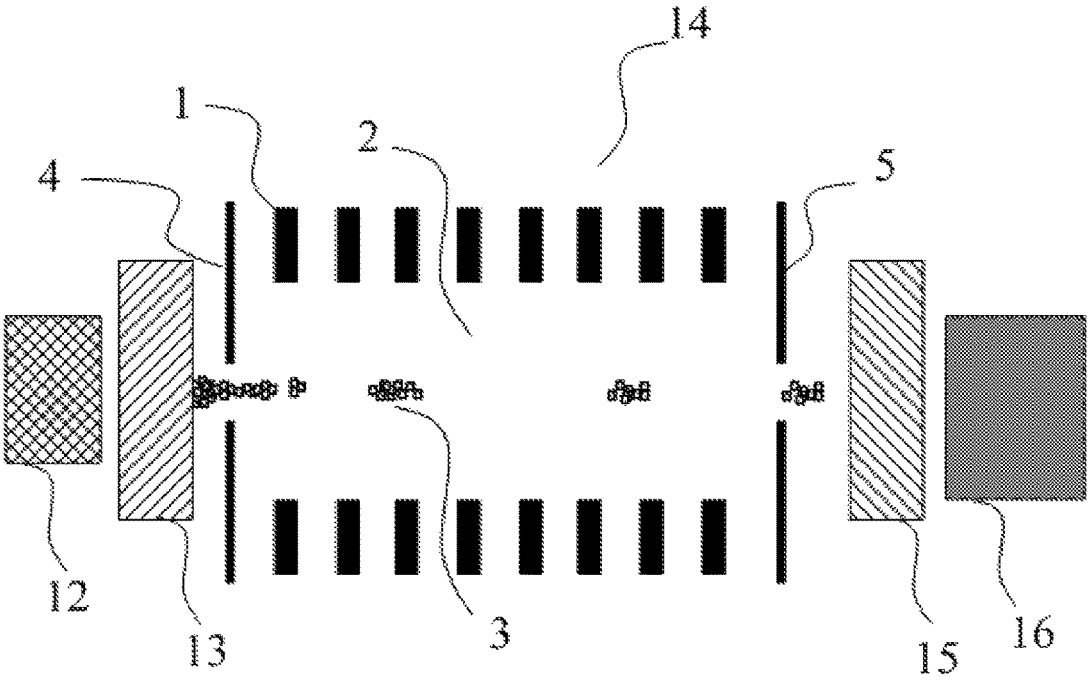
FIG. 68. The device of the present invention, included in the composition of an instrument for analysis of charged particles.

FIG. 68 presents a particular form of the device included in the structure of an instrument for analysis of charged particles (a mass-spectrometer, for example). Such a device can be composed of devices for generation of charged particles 12, inlet intermediate device 13 of the claimed device for manipulations with charged particles 14, outlet intermediate device 15, and analyser of charged particles 16. The device for generation of charged particles is used to generate primary charged particles, and can be based on diversified physical processes. The inlet intermediate device is used for accumulation (storage) of charged particles, or cooling of charged particles (decrement of kinetic energy), or transformation of the properties of the beam of charged particles, or excitation of charged particles, or fragmentation of charged particles, or generation of secondary charged particles, or filtration of the required group of charged particles, or initial detection of charged particles, or execution of a number of the aforementioned functions at once. The device for manipulations with charged particles performs breaking-up of the input beam of charged particles into a beam of discrete and time-synchronised packets of charged particles, transfer of charged particles from the inlet to the outlet, and it can realise other kinds of manipulations with charged particles. The outlet intermediate device is used for storage of charged particles, or transformation of the properties of a beam of charged particles, or fragmentation of charged particles, or generation of secondary charged particles, or filtration of the required group of charged particles, or initial detection of charged particles, or execution of a number of the aforementioned functions at once. Analyser of charged particles can represent, for example, a detector based on micro-channel plates, or an aggregate (possibly containing a single element) of diode detectors, or an aggregate (possibly containing a single element) of semiconductor detectors, or an aggregate (possibly containing a single element) of detectors based on the measurement of induced charge, or a mass-analyser (mass spectrometer, mass spectrograph, or mass filter), or optical spectrometer, or a spectrometer utilising separation of charged particles based on the property of ion mobility or derivatives thereof. Inlet intermediate devices and/or outlet intermediate devices can be absent, and the process of ionisation of charged particles and/or process of analysis of charged particles can be implemented inside the claimed device for manipulation with charged particles. Both the inlet and outlet intermediate devices can represent an aggregate of the respective devices, separated, possibly, by devices for transportation of charged particles and/or devices for manipulation with charged particles, including the possibility of use of the device of the present invention, as such, for manipulations with charged particles. All the specified elements of the instrument can operate in a continuous mode, and/or in a pulsed mode, and/or can switch between continuous and pulsed operating modes.

For completeness it is noted that each of the following embodiments, and indeed all of the embodiments disclosed herein, may be combined with one or more of the other embodiments.

It should be noted that in embodiments, in the course of operation of the device (the device being configured accordingly, e.g. having corresponding means), a method of manipulation with charged particles is realised, including the effect on an aggregate of charged particles, localised in the space for manipulation with charged particles, of a non-uniform high-frequency electric field, the pseudopotential of which has one or more local extrema along the length of the space for manipulation with charged particles, at least, within a certain interval of time, whereas, at least one of said extrema of the pseudopotential high-frequency electric field is transposed with time, at least, along a part of the length of the space used for manipulation with charged particles, at least within a certain interval of time.

If, in embodiments, in the course of operation of the device (the device being configured accordingly, e.g. having corresponding means), a beam of charged particles comes into the inlet of the device, wherein, at least within a certain interval of time, the pseudopotential of high-frequency electric field has alternating maxima and minima along the length of the area for manipulations with charged particles, then as a result, breaking-up of the beam of charged particles into spatially segmented packets of charged particles is realised.

If, embodiments, in the course of operation of the device (the device being configured accordingly, e.g. having corresponding means), an aggregate of charged particles is located within the device, wherein, at least within a certain interval of time, the pseudopotential of high-frequency electric field has alternating maxima and minima along the length of the area for manipulations with charged particles, then as a result, grouping of charged particles into spatially segmented packets of charged particles is realised.

In embodiments, the device can be coupled to a storage device containing charged particles. In that case, an aggregate of charged particles would be captured, at least within a certain area of the storage device, at least within a certain interval of time, by the high-frequency electric field with the pseudopotential having one or more local extrema along the length of the space used for manipulations with charged particles, where at least one of said extrema of the pseudopotential of high-frequency electric field is transposed with time, at least, within a part of the length of the space used for manipulations with charged particles, at least within a certain interval of time.

In this way, extraction of charged particles can be performed, in the form of spatially separated packets, at least, of a part of charged particles available in the storage device, due to capture of charged particles by high-frequency electric field and transposition of the extremum or extrema of the pseudopotential of high-frequency electric field, along at least a part of the length of the channel, at least within a certain interval of time.

In embodiments, in the course of operation of the device (the device being configured accordingly, e.g. having corresponding means), an aggregate of charged particles can be effected by a high-frequency electrostatic field, the pseudopotential of which field has alternating maxima and minima along the length of the area for manipulations with charged particles, transposing with time in a predetermined manner, as a result of which, a time-synchronised transportation of charged particles is realised, in accordance with this time dependence.

In embodiments, in the course of operation of the device (the device being configured accordingly, e.g. having corresponding means), alternately-bidirectional movement of charged particles can be realised, because of the fact that the direction of transposition of the extremum of extrema of the pseudopotential of high-frequency electric field, at least for a part of the length of the space used for manipulations with charged particles, at a certain point of time, or certain points of time, reverses its sign.

In embodiments, in the course of operation of the device (the device being configured accordingly, e.g. having corresponding means), oscillating transposition of charged particles can be realised, because of the fact that transposition of the extremum of extrema of the pseudopotential of high-frequency electric field with time, at least, within a part of the length of the space used for manipulations with charged particles, at least within a certain interval of time, has an oscillating pattern.

In embodiments, in the course of operation of the device (the device being configured accordingly, e.g. having corresponding means), integration of two or more adjacent, spatially separated packets of charged particles can be realised, as a result of the fact that the value of the pseudopotential of high-frequency electric field in the maximum of the pseudopotential, which separates the spatially separated packets, drops, during at least, a certain interval of time.

In embodiments, in the course of operation of the device (the device being configured accordingly, e.g. having corresponding means), transition of at least some of charged particles between the adjacent spatially separated packets of charged particles can be realised, at least within a certain interval of time, as a result of the fact that the value of the pseudopotential of high-frequency electric field in the maximum of the pseudopotential, which separates the spatially separated packets, drops, during at least, a certain interval of time.

In embodiments, in the course of operation of the device (the device being configured accordingly, e.g. having corresponding means), disintegration of at least, one packet of charged particles can be realised, as a result of the fact that the value of the pseudopotential of high-frequency electric field in the minimum of the pseudopotential, which minimum corresponds to the location of the packet of charged particles of interest, rises above the barrier level, during at least, a certain interval of time.

In embodiments, in the course of operation of the device (the device being configured accordingly, e.g. having corresponding means), escape of at least, some of the charged particles from a packet can be realised, at least, within a certain interval of time, as a result of the fact that the value of the pseudopotential of high-frequency electric field in the minimum of the pseudopotential, which minimum corresponds to the location of the packet of charged particles of interest, rises, during at least, a certain interval of time.

In embodiments, in the course of operation of the device (the device being configured accordingly, e.g. having corresponding means), transfer of all or some of charged particles from one packet of charged particles to adjacent packet of charged particles can be realised, as a result of the fact that the value of the pseudopotential of high-frequency electric field in the maximum of the pseudopotential, which separates the spatially separated packets, drops, whereas the value of the pseudopotential of high-frequency electric field in the minimum of the pseudopotential, which minimum corresponds to the location of the packet of charged particles of interest, rises, during at least, a certain interval of time.

In embodiments, in the course of operation of the device (the device being configured accordingly, e.g. having corresponding means), creation or restoration of the area of capture of charged particles can be realised, as a result of the fact that the value of the pseudopotential of high-frequency electric field, varies, at least over a certain portion of transportation channel, at least within a certain interval of time, thus creating a local minimum.

In embodiments, in the course of operation of the device (the device being configured accordingly, e.g. having corresponding means), a zone can be created, for storage of charged particles, because of the fact that at least within a certain interval of time, at least for a certain length of transportation channel, the pseudopotential of high-frequency electric field has no maxima and minima.

In embodiments, in the course of operation of the device (the device being configured accordingly, e.g. having corresponding means), for the purpose of enhancement of radial containment of charged particles within the space used for manipulations with charged particles, additional static electric fields, and/or additional quasi-static electric fields, and/or additional AC electric fields, and/or additional pulsed electric fields, and/or additional high-frequency electric fields, and/or superposition of said fields can be used.

In embodiments, in the course of operation of the device (the device being configured accordingly, e.g. having corresponding means), for the purpose of enhancement of spatial isolation of the packets of charged particles along the length of the space used for manipulations with charged particles, additional static electric fields, and/or additional quasi-static electric fields, and/or additional AC electric fields, and/or additional AC electric fields, and/or additional pulsed electric fields, and/or additional high-frequency electric fields, and/or superposition of said fields can be used.

In embodiments, in the course of operation of the device (the device being configured accordingly, e.g. having corresponding means), for the purpose of enhancement of time synchronisation of transportation of the packets of charged particles, additional static electric fields, and/or additional quasi-static electric fields, and/or additional AC electric fields, and/or additional pulsed electric fields, and/or additional high-frequency electric fields, and/or superposition of said fields can be used.

In embodiments, in the course of operation of the device (the device being configured accordingly, e.g. having corresponding means), in order to ensure control of the behaviour of charged particles in the process of transportation of charged particles, additional static electric fields, and/or additional quasi-static electric fields, and/or additional AC electric fields, and/or additional pulsed electric fields, and/or additional high-frequency electric fields, and/or superposition of said fields can be used, the fields being created within the space used for manipulations with charged particles.

In embodiments, in the course of operation of the device (the device being configured accordingly, e.g. having corresponding means), in order to ensure control of the behaviour of charged particles with the help of creation of additional potential barriers, and/or pseudopotential barriers, and/or potential wells, or pseudopotential wells, at least within a part of the space used for manipulations with charged particles, at least within a certain interval of time, additional static electric fields, and/or additional quasi-static electric fields, and/or additional AC electric fields, and/or additional pulsed electric fields, and/or additional high-frequency electric fields, and/or superposition of said fields can be used.

In this way, said potential and pseudopotential barriers and wells can vary with time and/or move in time within the space used for manipulations with charged particles, at least, within a certain interval of time, thus ensuring controllable behaviour of charged particles.

In embodiments, in the course of operation of the device (the device being configured accordingly, e.g. having corresponding means), in order to ensure control of the behaviour of charged particles with the help of additional zones of stability and/or additional zones of instability, at least within a portion of the space used for manipulations with charged particles, at least within a certain interval of time, additional static electric fields, and/or additional quasi-static electric fields, and/or additional AC electric fields, and/or additional pulsed electric fields, and/or additional high-frequency electric fields, and/or superposition of said fields can be used.

In this way, said stability and instability zones can vary with time and/or move with time, within the space used for manipulations with charged particles, at least, within a certain interval of time, thus ensuring controllable behaviour of charged particles.

In embodiments, in the course of operation of the device (the device being configured accordingly, e.g. having corresponding means), for the purpose of selective extraction of charged particles, additional static electric fields, and/or additional quasi-static electric fields, and/or additional AC electric fields, and/or additional pulsed electric fields, and/or additional high-frequency electric fields, and/or superposition of said fields can be used.

In embodiments, in the course of operation of the device (the device being configured accordingly, e.g. having corresponding means), for the purpose of control of the essential dependence of motion of charged particles on the mass of charged particles, additional static electric fields, and/or additional quasi-static electric fields, and/or additional AC electric fields, and/or additional pulsed electric fields, and/or additional high-frequency electric fields, and/or superposition of said fields are used.

In embodiments, the channel used for charged particle transportation in the device can have a varying profile, at least along a part of the length of the space used for manipulations with charged particles, in this way, in the course of operation of the device, collection, and/or focussing, and/or compression of the beam of charged particles can be realised in said channel.

In embodiments, the channel used for charged particle transportation in the device can be closed to form a ring, in this way, in the course of operation of the device, it can be used to create a storage volume for charged particles, and/or trap for charged particles, and/or the space used for manipulations with charged particles, where the channel for charged particle transportation is closed to form a ring.

In embodiments, for the purpose of creation of storage volume for charged particles, and/or trap for charged particles, and/or space for manipulations with charged particles, the channel for charged particle transportation, operation in an alternately-bidirectional mode, at least within a certain interval of time can be used.

In embodiments, in the course of operation of the device (the device being configured accordingly, e.g. having corresponding means), manipulations with charged particles can be performed in vacuum.

In embodiments, in the course of operation of the device (the device being configured accordingly, e.g. having corresponding means), manipulations with charged particles can be performed in neutral or ionised gas.

In embodiments, in the course of operation of the device (the device being configured accordingly, e.g. having corresponding means), manipulations with charged particles can be performed in the flow of neutral or ionised gas.

In embodiments, in the course of operation of the device (the device being configured accordingly, e.g. having corresponding means)e, the charged particles can arrive into the inlet of the device from an external source.

In embodiments, in the course of operation of the device (the device being configured accordingly, e.g. having corresponding means), one can perform manipulations with charged particles generated within the device.

In embodiments, in the course of operation of the device (the device being configured accordingly, e.g. having corresponding means), one can perform manipulations with c secondary charged particles generated within the device.

In embodiments, in the course of operation of the device (the device being configured accordingly, e.g. having corresponding means), one can perform manipulations with fragmented charged particles generated within the device.

In embodiments, fragmented charged particles can be generated in case of acceleration of charged particles with the help of electric fields created in the device, due to collisions of said charged particles with molecules of neutral gas and/or with the surfaces inside the device.

In embodiments, fragmented charged particles can be generated within the device (the device being configured accordingly, e.g. having corresponding means) as a result of interaction between positively charged and negatively charged particles, integrated into a single spatially separated packet of charged particles.

In embodiments, in the course of operation of the device (the device being configured accordingly, e.g. having corresponding means), the charged particles can be extracted from the device in the direction along the channel used for charged particle transportation.

In embodiments, in the course of operation of the device (the device being configured accordingly, e.g. having corresponding means), the charged particles can be extracted from the device in the direction, orthogonal or slanting with respect to the channel used for charged particle transportation.

In embodiments, in the course of operation of the device (the device being configured accordingly, e.g. having corresponding means), in the process of transportation, equalisation of kinetic energies of charged particles can take place, due to collisions and energy exchange between charged particles and neutral gas molecules.

In embodiments, in the course of operation of the device (the device being configured accordingly, e.g. having corresponding means), in the process of movement, mass-filtration of charged particles can take place.

In embodiments, in the course of operation of the device (the device being configured accordingly, e.g. having corresponding means), in the process of movement, fragmentation of charged particles can take place.

In embodiments, in the course of operation of the device (the device being configured accordingly, e.g. having corresponding means), in the process of movement of charged particles, formation of secondary charged particles can take place.

In embodiments, in the course of operation of the device (the device being configured accordingly, e.g. having corresponding means), in the process of movement of charged particles, formation of secondary charged particles can take place as a result of charge-exchange between the charged particles in case of collisions, and charge-exchange between charged particles and neutral gas molecules.

In embodiments, in the course of operation of the device (the device being configured accordingly, e.g. having corresponding means), in the process of movement of charged particles, formation of secondary charged particles can take place as a result of charge-exchange between the charged particles in case of collisions, and charge-exchange between charged particles having opposite signs of charge.

In embodiments, in the course of operation of the device (the device being configured accordingly, e.g. having corresponding means), in the process of movement of charged particles, formation of secondary charged particles can take place as a result of creation of composite ions in case of collisions and interaction between charged particles and neutral gas molecules.

In embodiments, in the course of operation of the device (the device being configured accordingly, e.g. having corresponding means), in the process of movement of charged particles formation of secondary charged particles can take place as a result of creation of composite ions in case of collisions and interactions between the charged particles.

In embodiments, in the course of operation of the device (the device being configured accordingly, e.g. having corresponding means), manipulations with charged particles can be realised while operating with the packets of charged particles, consisting of positively and negatively charged particles simultaneously.

We shall consider some variants of application of the device.

The device can be used for conversion of continuous ion beam into a series of time-synchronised ion pulses, and thus, it can be used as an ion source (ion preparation system). The capability of the device, in terms of manipulations with charged particles, the capability of defining the time dependences for transposition and output of the packets of charged particles, prove to be inestimable when the device is used being coupled to the various outlet devices operating in a pulsed mode. When coupled to such devices, a provision should be made, in order that the intervals of time between successive packets of charged particles exceed the intervals of time required for the output device to perform processing of every next packet, to avoid losses of the charged particles. For the output device, one can use a device, which performs analysis of charged particles (for example, time-of-flight mass spectrometer or RF ion trap), or otherwise, performs a predefined modification of the packet of charged particles (for example, collision cell), or extracts a sub-group of charged particles featuring the required characteristics (for example, mass filter), or transfers the packet of charged particles to another device (for example, another device for transportation of charged particles), or makes use of the pulse of charged particles for some technical applications, or combines intrinsically a number of functions at once.

The device enables to efficiently convert a continuous beam of charged particles into a series of successive pulses of charged particles, since with an appropriate selection of the velocity of movement of the packets of charged particles along the axis of the device for transportation of charged particles, and respectively, selection of the pulse repetition frequency for the ejecting voltages, analysis of all arriving charged particles would be possible without losses. Note that the velocity of movement of the packets along the axis of the device for transportation of charged particles in the proposed device is defined by the frequency of amplitude modulation and phase shift between the control high-frequency voltages, applied to the electrodes (of frequency difference between close frequencies of high-frequency harmonics, if for the synthesis of control voltages this particular method is used) and can easily be adjusted using electronics. The number of charged particles in each packet can be rather considerable, and according to a tentative assessment, it should be close to the capacity of linear ion trap.

For those output devices operating in a pulsed mode this method of separation of a continuous beam of charged particles into discrete portions is envisioned to be the most successful. With a proper adjustment of the time intervals between arrival of individual discrete portions of charged particles to the outlet of the transportation device, and respectively, to the inlet of the next device (which, for example, represents a mass analyser operating in a pulsed mode), and the time required to analyse the arrived portion of charged particles, this method allows to analyse all the charged particles received from the continuous beam into the analyser, with almost no losses.

In addition to conversion of a continuous beam into a series of packets, this device can also have other applications.

The device can be used in the composition of a range of specialised physical instruments (apparatus), where the above mentioned schemes of its application can be integrated together in case where necessary.

In particular, the device can be used in the composition of a physical instrument (i.e. be part of the instrument/apparatus), which includes a) device for creation generation of charged particles, b) inlet intermediate device, c) the claimed device for manipulations with charged particles, d) outlet intermediate device, e) a device for detection of charged particles (see FIG. 68).

In embodiments, in the physical instrument, the inlet intermediate device is used for storage of charged particles, or for conversion of properties of the beam of charged particles, or for fragmentation of charged particles, or for generation of secondary charged particles, or filtration of the required group of charged particles, or initial detection of charged particles, or for execution of a number of the aforementioned functions at once.

In embodiments, in the physical instrument, the inlet intermediate device can represent a sequence of inlet intermediate devices, separated, or not separated by transportation devices.

In embodiments, in the physical instrument, the inlet intermediate device may be absent.

In embodiments, in the physical instrument, the outlet intermediate device is used for storage of charged particles, or for conversion of properties of the beam of charged particles, or for fragmentation of charged particles, or for generation of secondary charged particles, or filtration of the required group of charged particles, or initial detection of charged particles, or for execution of a number of the aforementioned functions at once.

In embodiments, in the physical instrument, the outlet intermediate device can represent a sequence of outlet intermediate devices, either separated, or not separated by transportation devices.

In embodiments, in the physical instrument, the outlet intermediate device may be absent.

In embodiments, in the physical instrument, generation of charged particles can take place within the space of the device for transportation and manipulations with charged particles.

In embodiments, in the physical instrument, detection of charged particles can take place within the space of the device for transportation and manipulations with charged particles.

In embodiments, in the physical instrument, escape of charged particles from the device for generation of charged particles and/or the outlet intermediate device, can be locked at certain points of time.

In embodiments, in the physical instrument, transfer of charged particles to the device for detection of charged particles and/or to the outlet intermediate device, can be locked at certain points of time.

In embodiments, in the physical instrument, the device for generation of charged particles can represent an ion source operating in a continuous mode.

In embodiments, in the physical instrument, the ion source operating in a continuous mode can belong to the group of types of ion sources, which includes: 1) Electrospray Ionisation (ESI) ion source, 2) Atmospheric Pressure Ionization (API) ion source, 3) Atmospheric Pressure Chemical Ionization (APCI) ion source, 4) Atmospheric Pressure Photo Ionisation (APPI) ion source, 5) Inductively Coupled Plasma (ICP) ion source, 6) Electron Impact (EI) ion source, 7) Chemical Ionisation (CI) ion source, 8) Photo Ionisation (PI) ion source, 9) Thermal Ionisation (TI) ion source, 10) various types of gas discharge ionisation ion sources, 11) fast atom bombardment (FAB) ion source, 12) ion bombardment ionisation in Secondary Ion Mass Spectrometry (SIMS), 13) ion bombardment ionisation in Liquid Secondary Ion Mass Spectrometry (LSIMS).

In embodiments, in the physical instrument, the device for generation of charged particles can represent an ion source operating in a pulsed mode.

In embodiments, in the physical instrument, the ion source operating in a pulsed mode can belong to the group of types of ion sources, which includes: 1) Laser Desorption/Ionisation (LDI) ion source, 2) Matrix-Assisted Laser Desorption/Ionisation (MALDI) ion source, 3) ion source with orthogonal extraction of ions from continuous ion beam, 4) ion trap, whereas the ion trap, in particular, may belong to a group of device, including: 1) RF ion trap, including linear ion trap, and/or Paul ion trap, and/or RF ion trap with pulsed electric field, 2) electrostatic ion trap, including electrostatic Orbitrap type ion trap, 3) Penning ion trap.

In embodiments, in the physical instrument, the inlet intermediate device can represent: 1) a device, transporting the beam of charged particles from a source of charged particles, 2) a device for accumulation and storage of charged particles, 3) mass-selective device for separation of charged particles of interest, 4) a device for separation of charged particles based on the property of ion mobility or derivatives from ion mobility, 5) a cell for fragmentation of charged particles using various methods, 6) a cell for generation of secondary charged particles using various methods, 7) a combination of the above devices, where said devices can operate in a continuous mode, as well as devices operating in a pulsed mode.

In embodiments, in the physical instrument, the outlet intermediate device can represent: 1) a device, transporting the beam of charged particles to detecting device, 2) a device for accumulation and storage of charged particles, 3) mass-selective device for separation of charged particles of interest, 4) a device for separation of charged particles based on the property of ion mobility or derivatives from ion mobility, 5) a cell for fragmentation of charged particles using various methods, 6) a cell for generation of secondary charged particles using various methods, 7) a combination of the above devices, where said devices can operate in a continuous mode, as well as devices operating in a pulsed mode.

In embodiments, in the physical instrument, the following devices can be used for detection: 1) a detector of the base of micro-channel plates, 2) diode detectors, 3) semiconductor detectors, 4) detectors based on the measurement of induced charge, 5) mass analyser (mass spectrometer, mass spectrograph, or mass filter), 6) optical spectrometer, 7) spectrometers performing separation of charged particles based on the property of ion mobility or derivatives thereof, where said devices can operate in a continuous mode, as well as devices operating in a pulsed mode.

In embodiments, in the device of the present invention, in the course of operation thereof within the structure of the physical instrument under consideration, equalisation kinetic energies of charged particles can take place, due to collisions and energy exchange between charged particles and neutral gas molecules.

In embodiments, in the device of the present invention, in the course of operation thereof within the structure of the physical instrument under consideration, mass-filtration of charged particles can take place.

In embodiments, in the device of the present invention, in the course of operation thereof within the structure of the physical instrument under consideration, fragmentation of charged particles can take place.

In embodiments, in the device of the present invention, in the course of operation thereof within the structure of the physical instrument under consideration, formation of secondary charged particles can take place.

In embodiments, in the device of the present invention, in the course of operation thereof within the structure of the physical instrument under consideration, conversion of continuous beam of charged particles into a discrete series of spatially separated packets of charged particles, required for correct operation of the outlet intermediate device and/or detecting device can take place.

In embodiments, in the device of the present invention, in the course of operation thereof within the structure of the physical instrument under consideration, conversion of continuous beam of charged particles into a discrete series of time-synchronised packets of charged particles, required for correct operation of the outlet intermediate device and/or detecting device can take place.

In embodiments, in the physical instrument under consideration, operation of the device for generation of charged particles and/or operation of the inlet intermediate device can be essentially time-synchronised with operation of the device.

In embodiments, in the physical instrument under consideration, operation of the claimed device can be essentially time-synchronised with operation of the device for detection of charged particles and/or operation of the outlet intermediate device.

In embodiments, the device can be used as transportation device for a beam of charged particles.

In embodiments, the device can be used as transportation device for a beam of charged particles with damping of velocities of charged particles due to collisions with gas molecules.

In embodiments, the device can be used as ion trap.

In embodiments, the device can be used as a cell for fragmentation of ions.

In embodiments, the device can be used as storage device for ions.

In embodiments, the device can be used as a reactor for ion-molecular reactions.

In embodiments, the device can be used as a cell for ion spectroscopy.

In embodiments, the device can be used as an ion source for continuous injecting of ions into a mass analyser, or into an intermediate device placed before the mass analyser.

In embodiments, the device can be used as an ion source for pulsed injecting of ions into a mass analyser or into an intermediate device placed before the mass analyser.

In embodiments, the device can be used as a mass filter.

In embodiments, the device can be used as a mass-selective storage device.

In embodiments, the device can be used as a mass analyser.

In embodiments, the device can be used in an interface for transportation of charged particles from gas-filled ion sources into mass analyser.

In embodiments, in the case of its application in an interface for transportation of charged particles into mass analyser, the device can be used, in particular, for transportation of ions, at least over a part of the path between the ion source and the mass analyser.

In embodiments, in the case of its application in an interface for transportation of charged particles into mass analyser, the device, in particular, can encompass several stages of differential pumping.

In embodiments, in the case of its application in an interface for transportation of charged particles into mass analyser, the device can be used, in particular, for combining of ion beams from several sources, including: 1) alternate operation with individual sources transferring ions into the device for transportation, focussing and performing manipulations with ions, 2) periodical switching between the main source and the source containing a substance used for calibration, 3) simultaneous operation with a number of sources for mixing of ion beams, or for the purpose to initiate reactions between ions of various types, or for the purpose of mass analyser mass calibration, or for the purpose of mass analyser sensitivity calibration.

In embodiments, in the case of its application in an interface for transportation of charged particles into mass analyser, the device can be used, in particular, for additional excitation of internal energy of ions, for the purpose of: 1) disintegration of ion clusters, 2) fragmentation of ions, 3) stimulation of ion-molecular reactions, and 4) suppression of ion-molecular reactions.

In embodiments, in the case of its application in an interface for transportation of charged particles into mass analyser, the device can be used, in particular, for: 1) direct and continuous, or pulsed injection of ions into continuously operating mass analyser, 2) pulsed injection of ions into mass analyser operating in a pulsed mode, 3) pulsed injection of ions into mass analyser, operating in a pulsed mode, with the help of conversion of continuous ion beam into pulsed ion beam, through the instrumentality of orthogonal acceleration device.

In embodiments, the device can be used in a convertor of continuous ion beam into discrete (i.e. packeted) ion beam.

In embodiments, in the case of its application for conversion of continuous ion beam into discrete ion beam, the device, in particular, can receive continuous ion beam at the inlet and produce a beam consisting of discrete packets of ions at the outlet, directly into an output device operating is pulsed mode.

In embodiments, in the case of its application for conversion of continuous ion beam into discrete ion beam, the output discrete packets of ions in the device, in particular, can be essentially time-synchronised.

In embodiments, in the case of its application for conversion of continuous ion beam into discrete ion beam, the device, in particular, can encompass several stages of differential pumping; in that way, the pressure of gas can vary essentially along the length of said device, and injecting of ions into the mentioned device can take place at essentially higher pressure as compared with the ion outlet area and the mentioned device.

In embodiments, the device can be used in an ion accumulation device, wherein accumulation of ions takes place within the device.

In embodiments, in the case where the device is used in an ion accumulation device, the device can provide mass selectivity of the device.

In embodiments, the device can be used in the structure of ion source; in that case, the generation of ions can take place within the device.

In embodiments, in the case where the device is used in the structure of an ion source, the high-frequency fields created in the claimed device can be used for: 1) confinement of ions, 2) transportation of ions along a defined path, 3) excitation of internal energy of ions, 4) collisional damping of the velocity of ions, 5) collisional cooling of internal energy of ions, 6) conversion of discrete ion beam into continuous or quasicontinuous ion beam, 7) protection of solid surfaces of ion source against contamination with the material under investigation and accumulation of electric charges, 8) confinement of ions with opposite charges, 9) confinement of ions within a wide mass range, 10) coarse filtration of ions based on the parameter of mass-to-charge ratio.

In embodiments, the device can be used in the structure of a cell for fragmentation of ions, wherein, confinement of ions within the device can be realised due to the effect of high-frequency electric fields of the device, and fragmentation of ions is caused by: 1) injecting of ions into said device with sufficiently high kinetic energy, 2) drop of ions onto the surface of the elements of said device, 3) fast-particle bombardment of ions, 4) lighting of ions with photons, 5) fast electron impact on ions, 6) slow electron impact on ions and dissociation of ions as a result of electron capture, 7) ion-molecular reactions of ions with particles having opposite charges, 8) ion-molecular reactions with aggressively acting vapours.

The following numbered paragraphs contain statements of broad combinations of the inventive technical features herein disclosed:

1. Device for manipulations with charged particles, containing a series of electrodes located so as to form a channel used for transportation of charged particles; a power supply unit to provide supply voltages to be applied to said electrodes for the purpose of creation of a non-uniform high-frequency electric field within said channel; pseudopotential of said field having one or more local extrema along the length of said channel for transportation of charged particles, at least within a certain interval of time; whereas at least one of said extrema of the pseudopotential is transposed with time, at least within a certain interval of time, at least within a part of the length of the channel used for transportation of charged particles.

2. Device according to paragraph 1, wherein, said pseudopotential has alternating maxima and minima along the length of the channel used for transportation of charged particles.

3. Device according to any one of the preceding paragraphs, wherein, extremum or extrema of said pseudopotential is transposed with time, in accordance with a certain time law, at least within a part of the length of the channel, at least within a certain interval of time.

4. Device according to any one of the preceding paragraphs, wherein, the direction of transposition of extremum or extrema of said pseudopotential changes the sign, at certain point or certain points of time, at least for a part of the length of the channel.

5. Device according to any one of the preceding paragraphs, wherein, transposition of extremum or extrema of said pseudopotential has oscillating pattern, at least within a part of the length of the channel, at least within a certain interval of time.

6. Device according to any one of the preceding paragraphs, wherein, the pseudopotential is uniform along the length of the channel, at least within a certain interval of time, at least within a certain part of the length of transportation channel.

7. Device according to any one of the preceding paragraphs, wherein, successive extrema, or successive maxima only, or successive minima only, of said pseudopotential, are monotone increasing, at least within a part of the length of the channel, at least within a certain interval of time.

8. Device according to any one of the preceding paragraphs, wherein successive extrema, or successive maxima only, or successive minima only, of said pseudopotential, are monotone decreasing, at least within a part of the length of the channel, at least within a certain interval of time.

9. Device according to any one of the preceding paragraphs, wherein, the value of said pseudopotential in one or more points of local maxima of said pseudopotential varies along the length of the channel, at least within a certain interval of time.

10. Device according to any one of the preceding paragraphs, wherein, the value of said pseudopotential in one or more points of local minima of said pseudopotential varies along the length of the channel, at least within a certain interval of time.

11. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing control of radial confinement of charged particles within the channel for transportation of charged particles.

12. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing unlocking and/or locking the escape of charged particles through the ends of the channel used for transportation of charged particles.

13. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing control of spatial isolation of the packets of charged particles from each other along the length of the channel used for transportation of charged particles.

14. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing control of time synchronisation of the transportation of packets of charged particles.

15. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing additional control of the transportation of charged particles.

16. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing control of the movement of charged particles within the local areas of capture of charged particles.

17. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing creation of additional potential or pseudopotential barriers, and/or potential or pseudopotential wells along the channel for transportation of charged particles, at least in one point of the path within said channel, at least within a certain interval of time.

18. Device according to any one of the preceding paragraphs, wherein, said potential or pseudopotential barriers, and/or potential or pseudopotential wells vary with time or travel with time along the transportation channel, at least within a certain interval of time.

19. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing creation of additional zones of stability and/or additional zones of instability along the channel for transportation of charged particles, at least in one point of the path within said channel, at least within a certain interval of time.

20. Device according to any one of the preceding paragraphs, wherein, said zones of stability and/or zones of instability vary with time or travel with time along the transportation channel, at least, within a certain interval of time.

21. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing selective extraction of charged particles.

22. Device according to any one of the preceding paragraphs, wherein, additional voltages are applied to electrodes; said voltages being DC voltages, and/or quasi-static voltages, and/or AC voltages, and/or pulsed voltages, and/or high-frequency voltages, thus providing control of essential dependence of the motion of charged particles on the mass of charged particles.

23. Device according to any one of the preceding paragraphs, wherein, frequency of the supply voltage applied to electrodes varies, at least within a certain interval of time.

24. Device according to any one of the preceding paragraphs, wherein, the channel used for transportation of charged particles has a rectilinear orientation.

25. Device according to any one of the preceding paragraphs, wherein, the channel used for transportation of charged particles has a curvilinear orientation.

26. Device according to any one of the preceding paragraphs, wherein, the channel used for transportation of charged particles has variable profile along the length of the channel.

27. Device according to any one of the preceding paragraphs, wherein, the channel used for transportation of charged particles is closed to form a loop or a ring.

28. Device according to any one of the preceding paragraphs, wherein, an additional electrode or electrodes are located in the central part of the channel used for transportation of charged particles.

29. Device according to any one of the preceding paragraphs, wherein, the channel used for transportation of charged particles is subdivided into segments.

30. Device according to any one of the preceding paragraphs, the channel used for transportation of charged particles consists of a series of channels attached to each other, possibly, interfaced by additional zones or devices.

31. Device according to any one of the preceding paragraphs, the channel used for transportation of charged particles is formed by a number of parallel channels for charged particle transportation, at least, in some part of the channel.

32. Device according to any one of the preceding paragraphs, the channel used for transportation of charged particles is split within some part of the channel, into a number of parallel channels.

33. Device according to any one of the preceding paragraphs, wherein, a number of parallel channels for charged particle transportation are connected along some sector thereof, to form a single channel for transportation of charged particles.

34. Device according to any one of the preceding paragraphs, wherein, the channel used for transportation of charged particles contains an area, which performs the function of storage volume for charged particles, the said area located at the inlet to the channel, and/or at the outlet from the channel, and/or inside the channel.

35. Device according to any one of the preceding paragraphs, wherein, the channel used for transportation of charged particles is plugged, at least at either end, at least within a certain interval of time.

36. Device according to any one of the preceding paragraphs, wherein, the channel used for transportation of charged particles has a stopper controlled by electric field, at least at one of the ends.

37. Device according to any one of the preceding paragraphs, wherein, the channel used for transportation of charged particles contains a mirror controlled by electric field, whereas said mirror is placed in the channel used for charged particle transportation, at least at one of the ends.

38. Device according to any one of the preceding paragraphs, containing a device used for inlet of charged particles, located in the channel used for charged particle transportation, whereas said inlet device operates in a continuous mode.

39. Device according to any one of the preceding paragraphs, containing a device used for inlet of charged particles, located in the channel used for charged particle transportation, whereas said inlet device operates in a pulsed mode.

40. Device according to any one of the preceding paragraphs, containing a device used for inlet of charged particles, located in the channel used for charged particle transportation, whereas said inlet device is capable of switching between continuous mode of operation and pulsed mode of operation.

41. Device according to any one of the preceding paragraphs, containing a device used for outlet of charged particles, located in the channel used for charged particle transportation, whereas said outlet device operates in a continuous mode.

42. Device according to any one of the preceding paragraphs, containing a device used for outlet of charged particles, located in the channel used for charged particle transportation, whereas said outlet device operates in a pulsed mode.

43. Device according to any one of the preceding paragraphs, containing a device used for outlet of charged particles, located in the channel used for charged particle transportation, whereas said outlet device is capable of switching between continuous mode of operation and pulsed mode of operation.

44. Device according to any one of the preceding paragraphs, containing a device for generation of charged particles, located in the channel used for charged particle transportation, whereas said generating device operates in a continuous mode.

45. Device according to any one of the preceding paragraphs, containing a device for generation of charged particles, located in the channel used for charged particle transportation, whereas said generating device operates in a pulsed mode.

46. Device according to any one of the preceding paragraphs, containing a device for generation of charged particles, located in the channel used for charged particle transportation, whereas said generating device is capable of switching between continuous mode of operation and pulsed mode of operation.

47. Device according to any one of the preceding paragraphs, wherein, a non-uniform high-frequency electric field within the channel is created by the supply voltages in the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, whereas said voltages undergo amplitude modulation, or otherwise, a superposition of the said voltages is used.

48. Device according to any one of the preceding paragraphs, wherein, a non-uniform high-frequency electric field within the channel is created by the supply voltages in the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, whereas said voltages undergo frequency modulation, or otherwise, a superposition of the said voltages is used.

49. Device according to any one of the preceding paragraphs, wherein, a non-uniform high-frequency electric field within the channel is created by the supply voltages in the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, whereas said voltages undergo phase modulation, or otherwise, a superposition of the said voltages is used.

50. Device according to any one of the preceding paragraphs, wherein, a non-uniform high-frequency electric field within the channel is created by the supply voltages in the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, whereas the said voltages feature two or more neighbour fundamental frequencies, or otherwise, a superposition of the said voltages is used.

51. Device according to any one of the preceding paragraphs, wherein, a non-uniform high-frequency electric field within the channel is created by the supply voltages in the form of high-frequency harmonic voltages, and/or periodic non-harmonic high-frequency voltages, and/or high-frequency voltages having frequency spectrum, which contains two or more frequencies, and/or high-frequency voltages having frequency spectrum, which contains an infinite set of frequencies, and/or high-frequency pulsed voltages, whereas the said voltages are converted into time-synchronised trains of high-frequency voltages, or otherwise, a superposition of the said voltages is used.

52. Device according to any one of the preceding paragraphs, wherein, a non-uniform high-frequency electric field within the channel is created by the supply voltages in the form of high-frequency voltages, synthesised using a digital method.

53. Device according to any one of the preceding paragraphs, wherein, the aggregate of electrodes represents repetitive electrodes.

54. Device according to any one of the preceding paragraphs, wherein, the aggregate of electrodes represents repetitive cascades of electrodes, whereas configuration of electrodes in an individual cascade is not necessarily periodical.

55. Device according to any one of the preceding paragraphs, wherein, some of the electrodes or all the electrodes can be solid, whereas the other electrodes or a part of the other electrodes are disintegrated to form a periodic string of elements.

56. Device according to any one of the preceding paragraphs, wherein, high-frequency voltages may not be applied to certain electrodes.

57. Device according to any one of the preceding paragraphs, wherein, certain electrodes, or all the electrodes in the aggregate of electrodes have multipole profile.

58. Wherein, certain electrodes, or all the electrodes in the aggregate of electrodes have coarsened multipole profile formed by plane, stepped, piecewise-stepped, linear, piecewise-linear, circular, rounded, piecewise-rounded, curvilinear, piecewise-curvilinear profiles, or by a combination of the said profiles.

59. Device according to any one of the preceding paragraphs, wherein, certain electrodes, or all the electrodes in the aggregate of electrodes, represent thin metallic films deposited on a non-conductive substrates.

60. Device according to any one of the preceding paragraphs, wherein, certain electrodes, or all the electrodes in the aggregate of electrodes are wire and/or mesh, and/or have slits and/or other additional apertures making the said electrodes transparent for gas flow, or enabling reduction of the resistance for the gas flow through the said electrodes.

61. Device according to any one of the preceding paragraphs, wherein, vacuum is created in the channel used for transportation of charged particles.

62. Device according to any one of the preceding paragraphs, wherein, the channel used for charged particle transportation is filled with a neutral gas, and/or (partly) ionised gas.

63. Device according to any one of the preceding paragraphs, wherein, a flow of neutral and/or (partly) ionised gas is created in the channel used for transportation of charged particles.

64. Device according to any one of the preceding paragraphs, wherein, several electrodes or all of the electrodes have slits and/or apertures intended for inlet of charged particles into the device, and/or outlet of charged particles from the device.

65. Device according to any one of the preceding paragraphs, wherein, the gap between the electrodes is used for inlet of charged particles into the device, and/or outlet of charged particles from the device.

66. Device according to any one of the preceding paragraphs, wherein, additional pulsed or stepwise voltages are applied, at least to a part of electrodes, at least within some interval of time; whereas the said voltages enable inlet of charged particles into the device, and/or outlet of charged particles from the device, and/or confinement of charged particles within the device.

EXAMPLES AND FURTHER DISCUSSION

Operation of the device is demonstrated using the following examples.

Example 1

Figure 53:
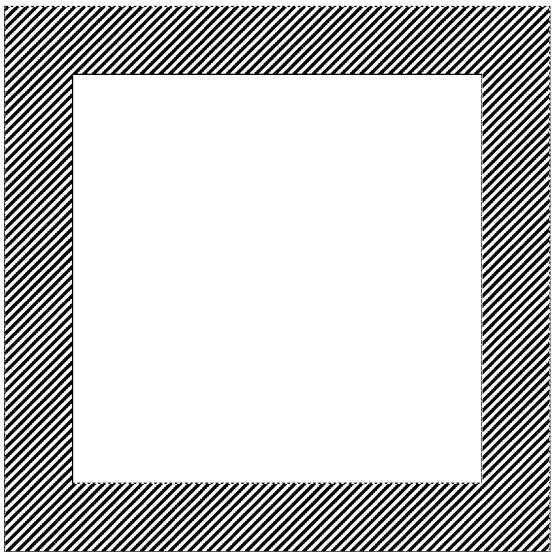
FIG. 53. Plane, non-annular diaphragm, used for creation of a channel for charged particle transportation, consisting of repetitive single diaphragms.
Figure 54:
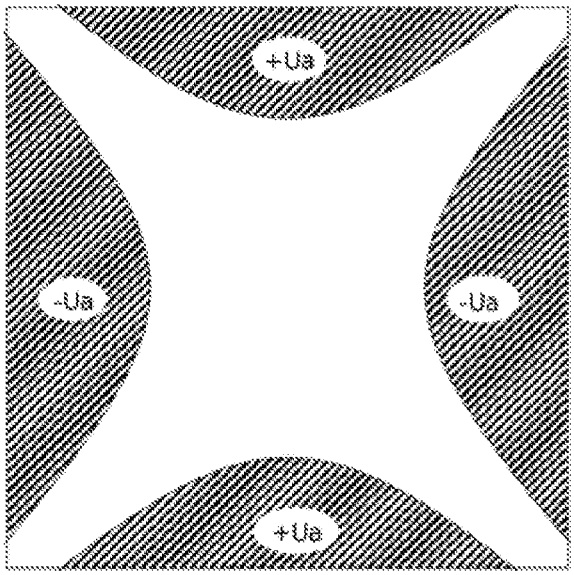
FIG. 54. Quadrupole-like configuration of the electrodes of single diaphragm, used for creation of a channel for charged particle transportation. This configuration enables more efficient (as compared with simple diaphragms) compression of the ion beam to the axis of the device. Analytically calculated profiles of these electrodes are not hyperbolic, but defined by transcendental equations with interposition of higher transcendental functions.
Figure 69:
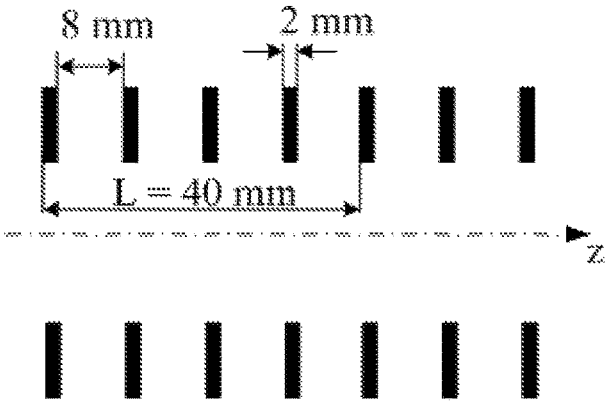
FIG. 69. Axial cross-section and geometrical dimensions of the periodical sequences of electrodes composed of single plane diaphragms with square apertures, used as example 1 (see below).
Figure 70:
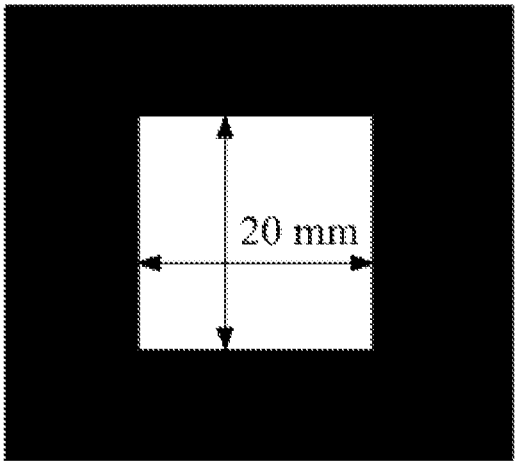
FIG. 70. Geometrical dimensions of single plane diaphragms with square apertures, used for periodical sequence of electrodes in example 1.

For the electrodes 1, the system of electrodes described above was used, the system consisting of periodic sequence of plane diaphragms with square cross-section (FIG. 53). Geometrical parameters and dimensions of the specified system of electrodes are shown in FIG. 69, geometrical dimensions of single diaphragm with square aperture are shown in FIG. 70.

For the supply voltage, sinusoidal supply with amplitude modulation was used. Periodic sequence of electrodes was subdivided into groups of four electrodes. The first electrodes in each group were supplied with electric voltage $+U_0 \cos(\delta t)\cos(\omega t)$, the second electrodes were supplied with voltage $+U_0 \sin(\delta t)\cos(\omega t)$, the third electrodes were supplied with voltage $-U_0 \cos(\delta t)\cos(\omega t)$, the fourth electrodes were supplied with voltage $-U_0 \sin(\delta t)\cos(\omega t)$. The fundamental frequency of sinusoidal supply was selected to be equal to $\omega$=1 MHz, the frequency of amplitude modulation of sinusoidal supply was selected to be equal to $\delta$=1 kHz, the amplitude of sinusoidal supply was selected to be equal to $U_0$=400 V. The transportation channel was filled with buffer gas, for the buffer gas, nitrogen gas was used (molecular mass 28 amu) at pressure of 2 mTorr (1 Torr=1 mm Hg) and temperature of 300 K. For the charged particles, singly charged ions having the mass of 609 amu were used. As one can see from FIG. 71, the behaviour of charged particles met the expectations: breaking-up of the continuous cloud of charged particles into individual, spatially separated packets, and uniform movement of said packets along the axis of the device took place. The velocity of movement of the clouds of charged particles was in compliance with the expected velocity, and was defined by the frequency of amplitude modulation δ.

Example 2

Figure 59:
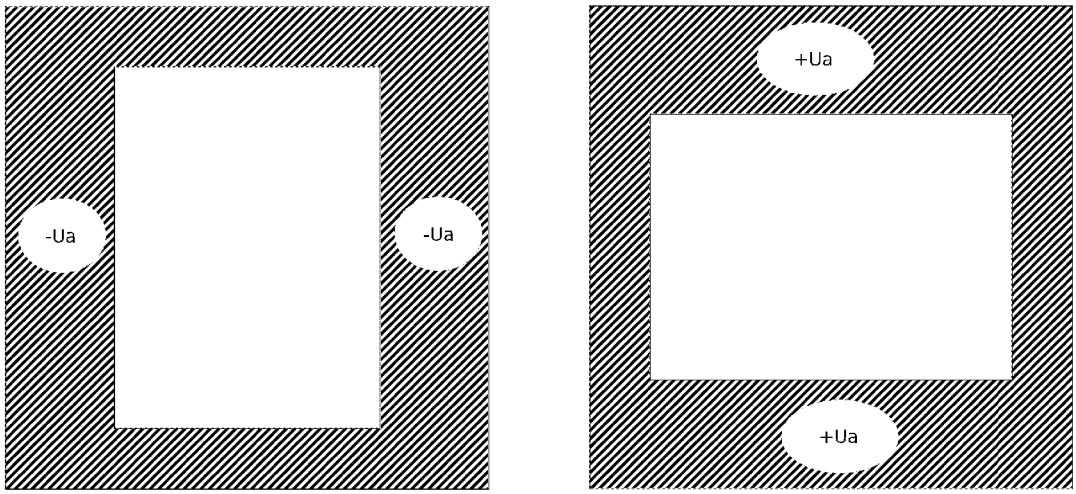
FIG. 59. Plane diaphragms with rectangular apertures, used for creation of a channel for charged particle transportation, composed of repetitive diaphragms with various cross-sections, creating high-frequency electric field with pseudopotential having non-uniform multipole components along the length of the channel for charged particle transportation.
Figure 72:
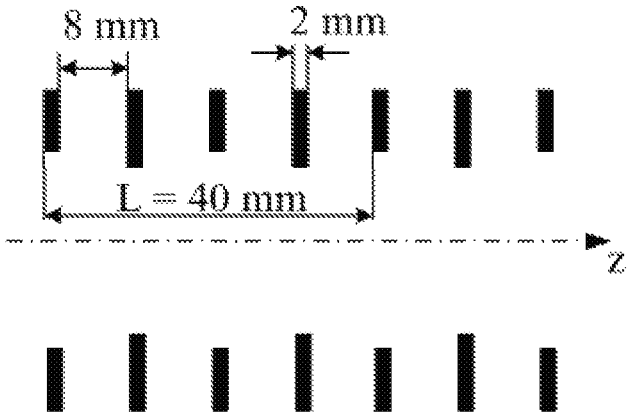
FIG. 72. Axial cross-section and geometrical dimensions of the periodical sequences of electrodes composed of alternating, plane, single diaphragms with rectangular apertures, used as example 2.
Figure 73:
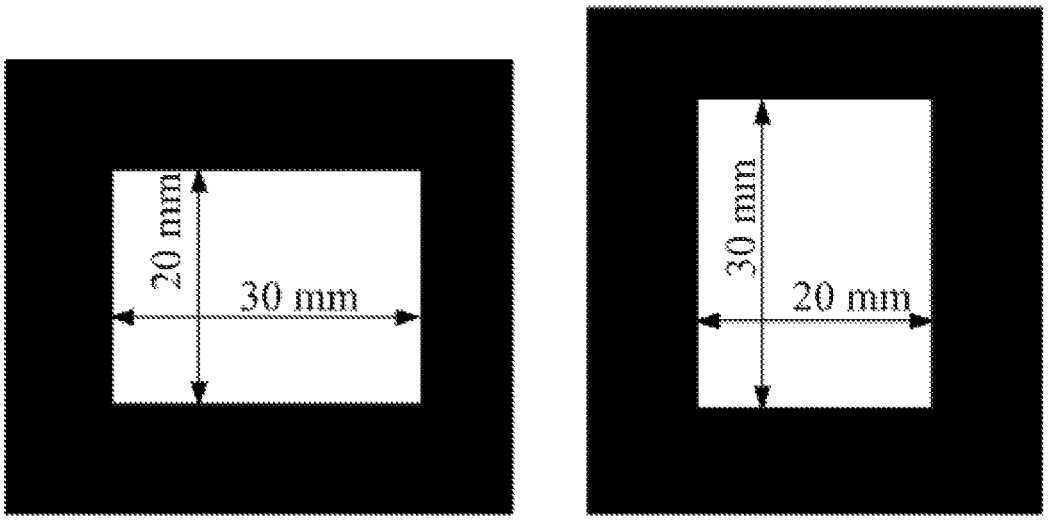
FIG. 73. Geometrical dimensions of alternating, plane, single diaphragms with rectangular apertures, used for periodical sequence of electrodes in example 2 (see below).

For the electrodes 1, the system of electrodes described above was used, the system consisting of periodic sequence of alternating plane diaphragms with rectangular cross-sections (FIG. 59). Geometrical parameters and dimensions of the specified system of electrodes are shown in FIG. 72, geometrical dimensions of single diaphragm with square aperture are shown in FIG. 73.

Figure 74:
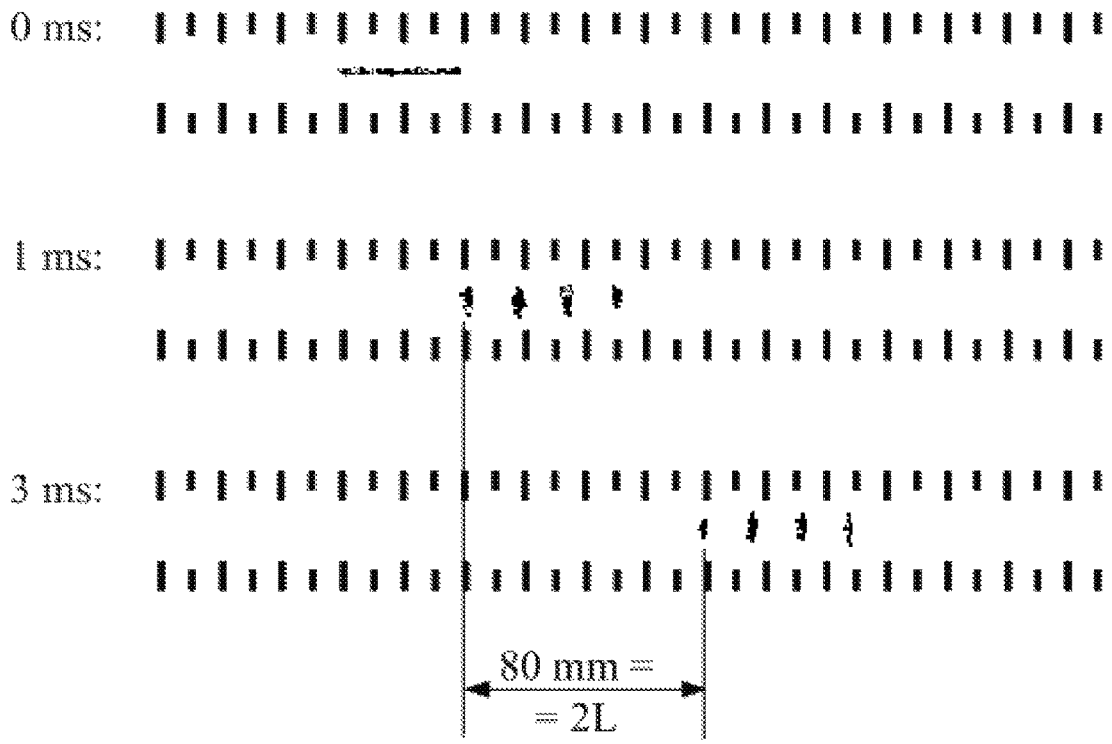
FIG. 74. Breaking-up of the initial ensemble of charged particles into spatially separated packets and transportation thereof along the channel for charged particle transportation in example 2.

For the supply voltage, sinusoidal supply with amplitude modulation was used. Periodic sequence of electrodes was subdivided into groups of four electrodes. The first electrodes in each group were supplied with electric voltage $+U_0 \cos(\delta t)\cos(\omega t)$, the second electrodes were supplied with voltage $+U_0 \sin(\delta t)\cos(\omega t)$, the third electrodes were supplied with voltage $-U_0 \cos(\delta t)\cos(\omega t)$, the fourth electrodes were supplied with voltage $-U_0 \sin(\delta t)\cos(\omega t)$. The fundamental frequency of sinusoidal supply was selected to be equal to ω=1 MHz, the frequency of amplitude modulation of sinusoidal supply was selected to be equal to δ=1 kHz, the amplitude of sinusoidal supply was increased up to $U_0$=2000 V (2 kV). The transportation channel was filled with buffer gas, for the buffer gas, nitrogen gas was used (molecular mass 28 amu) at pressure of 2 mTorr and temperature of 300 K. For the charged particles, singly charged ions having the mass of 609 amu, and singly charged ions having the mass of 5000 amu. Amplitude of sinusoidal supply was increased in comparison with example 1, for more efficient manipulation with charged particles of heavier mass. As one can see from FIG. 74, the behaviour of charged particles met the expectations: breaking-up of the continuous cloud of charged particles of both masses into individual, spatially separated packets, and uniform movement of said packets along the axis of the device took place. The velocity of movement of the clouds of charged particles was in compliance with the expected velocity. As opposed to the previous example, the clouds of charged particles in this example are extended more in vertical direction, and their geometrical dimensions in radial direction along the axis OY and along the axis OZ (coordinate axis OX is selected here as the axis) are decreased and increased periodically, according to passage of a cloud of charged particles through alternating rectangular sections of diaphragms.

Example 3

Figure 55:
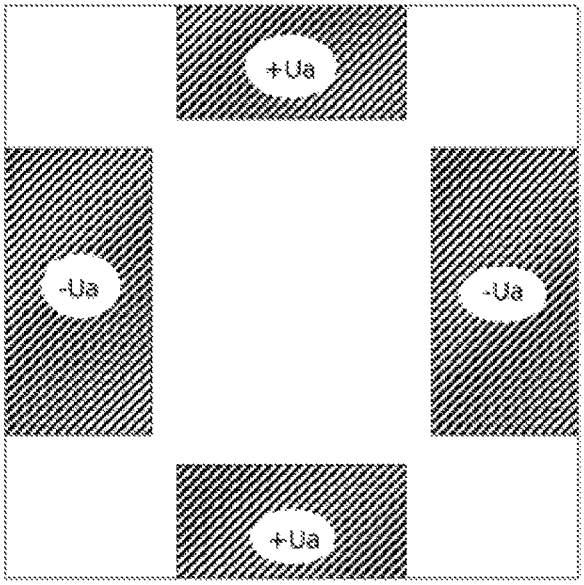
FIG. 55. Rectangular profile of the electrodes of single diaphragm, used for formation of a channel for charged particle transportation, as an example of profile for creation of electric field with the required distribution of pseudopotential along the axis of the device containing quadrupole components.
Figure 56:
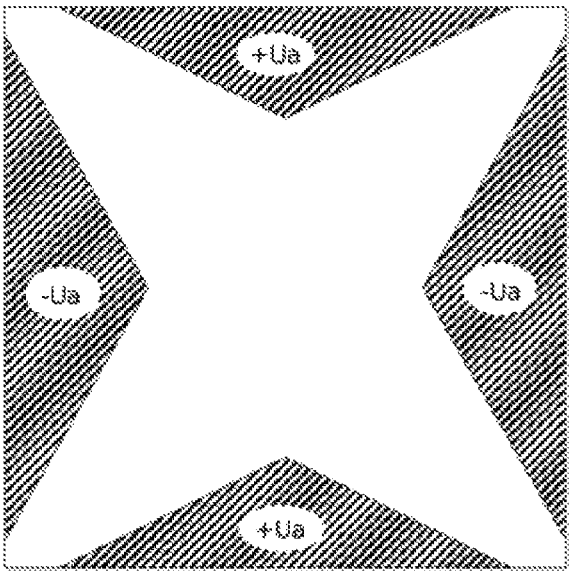
FIG. 56. Triangular profile of the electrodes of single diaphragm, used for formation of a channel for charged particle transportation, as an example of profile for creation of electric field with the required distribution of pseudopotential along the axis of the device, containing quadrupole components.
Figure 75:
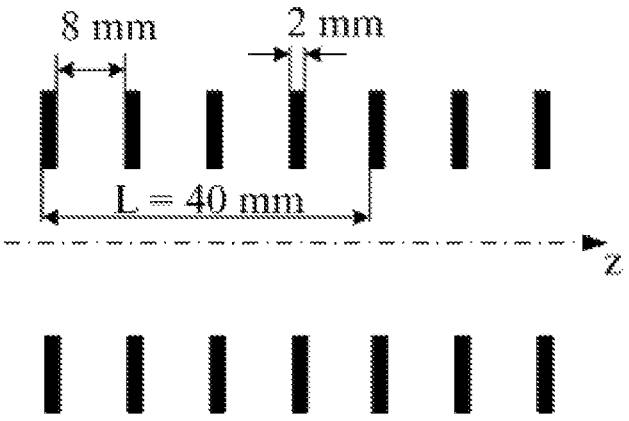
FIG. 75. Axial cross-section and geometrical dimensions of the periodical sequences of electrodes composed of alternating, plane, single diaphragms with plane independent electrodes and quadrupole configuration of electric field, used as an example 3 (see below).
Figure 76:
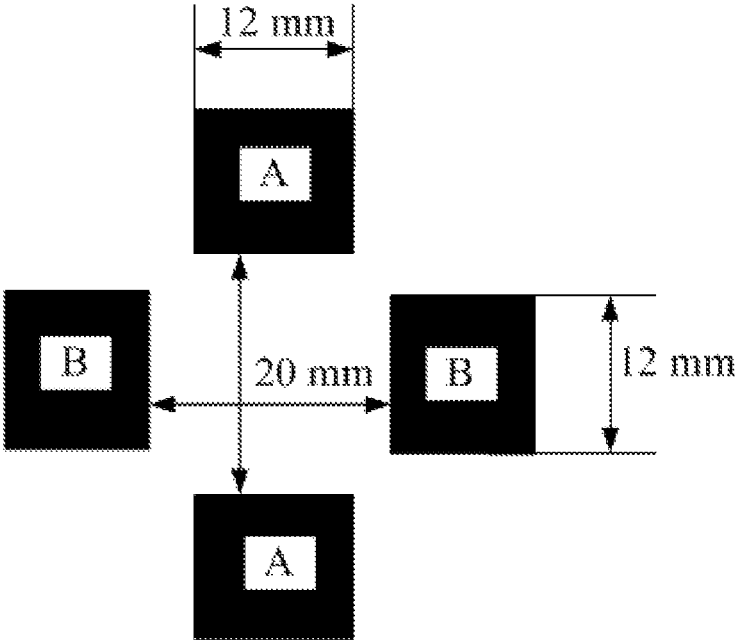
FIG. 76. Geometrical dimensions of alternating, plane, single diaphragms with plane independent electrodes and quadrupole configuration of electric field, used for periodical sequence of electrodes in example 3.

For the electrodes 1, the system of electrodes described above was used, the system consisting of periodic sequence of plane diaphragms, consisting of plane electrodes and providing quadrupole structure of electric field in the section of diaphragm (FIG. 55). Geometrical parameters and dimensions of the specified system of electrodes are shown in FIG. 75, geometrical dimensions of single square diaphragm consisting of four independent plane electrodes are shown in FIG. 76.

Figure 77:
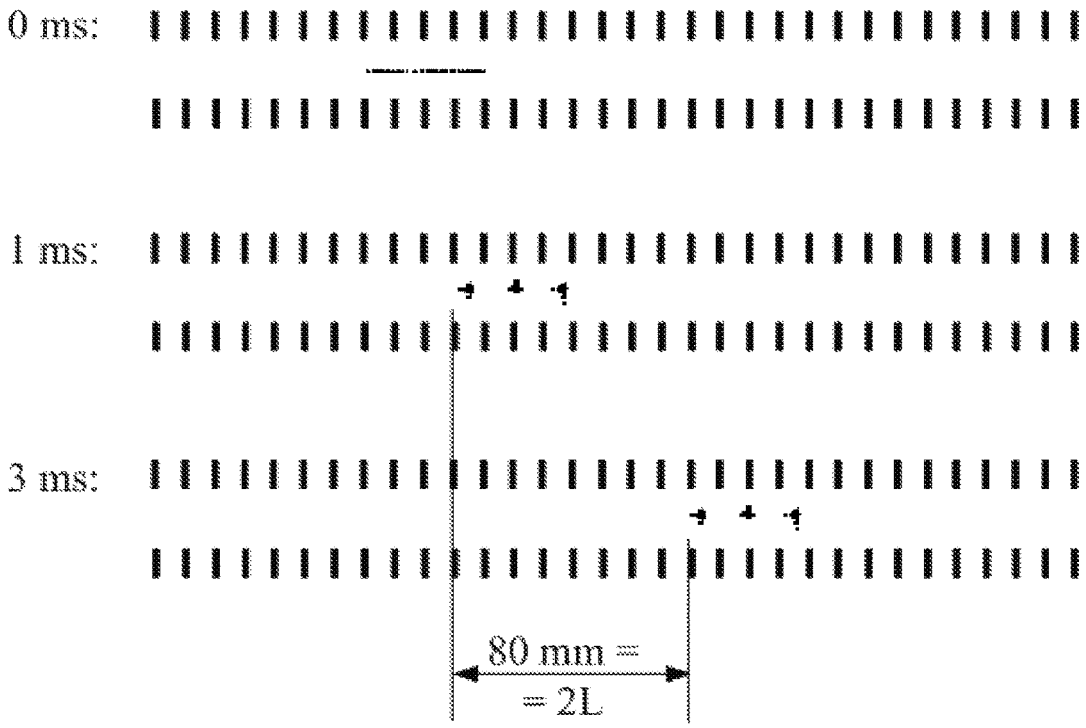
FIG. 77. Breaking-up of the initial ensemble of charged particles into spatially separated packets and transportation thereof along the channel for charged particle transportation in example 3.

For the supply voltage, sinusoidal supply with amplitude modulation was used. The electrodes, designated in FIG. 76 as <<A>> electrodes, electric voltage was supplied opposite in phase with electric voltage supplied to the electrodes designated in FIG. 76 as <<B>> electrodes. Periodic sequence of diaphragms was subdivided into groups of four, composed of consecutive diaphragms. The first diaphragms in each group of four were supplied with electric voltage $\pm U_0 \cos(\delta t)\cos(\omega t)$ (the sign of <<plus>> or <<minus>> is selected depending on whether this electrode of the diaphragm is designated as <<A>> electrode, or <<B>> electrode), the second diaphragms were supplied with electric voltage $\pm U_0 \sin(\delta t)\cos(\omega t)$, the third diaphragms were supplied with electric voltage $\mp U_0 \cos(\delta t)\cos(\omega t)$, the fourth diaphragms were supplied with electric voltage $\mp U_0 \sin(\delta t)\cos(\omega t)$. Fundamental frequency of sinusoidal supply was selected to be equal to ω=1 MHz, frequency of amplitude modulation of sinusoidal supply was selected to be equal to δ=1 kHz. Due to the fact that for quadrupole configuration of electrodes axial field is weakened considerably as against the configuration of electrodes composed of simple diaphragms, the amplitude of sinusoidal supply was increased up to $U_0$=4000 V. The transportation channel was filled with buffer gas. For the buffer gas, nitrogen gas was used (molecular mass 28 amu) at pressure of 2 mTorr and temperature of 300 K. For the charged particles, singly charged ions of both polarities (positively and negatively charged) having the mass of 609 amu were used. As one can see from FIG. 77, the behaviour of charged particles met the expectations: breaking-up of the continuous cloud of charged particles into individual, spatially separated packets, and uniform movement of said packets along the axis of the device took place. The velocity of movement of the clouds of charged particles was in compliance with the expected velocity. One can also see that the charged particles having opposite charges are controlled equally by the applied electric field. In this example the clouds of charged particles are blurred to a higher degree as compared with example 1, which is associated with the fact that the axial distribution of the high-frequency field is weakened to a large degree, and as a result, the local pseudopotential wells have shallower depth and less steep borders. In addition, in this case, high-frequency field near the edges of electrodes have considerably higher amplitude, and as a result, repels much stronger the charged particles from the edges of diaphragm towards its centre.

Example 4

Figure 60:
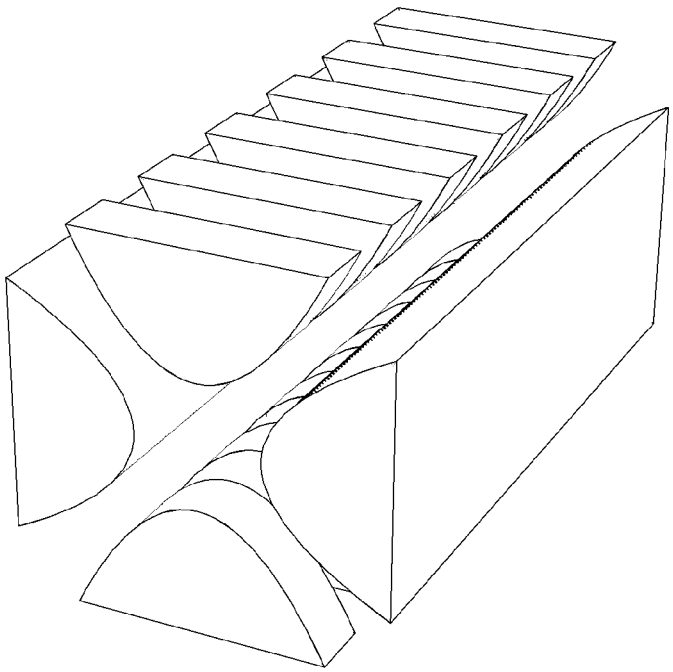
FIG. 60. Plane slotted diaphragms of quadrupole-like structure in aggregate with solid quadrupole-like electrode.
Figure 78:
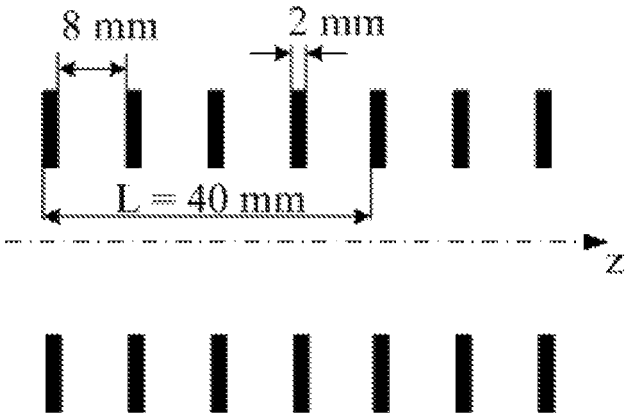
FIG. 78. Axial cross-section and geometrical dimensions of the periodical sequences of electrodes composed of sectionalised repetitive quadrupole-like electrodes and two solid quadrupole-like electrodes (see FIG. 60) which provide quadrupole configuration of electric field, and used as an example 4 (see below).

For the electrodes 1, the system of electrodes was used, consisting of periodic sequence of slotted quadrupole-like electrodes and two solid quadrupole-like electrodes, which provides quadrupole structure of electric field in the cross-section of transportation channel (general view of the device is shown in FIG. 60). Geometrical parameters and dimensions of the specified system of electrodes are shown in FIG. 78, geometrical dimensions of quadrupole-like profiles of electrodes are shown in FIG. 79.

Figure 79:
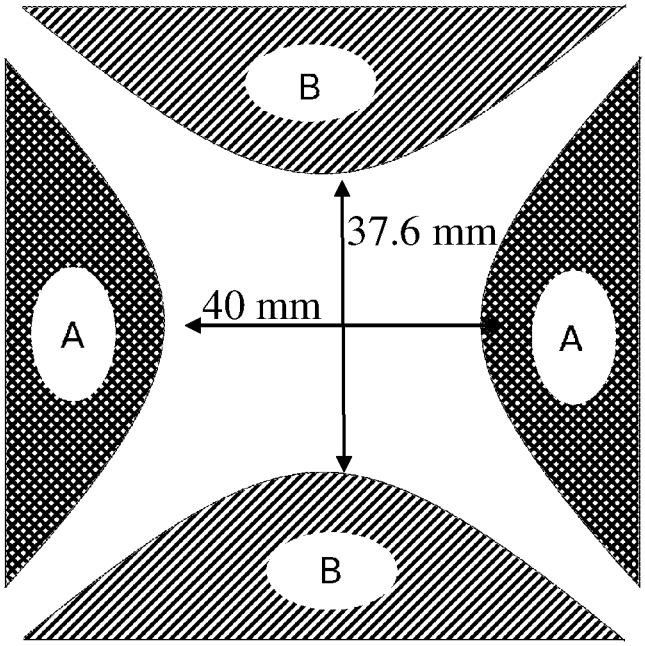
FIG. 79. Geometrical dimensions of alternating quadrupole-like sections composed of sectionalised repetitive quadrupole-like electrodes and two solid quadrupole-like electrodes (see FIG. 60), used for the aggregate of electrodes in example 4.
Figure 80:
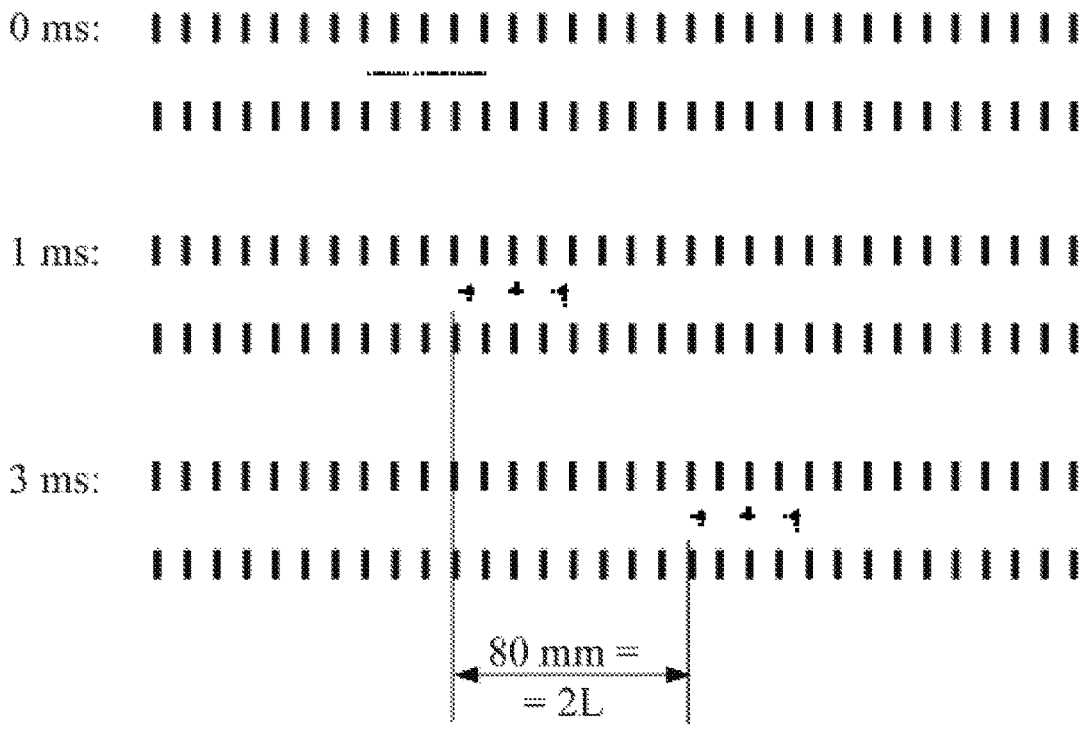
FIG. 80. Breaking-up of the initial ensemble of charged particles into spatially separated packets and transportation thereof along the channel for charged particle transportation in example 4.

For the supply voltage, sinusoidal supply with amplitude modulation was used, which was supplied to slotted electrodes, designated in FIG. 79 as <<B>> electrodes. RF voltages were not supplied to the solid electrodes, designated in FIG. 79 as <<A>> electrodes; these were permanently at zero voltage. Periodic sequence of the oppositely located sectionalised electrodes was subdivided into groups of four. The first pair of electrodes in each group was supplied with electric voltage $+U_0 \cos(\delta t)\cos(\omega t)$, the second pair of electrodes was supplied with electric voltage $+U_0 \sin(\delta t)\cos(\omega t)$, the third pair of electrodes was supplied with electric voltage $-U_0 \cos(\delta t)\cos(\omega t)$, the fourth pair of electrodes was supplied with electric voltage $-U_0 \sin(\delta t)\cos(\omega t)$. Fundamental frequency of sinusoidal supply was selected to be equal to ω=1 MHz, frequency of amplitude modulation of sinusoidal supply was selected to be equal to δ=1 kHz. Due to the fact that for quadrupole configuration of electrodes axial field is weakened considerably as against the configuration of electrodes composed of simple diaphragm, the amplitude of sinusoidal supply was increased up to $U_0$=3000 V (3 kV). The transportation channel was filled with buffer gas, for the buffer gas, nitrogen gas was used (molecular mass 28 amu) at pressure of 2 mTorr and temperature of 300 K. For the charged particles, singly charged, doubly charged, and triple-charged ions having the mass of 609 amu were used. The amplitude of electric field was selected to be high enough for efficient manipulation with the particles carrying different charges. As one can see from FIG. 80, the behaviour of charged particles met the expectations: breaking-up of the continuous cloud of charged particles into individual, spatially separated packets, and uniform movement of said packets along the axis of the device took place. The velocity of movement of the clouds of charged particles was also in compliance with the expected velocity and was defined by the frequency δ.

Digital Drive Method

Embodiments comprise a digital drive method for generation of the high frequency voltage. That is, embodiments comprise digital waveforms. The application of digital drive/waveforms provides for particularly practical implementation compared to alternative methods.

For example, harmonic waveforms may readily and reliably be provided using tuned RF generators. Such devices typically contain a highly tuned resonant LC circuit. Such devices can be used to drive a very well defined capacitive load. However, when such devices are used in combination in embodiments of the present invention, their application benefits from further explanation. The digital drive method introduced above provides for a straight forward method for generating the necessary periodic signals. The digital drive technology is described in U.S. Pat. No. 7,193,207 and the disclosures and methods in U.S. Pat. No. 7,193,207 are incorporated herein by reference. In particular, U.S. Pat. No. 7,193,207 describes digital drive apparatus for 'driving' (that means providing periodic waveforms for various mass spectrometer devices such as quadrupole or quadrupole ion trap. U.S. Pat. No. 7,193,207 describes a digital signal generator (programmable impulse device as introduced above) and a switching arrangement, which alternately switches between high and low voltage levels (V1, V2) to generate a rectangular wave drive voltage. The digital signal generator may be controlled via a computer of other means, to control the parameters of the square waveform, such as the frequency and the duty cycle and phase. Furthermore the digital periodic waveform may be terminated at a precise phase. One may also envisage more complex waveforms produce by the digital method by switching arrangement with three or more high voltage switches.

Figure 81:
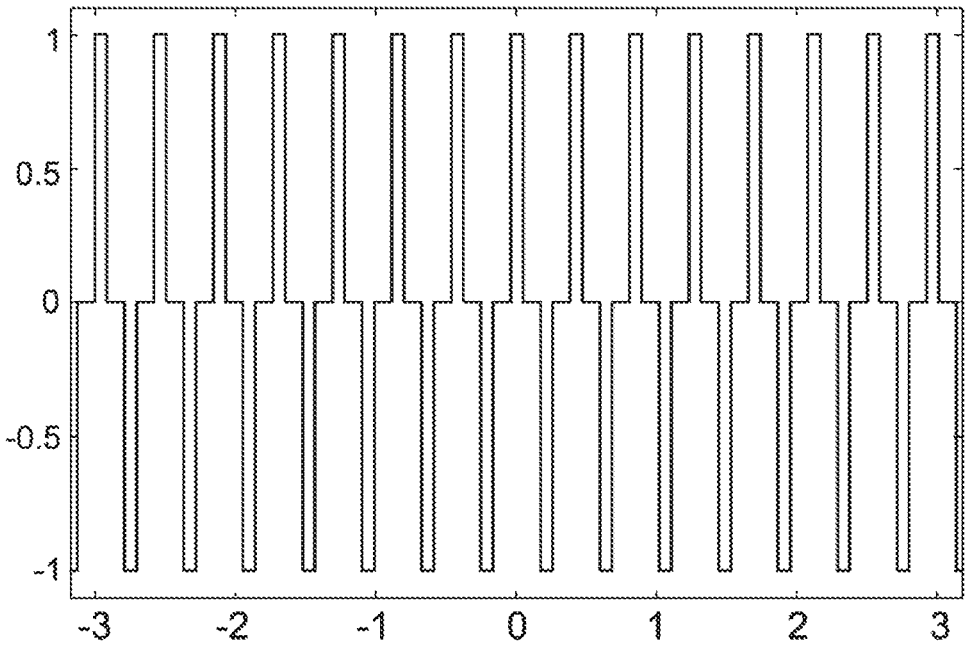
FIG. 81. Digital waveform signal that can be generated using a switching arrangement having three switches.
Figure 82:
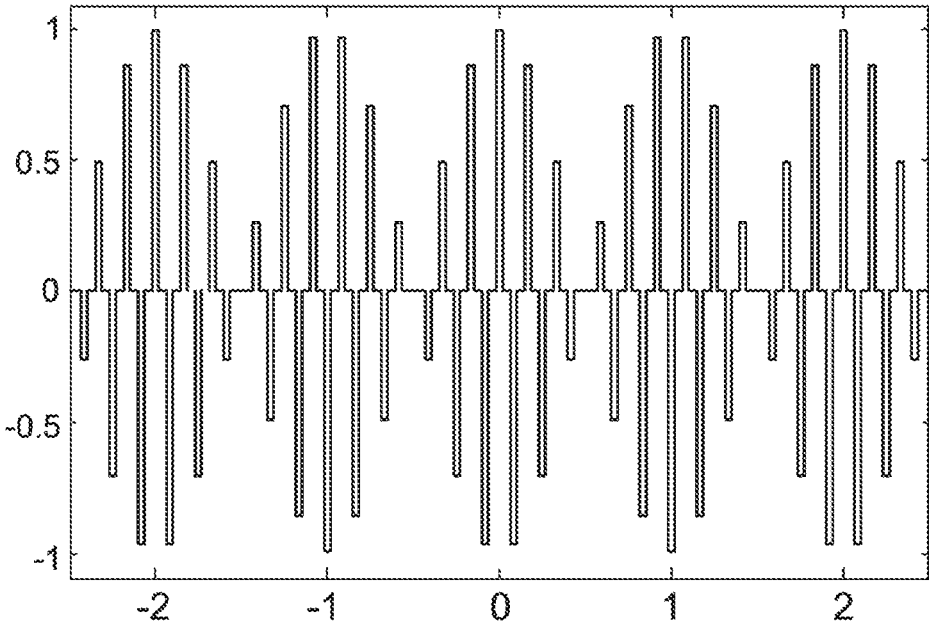
FIG. 82. Discrete digital waveform signal with amplitude modulation as cos(x).
Figure 83:
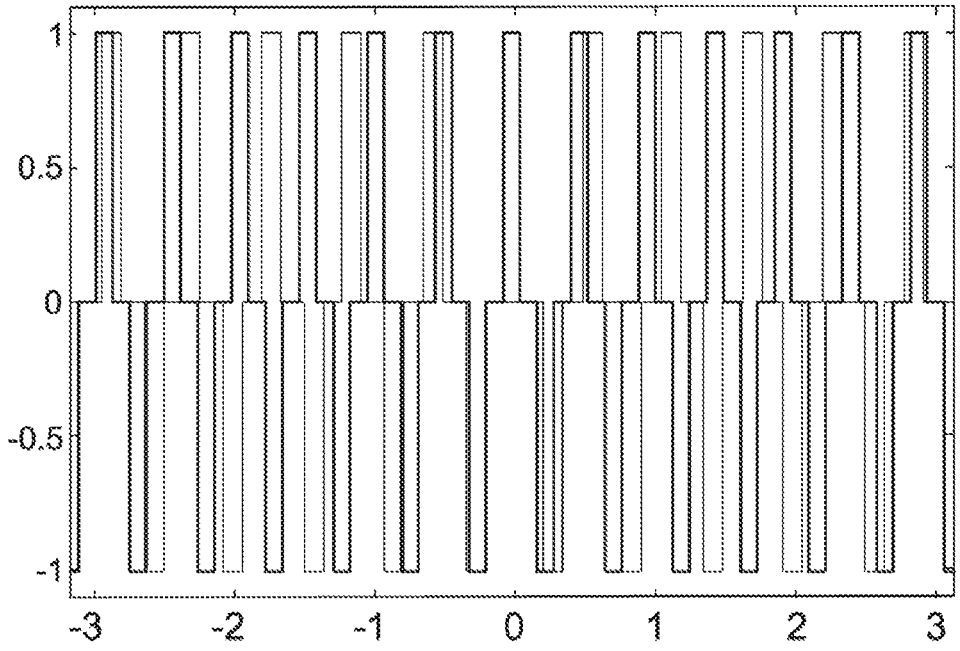
FIG. 83. Two discrete digital waveform signals with slightly different frequencies.
Figure 84:
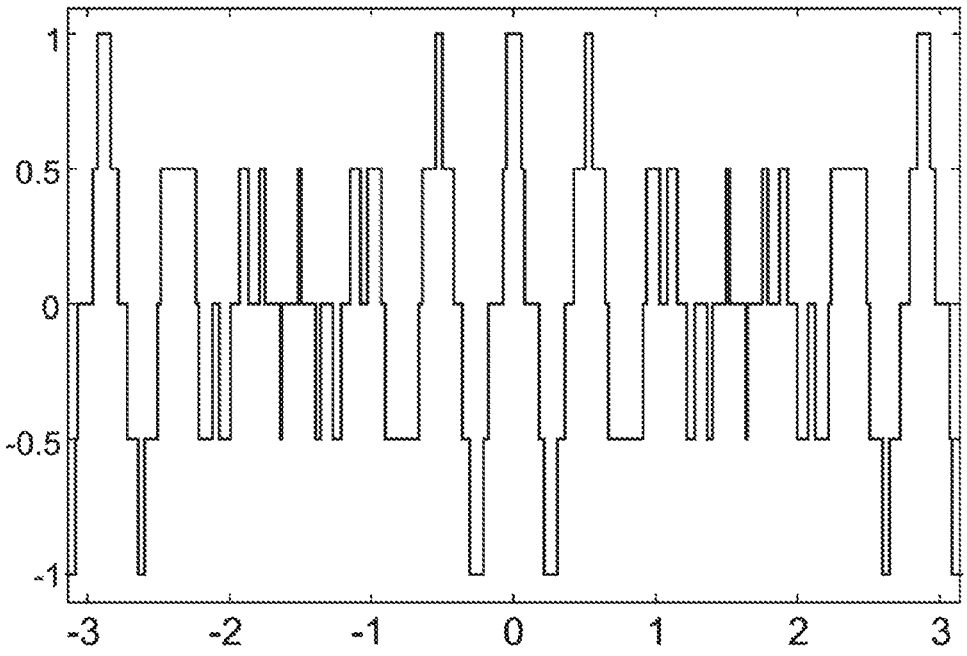
FIG. 84. Sum of two digital waveform signals with slightly different frequencies.

For example the waveform shown in FIG. 81 can be generated using a switching arrangement having three switches. Furthermore several switching arrangements may be combined into a single system, all controlled by a single digital signal generator, thus providing several signals similar to that shown in FIG. 81 having precisely controlled phase relationship to each other, and or defined and controllable frequency or duty cycle. By suitable combination, for example, a high frequency square wave, provided by the digital method, may be modulated in amplitude by a lower frequency square waveform also provided by the digital method. Furthermore, amplitude modulation of the square waveform derived by the digital method may be achieved by harmonic signals superimposed to the high and low voltage levels of a digital switching arrangement. FIGS. 82, 83 and 84 show alternative waveforms. FIG. 82 shows a discrete signal with amplitude modulation as cos(x). FIG. 83 shows two discrete signals with slightly different frequencies. FIG. 84 shows the sum of two signals with slightly different frequencies.

Figure 1:
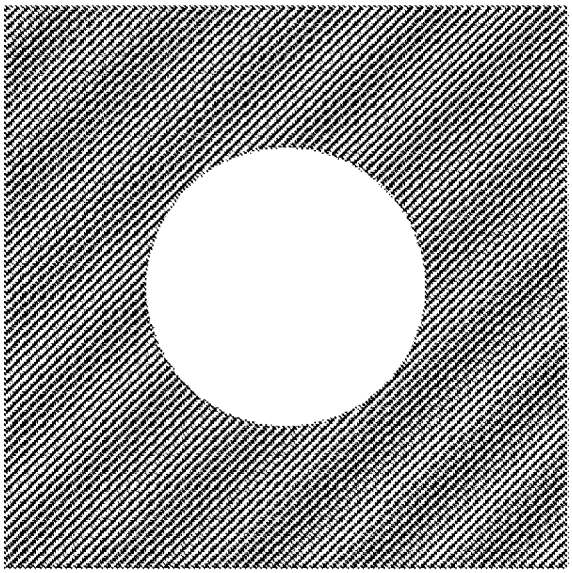
Fig. 1 (Prior Art)
FIG. 1. Single round diaphragm, used as one of possible electrodes in the device according to the U.S. Pat. No. 6,812,453.
Figure 2:
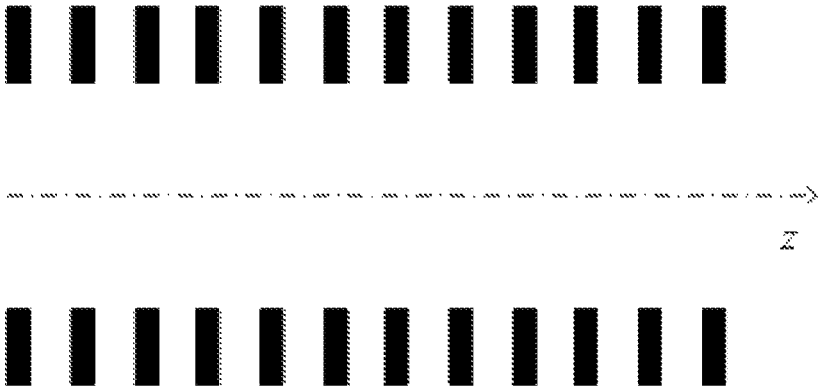
Fig. 2 (Prior Art)
FIG. 2. Possible arrangement of electrodes in the device according to the U.S. Pat. No. 6,812,453. The device contains a system of electrodes, representing a series of plates with coaxial apertures, arranged with provision of internal space between the electrodes, oriented along the longitudinal axis of the device, and intended for transmission of ions within said space.
Figure 3:
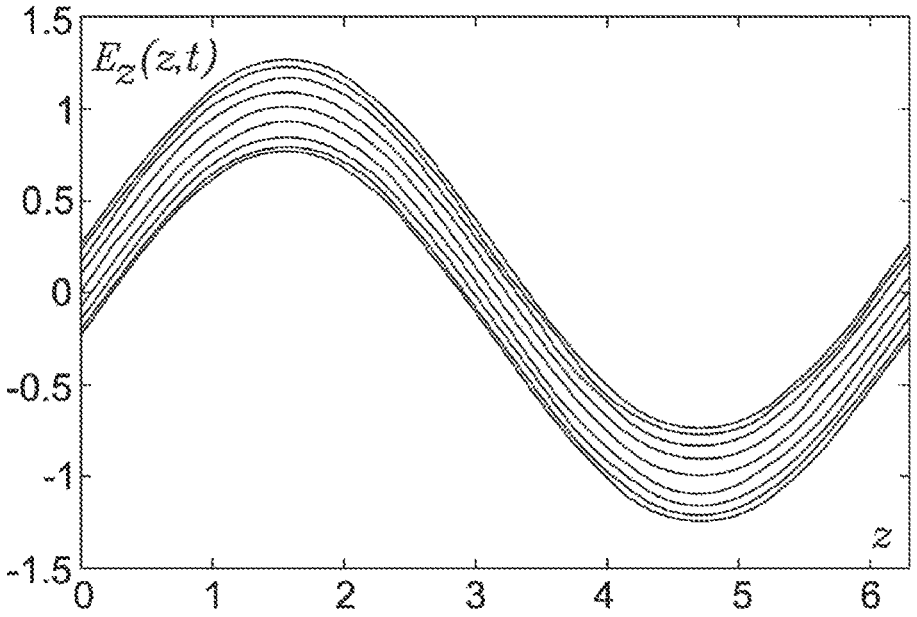
Fig. 3 (Prior Art)
FIG. 3. Possible distribution of the axial component of electric field $E_z(z,t)$ along the channel for charged particle transportation, for a number of closely located points of time t, t+δt, t+2δt, t+3δt, . . . (for the device according to the U.S. Pat. No. 6,812,453).
Figure 4:
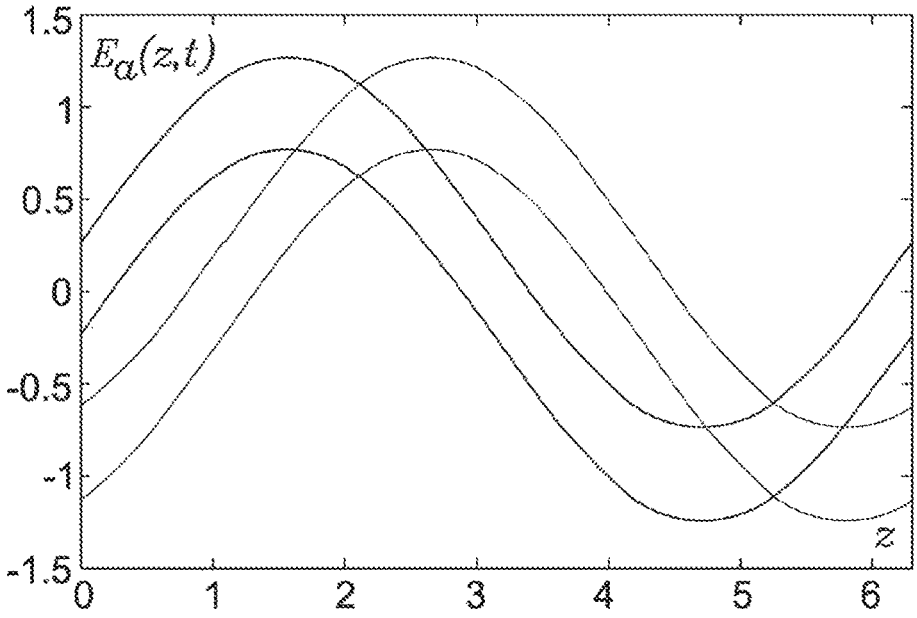
Fig. 4 (Prior Art)
FIG. 4. Possible envelope of the axial component of electric field intensity $E_a(z,t)$ along the transportation channel for several points of time t and t+Δt, Δt>>δt, located remotely enough from each other (for the device according to the U.S. Pat. No. 6,812,453).
Figure 5:
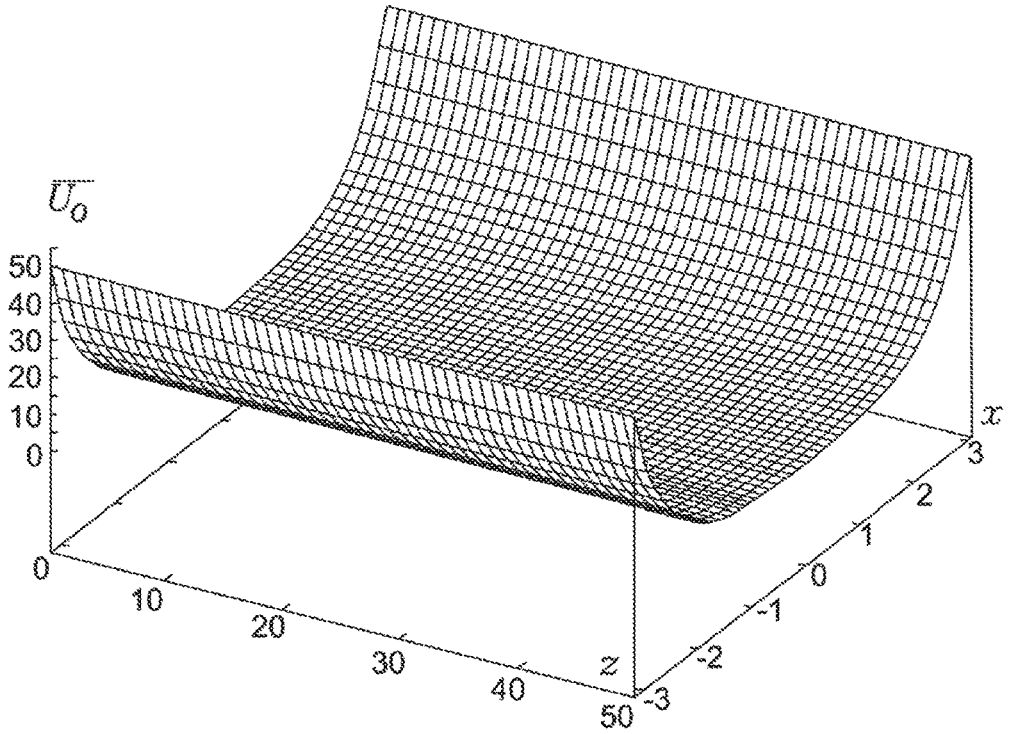
Fig. 5 (Prior Art)
FIG. 5. Possible two-dimensional distribution of the pseudopotential $\overline{U}_0(x,y,z)$ along the length of the channel for charged particle transportation (z-axis) and one of perpendicular directions (x-axis) for the device according to the U.S. Pat. No. 6,812,453.
Figure 6:
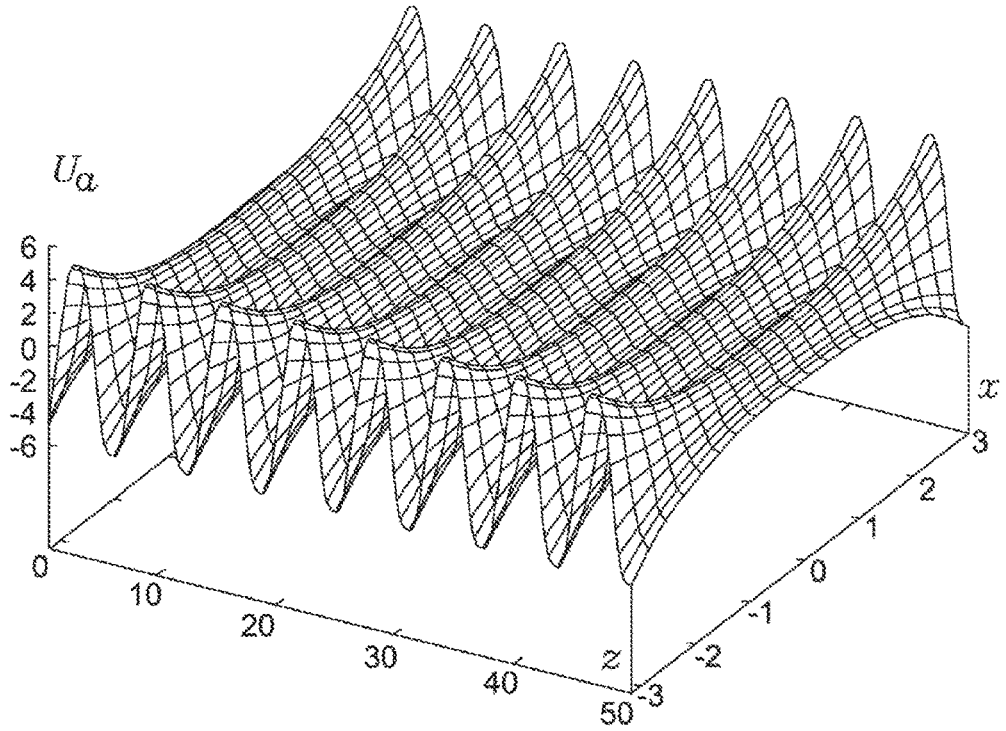
Fig. 6 (Prior Art)
FIG. 6. Possible two-dimensional distribution (at some point of time) of the potential $U_a(x,y,z,t)$ of quasi-static electric field along the length of the channel for charged particle transportation (z-axis) and one of perpendicular directions (x-axis) for the device according to the U.S. Pat. No. 6,812,453.
Figure 7:
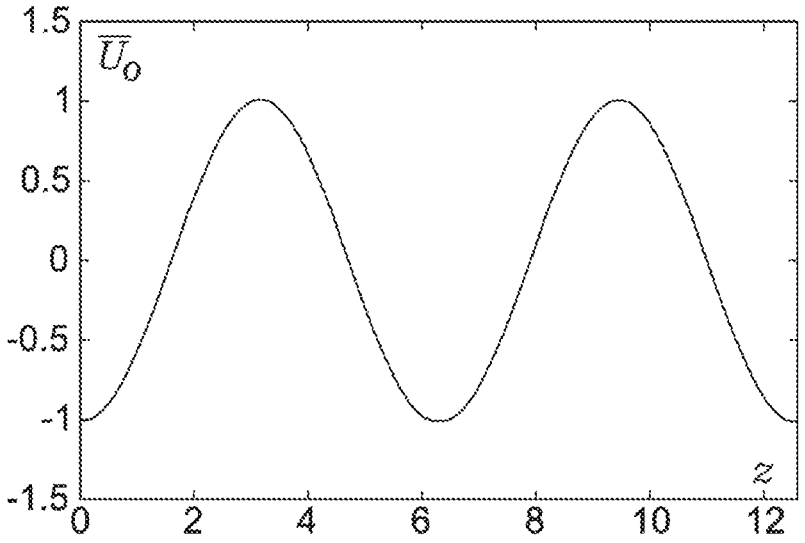
Fig. 7 (Prior Art)
FIG. 7. Possible distribution (at some point of time) of the potential $U_a(z,t)$ of quasi-static electric field, along the axis of the channel for charged particle transportation (z-axis) for the device according to the U.S. Pat. No. 6,812,453.
Figure 8:
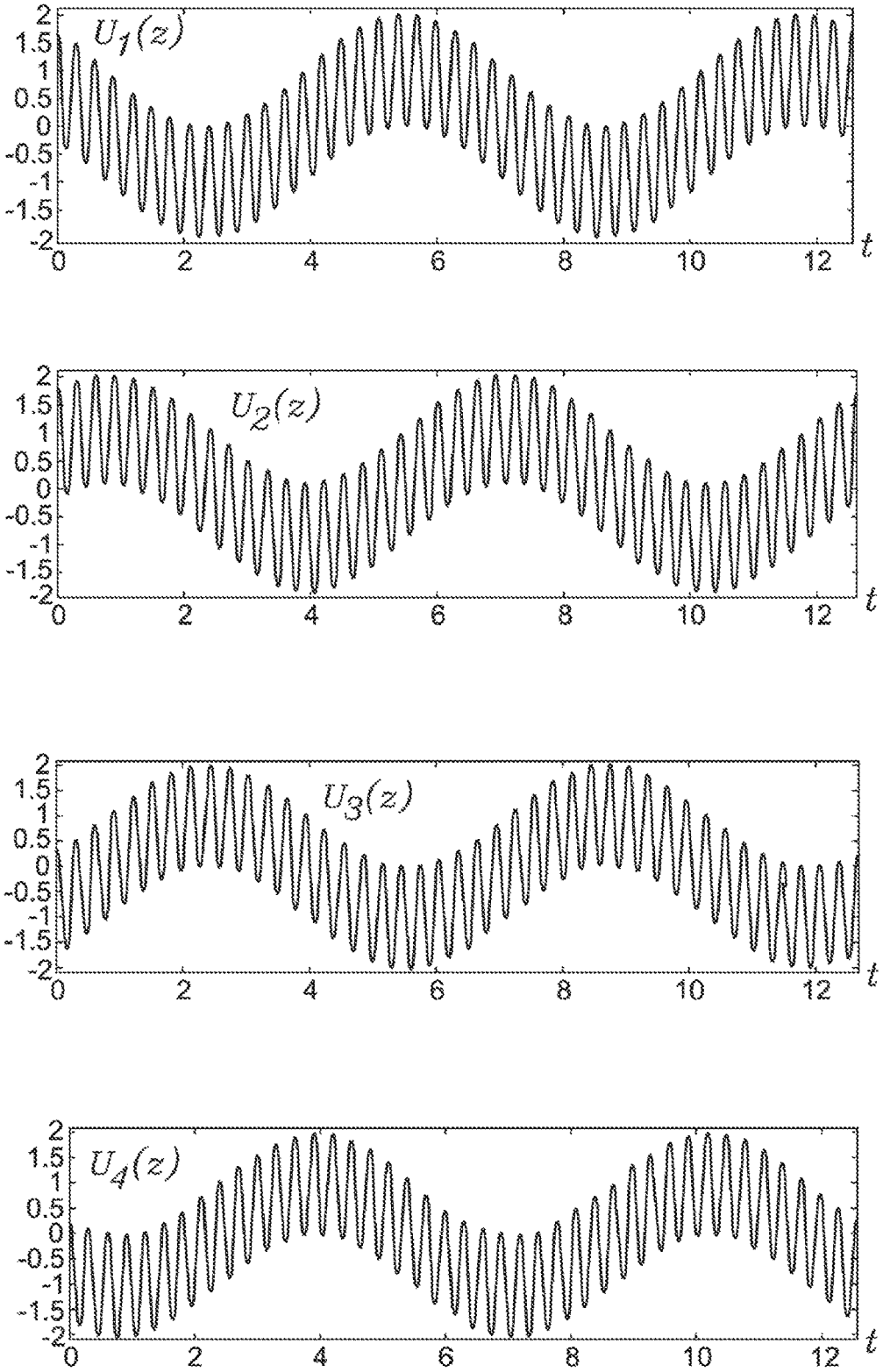
Fig. 8 (Prior Art)
FIG. 8. Possible electric voltages $U_1(t)$, $U_2(t)$, $U_3(t)$, $U_4(t)$ to be applied to the $1^{st}$, $2^{nd}$, $3^{rd}$ and $4^{th}$ electrodes, respectively, in each of repetitive groups of four electrodes, according to the U.S. Pat. No. 6,812,453.
Figure 9:
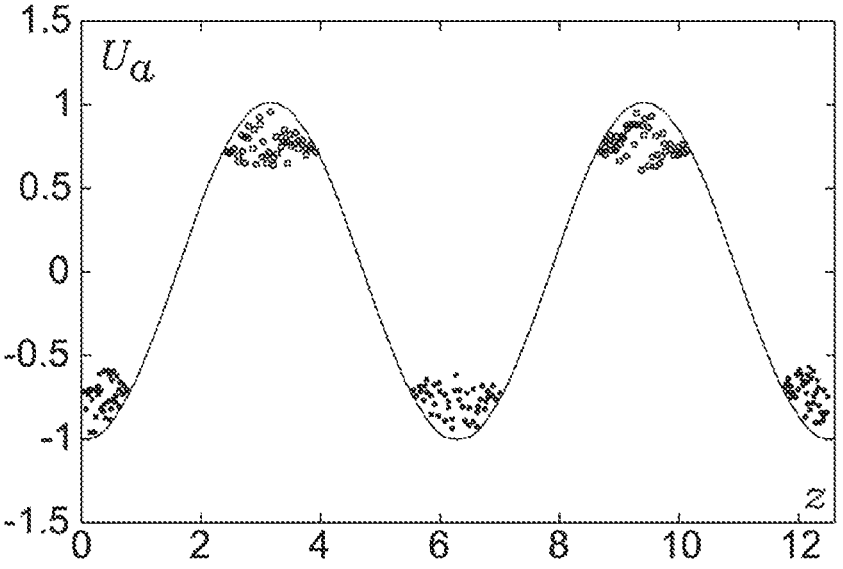
Fig. 9 (Prior Art)
FIG. 9. Capture of negatively charged particles by the maxima of quasi-static potential $U_a(z,t)$ and positively charged particles by the minima of quasi-static potential $U_a(z,t)$ along the channel for charged particle transportation (z-axis).
Figure 10:
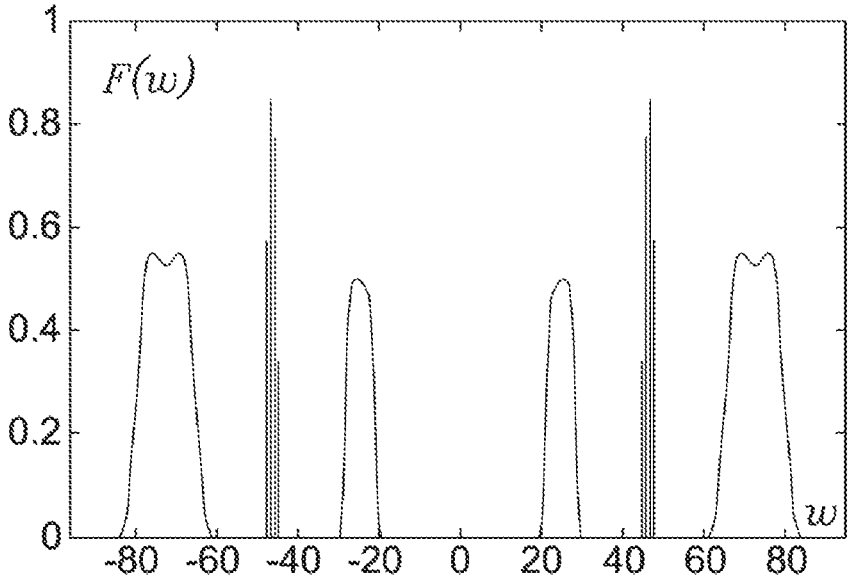
FIG. 10. An example of Fourier spectrum F(ω) for the applied high-frequency voltages f(t), which can be represented in canonical equivalent form as a sum of "fast" harmonics with "slowly" varying amplitudes.
Figure 11:
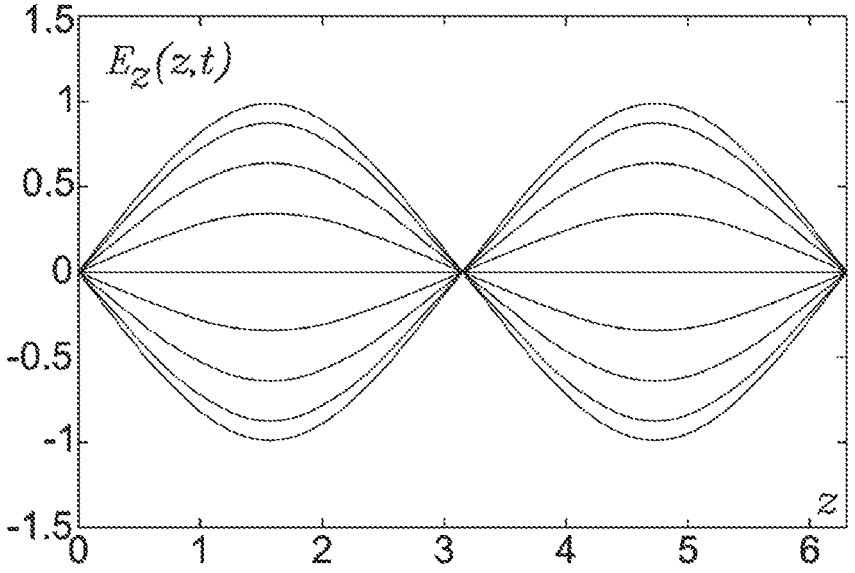
FIG. 11. Possible distribution of the axial component of electric field $E_z(z,t)$ along the axis of the channel for charged particle transportation (z-axis) for a number of closely located points of time t, t+δt, t+2δt, t+3δt, . . . for the device of the present invention.
Figure 12:
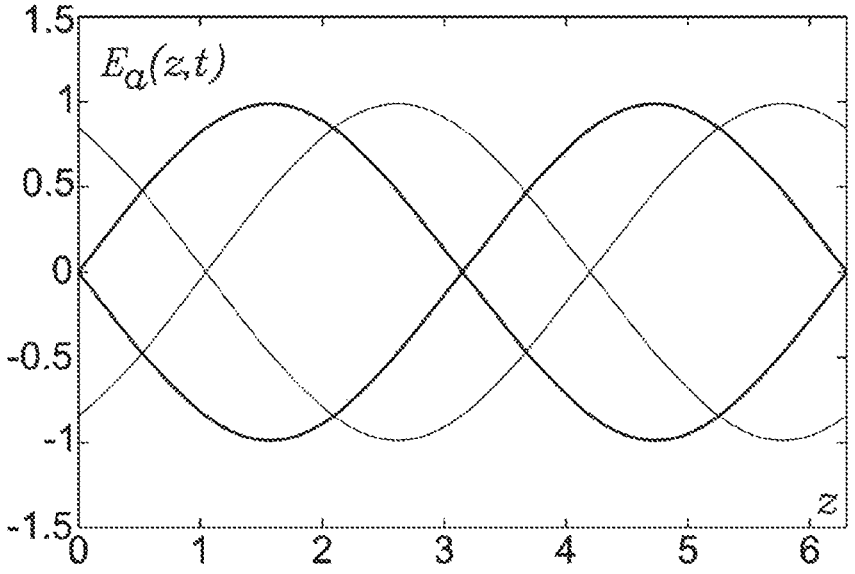
FIG. 12. Possible distribution of envelope of the axial component of electric field intensity $E_a(z,t)$ along the channel (z-axis) for several points of time t and t+Δt (Δt>>δt) located remotely enough from each other, for the device of the present invention.
Figure 13:
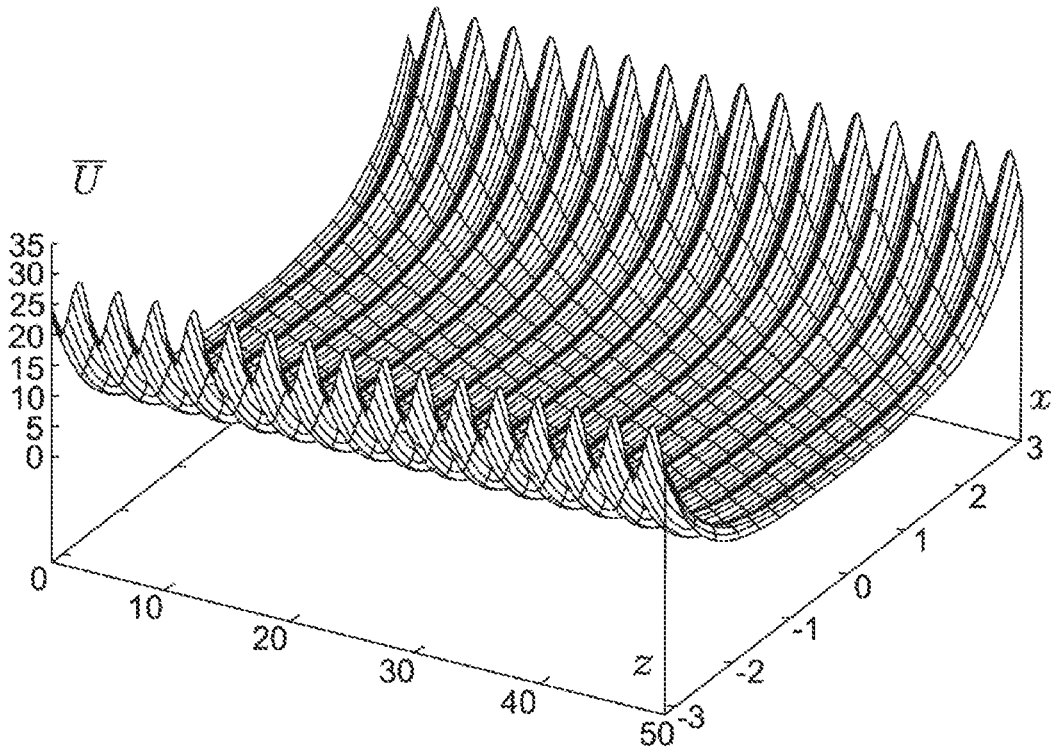
FIG. 13. Possible two-dimensional distribution of the pseudopotential $\overline{U}(x,y,z)$ along the length of the channel for charged particle transportation (z-axis) and one of perpendicular directions (x-axis) for the device of the present invention.
Figure 14:
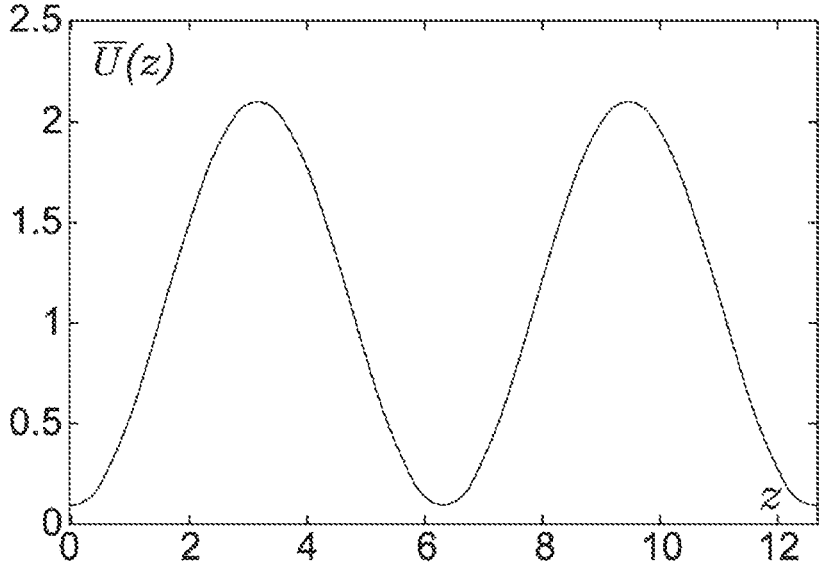
FIG. 14. Possible distribution of the pseudopotential $\overline{U}(z)$ along the channel for charged particle transportation (z-axis) for the device of the present invention.
Figure 15:
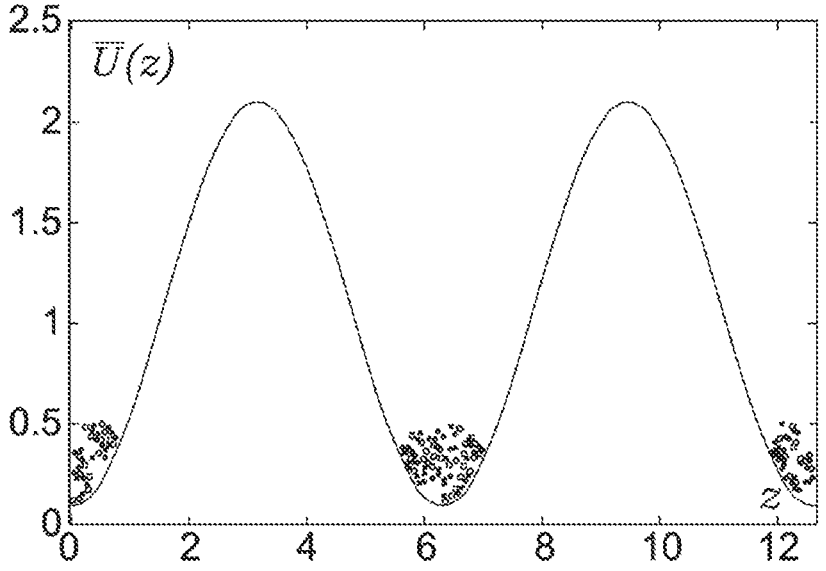
FIG. 15. Capture of negatively and positively charged particles in the locations of the minima of pseudopotential $\overline{U}(z)$, along a segment of z-axis.
Figure 16:
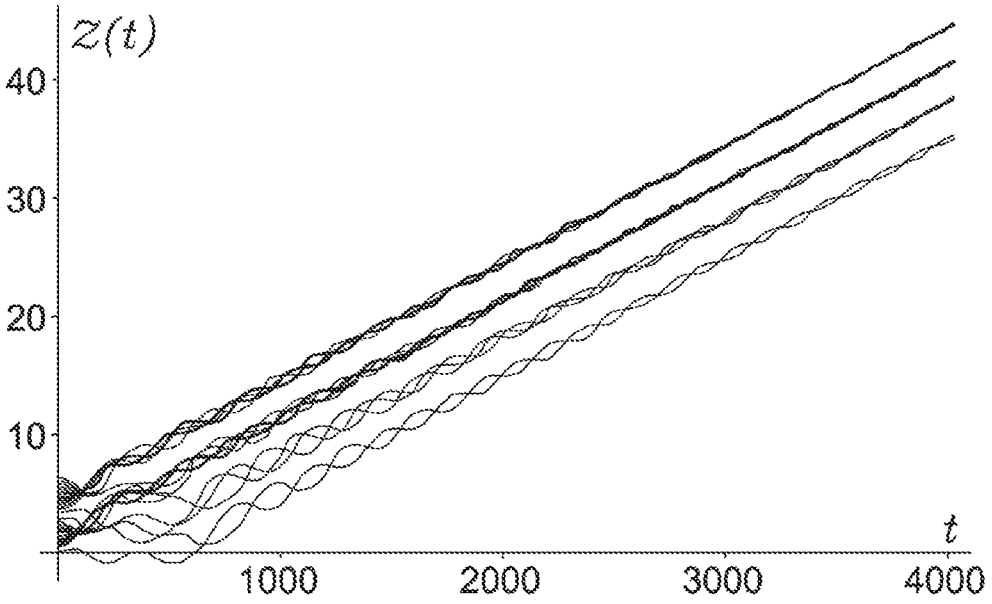
FIG. 16. Dependence of the coordinate z(t) (corresponds to the axis of the device) for ion trajectories, on time t for embodiments of the device of the present invention with axial distribution of electric field $E_z(z,t)=E_0 \cos(z/L-t/T)\cdot\cos(\omega)$.
Figure 17:
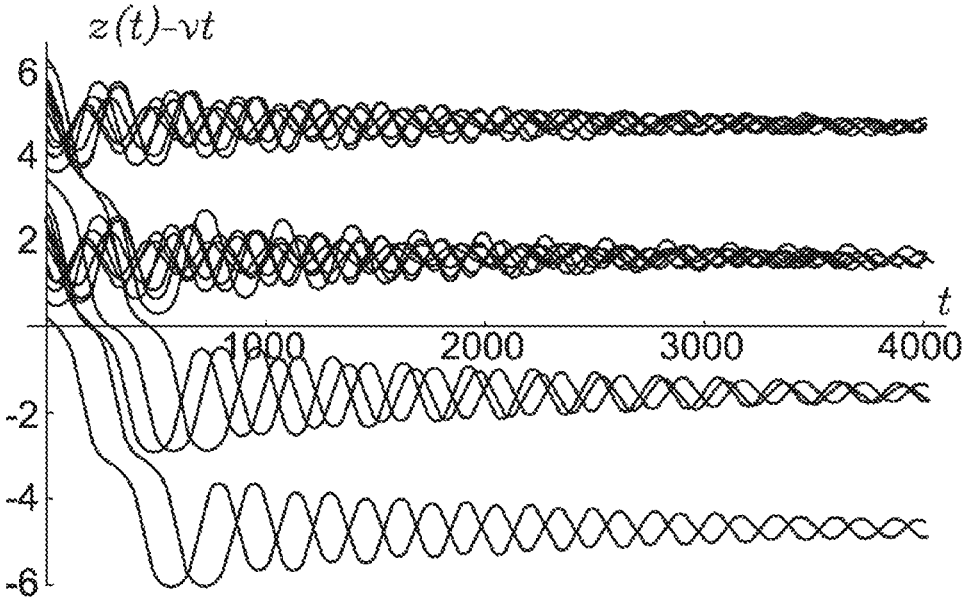
FIG. 17. Dependence of z(t)−vt with respect to time t, where v is the velocity of motion of the minima of the pseudopotential along the channel for charged particle transportation. This dependence demonstrates synchronous motion of ion packets at common average velocity v.
Figure 18:
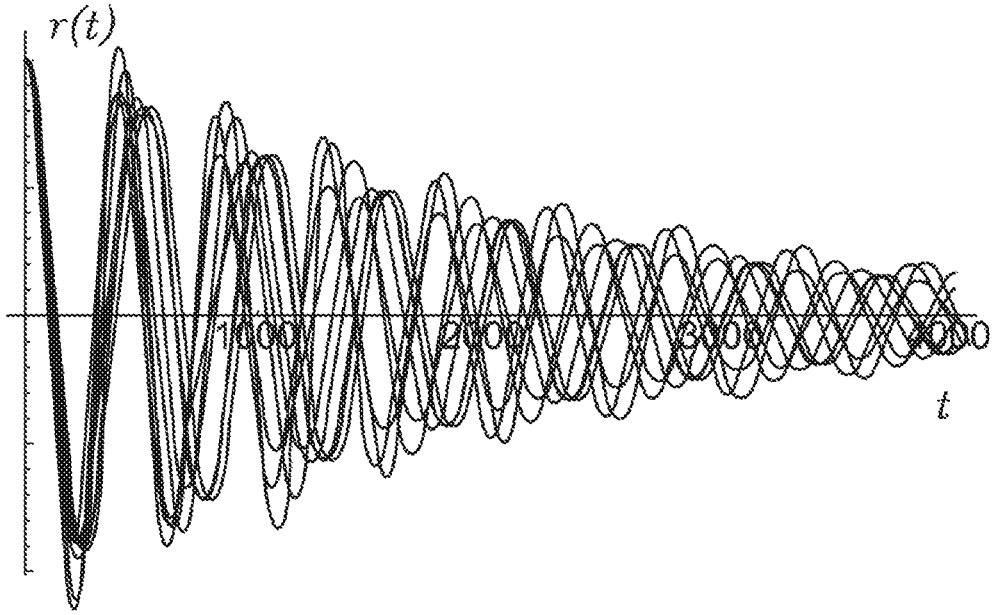
FIG. 18. Dependence of the coordinate r(t) (corresponds to radial direction with respect to the axis of the channel for charged particle transportation), with respect to time t.
Figure 19:
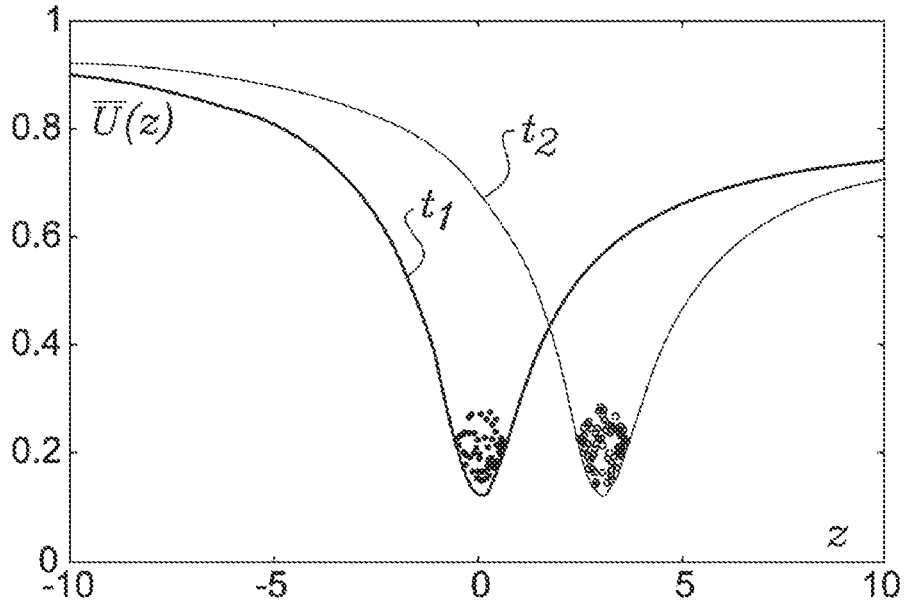
FIG. 19. Tine-synchronised transfer of the packet of charged particles and minima of the pseudopotential $\overline{U}(z)$ along the channel for charged particle transportation (z-axis). The FIG. shows the process of transposition of the minima of pseudopotential for different points of time $t_1$ and $t_2$ ($t_1<t_2$).
Figure 20:
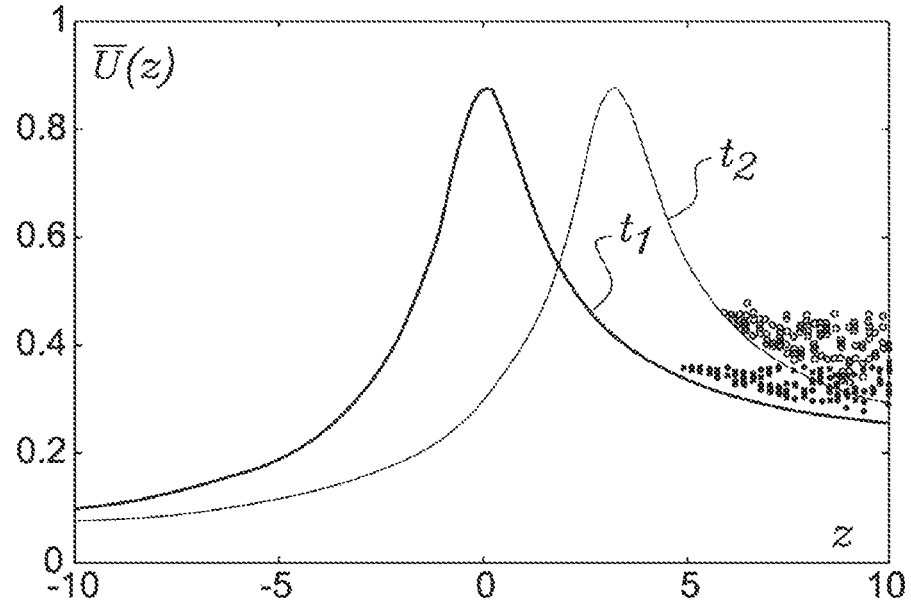
FIG. 20. Charged particles' "bundling out" by a maximum of the pseudopotential $\overline{U}(z)$ along the channel for charged particle transportation (z-axis) with time. FIG. shows the process of transposition of the maximum of pseudopotential for different points of time $t_1$ and $t_2$ ($t_1<t_2$).
Figure 21:
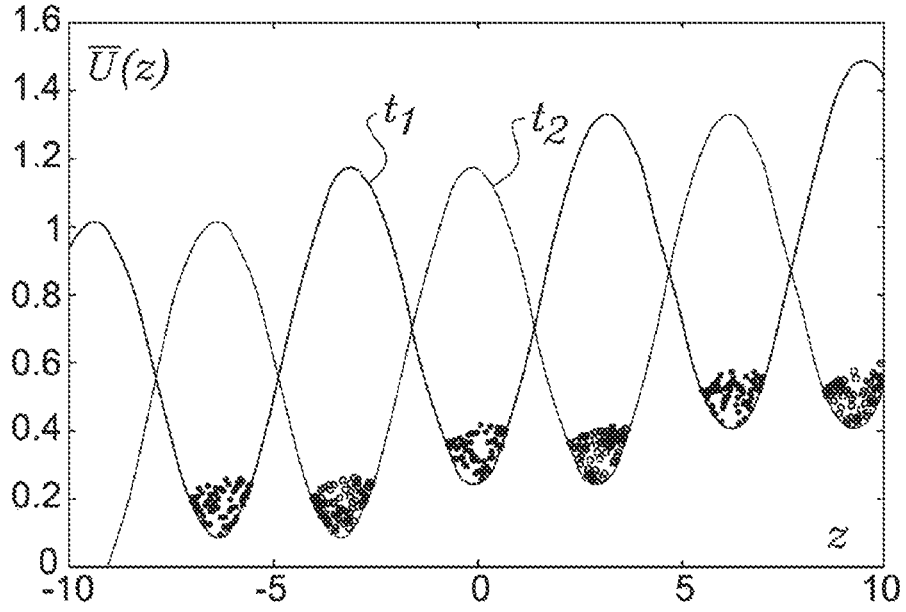
FIG. 21. Breaking-up of an ensemble of charged particles entered the channel for charged particle transportation, into spatially localised, spatially separated packets of charged particles, synchronously transposed from the inlet to the outlet, in case where the pseudopotential $\overline{U}(z)$ has alternating maxima and minima along the channel for charged particle transportation (z-axis). The FIG. shows the process of transposition of maxima and minima of the pseudopotential for different points of time $t_1$ and $t_2(t_1<t_2)$.
Figure 22:
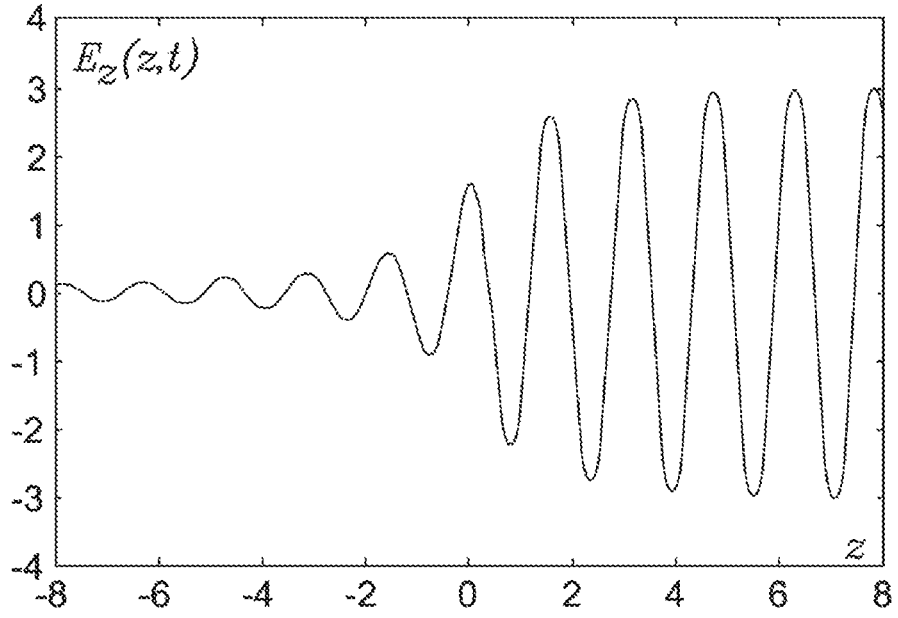
FIG. 22. An example of distribution of high-frequency electric field with non-uniform distribution $E_z(z,t)=E_0(\pi/2+\arctan(z/H))\cdot\cos(z/L-t/T)\cdot\cos(\omega t)$ of the axial component of the electric field along the axis of the device (where $E_0$ is characteristic scale of variation of the amplitude of electric field axial distribution, z is spatial coordinate along the axis of the charged particle transportation channel, H is characteristic spatial scale of "damping" of the oscillations of pseudopotential, L is characteristic spatial scale of single oscillation of the pseudopotential, T is characteristic "slow" time scale for displacement of oscillations of the pseudopotential along the axis of the device, ω is "fast" frequency of high-frequency harmonic oscillations of electric field, where $H>>L$ and $\omega T>>1$).
Figure 23:
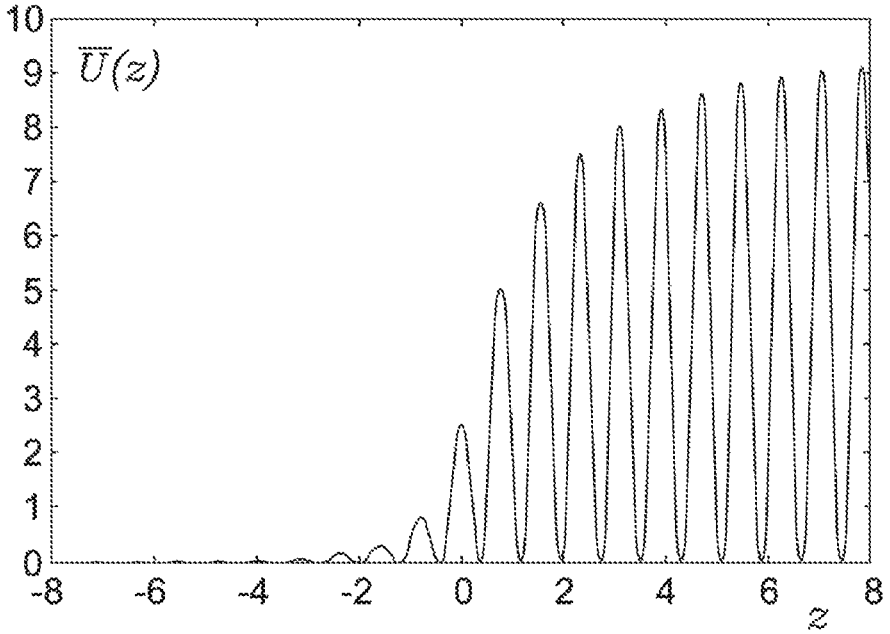
FIG. 23. Distribution of the pseudopotential $\overline{U}(z)$ of high-frequency electric field with axial component shown in FIG. 22, along the channel for charged particle transportation (z-axis). In the course of approach to the point z=0 one can observe monotone increasing maxima of the pseudopotential, which form a growing wave, moving along the axis towards $z=+\infty$. This axial distribution of electric field forms a zone of stable accumulation of particles for $-\infty<z<-2H$, the zone of stable movement of charged particles for $+2H<z<+\infty$, and transition region for $-2H<z<+2H$.
Figure 24:
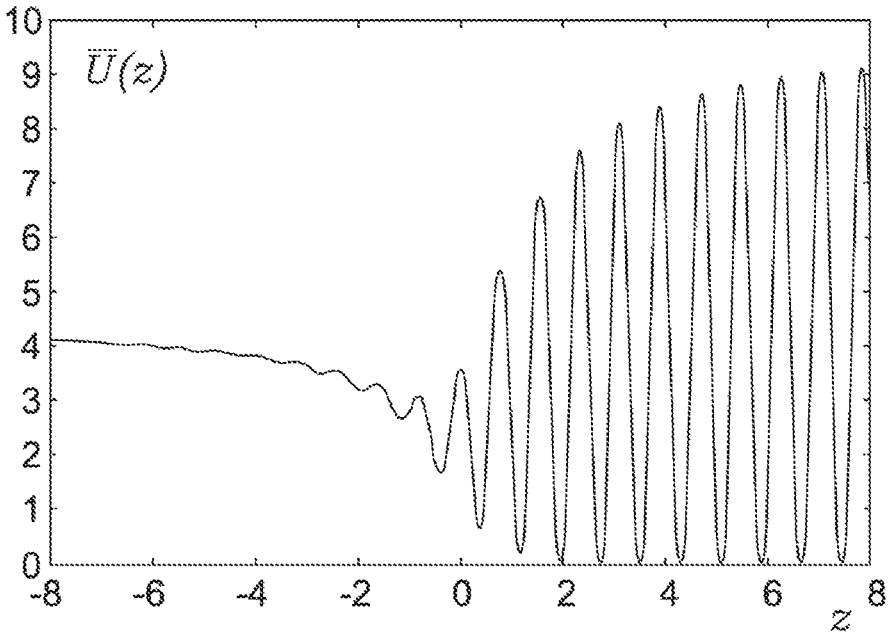
FIG. 24. An example of pseudopotential $\overline{U}(z)$ for high-frequency field obtained from FIG. 22 by addition of high-frequency field, with the following axial field distribution: $E_z(z,t)=0.45E_0(z/2-\arctan(z/H))\cdot\sin(\omega t)$. As a result of superposition of the specified high-frequency fields in the transition region between the zone of accumulation of charged particles and the zone of evacuation of charged particles, a segment of pseudopotential $\overline{U}(z)$ is obtained, with monotone decreasing minima, enhancing the efficiency of capture and evacuation of both positively and negatively charged particles.
Figure 25:
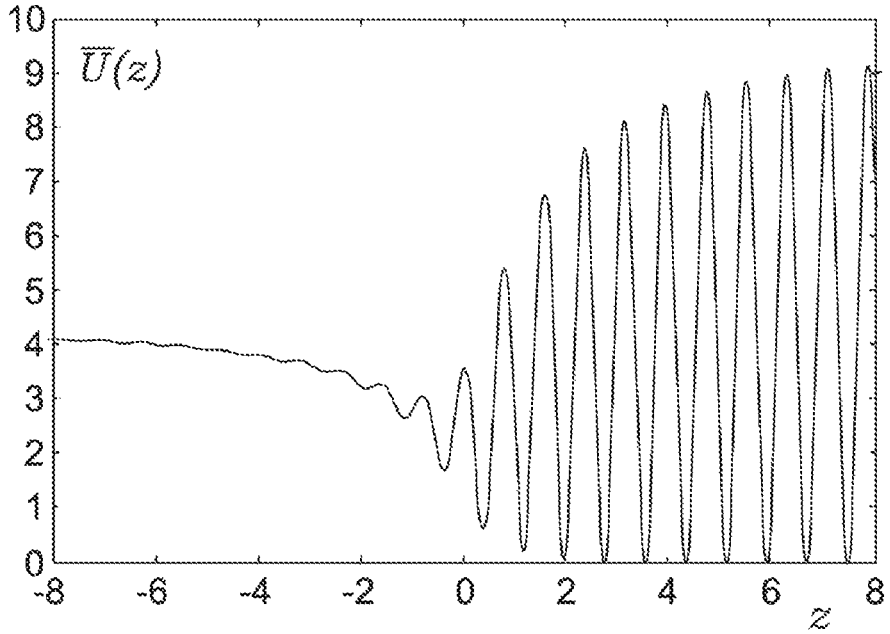
FIG. 25. An example of potential function for positively charged particles, which corresponds to superposition of DC electric field with axial distribution of potential $U(z)=U_0(\pi/2-\arctan(z/H))^2$ on the axis of the channel for charged particle transportation, and high-frequency electric field as shown in FIG. 22. The graph of potential function identically coincides with the graph of the pseudopotential as shown in FIG. 24. In the transition region between the zone of accumulation of charged particles and the zone of evacuation of charged particles, a segment with monotone decreasing maxima and minima is available, enhancing the efficiency of capture and evacuation of positively charged particles.
Figure 26:
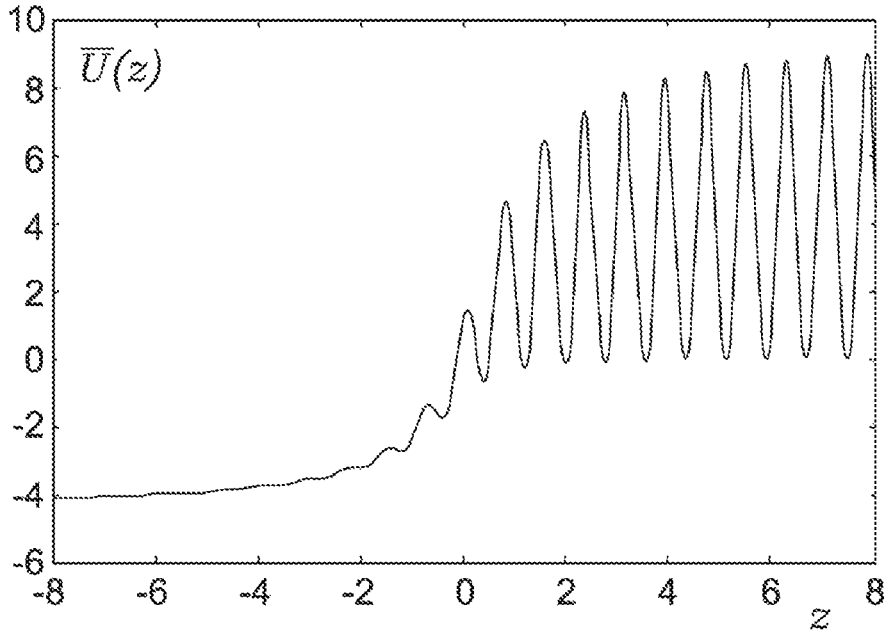
FIG. 26. An example of potential function for negatively charged particles, which corresponds to superposition of DC electric field, and high-frequency electric field as shown in FIG. 25. The graph shows that in the transition region between the zone of accumulation of charged particles and the zone of evacuation of charged particles, a segment with monotone growing maxima and minima is available, decreasing the efficiency of capture and evacuation of negatively charged particles.
Figure 27:
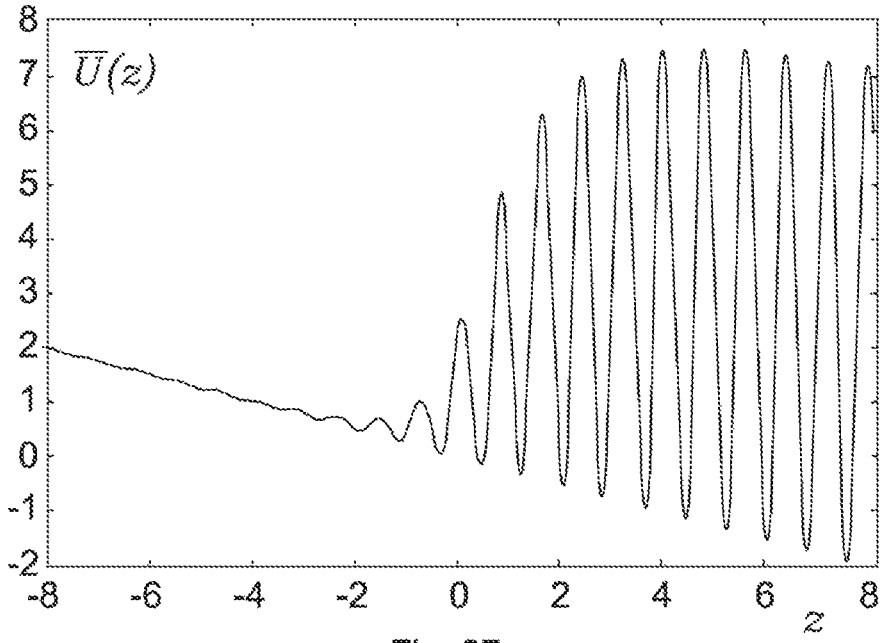
FIG. 27. An example of potential function for positively charged particles, corresponding to superposition of high-frequency electric field as sown in FIG. 22, and DC uniform electric field. The graph shows that such a superposition of electric fields forms transition region, enhancing the efficiency of capture and evacuation of positively charged particles.
Figure 28:
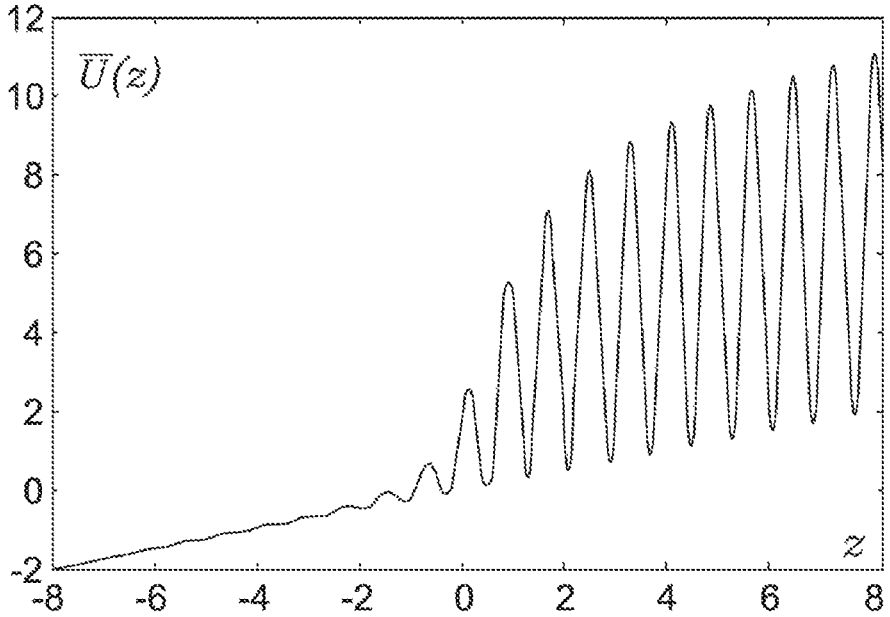
FIG. 28. An example of potential function for negatively charged particles, corresponding to superposition of high-frequency electric field as sown in FIG. 22, and DC uniform electric field. The graph shows that such a superposition of electric fields forms transition region, decreasing the efficiency of capture and evacuation of negatively charged particles.
Figure 29:
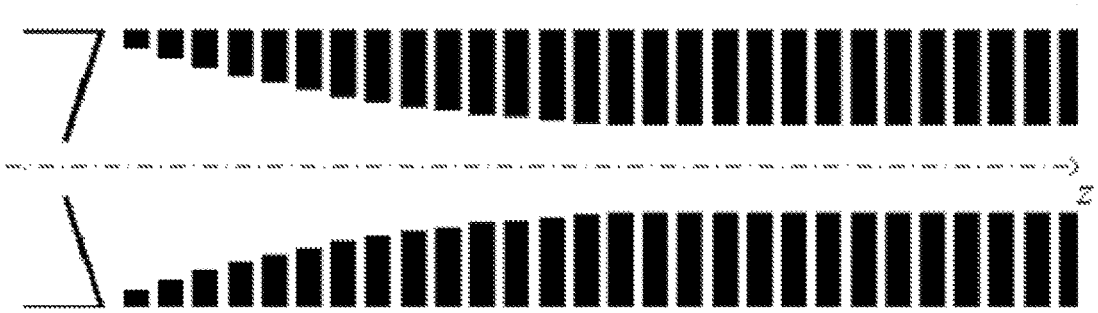
FIG. 29. Structure of electrodes, capable of generating a field for coupling the zone of storage and regular evacuation of discrete packets of charged particles from the edge of the zone.
Figure 30:
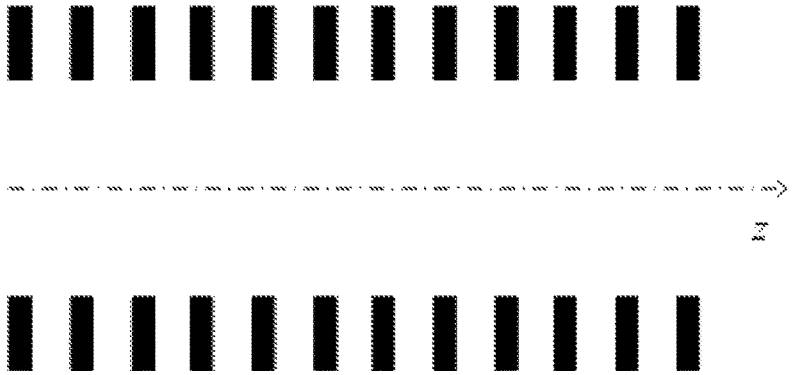
FIG. 30. An example of rectilinear channel for charged particle transportation.
Figure 31:
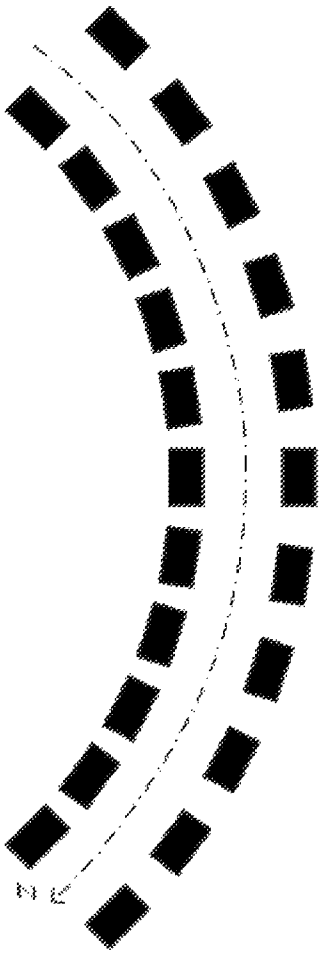
FIG. 31. An example of curvilinear channel for charged particle transportation.
Figure 32:
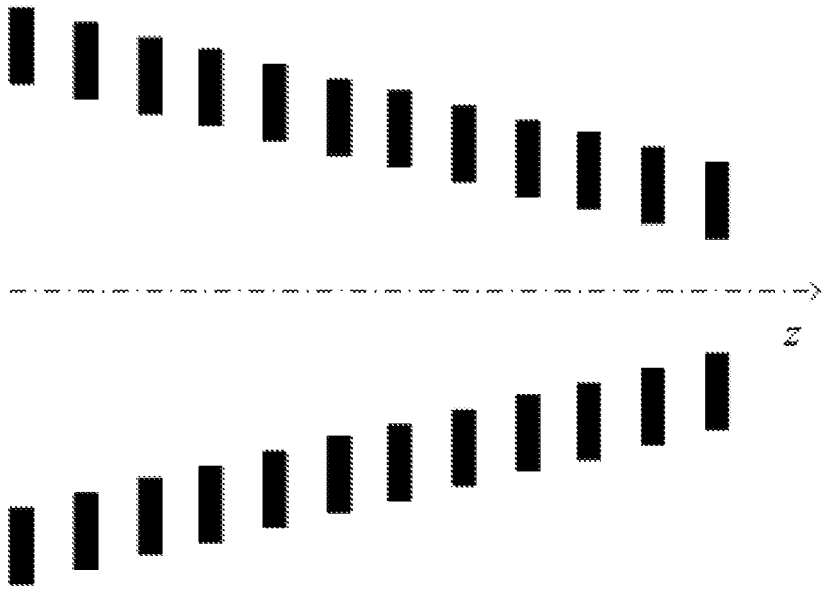
FIG. 32. Particular case of variable profile of the for charged particle transportation, having configuration of funnel.
Figure 33:
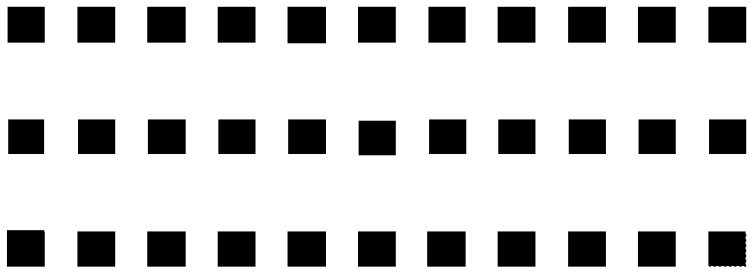
FIG. 33. An example of channel for charged particle transportation, formed by single diaphragms shown in FIG. 34 or FIG. 35, the central part of which contains additional electrodes in the cross-section.
Figure 34:
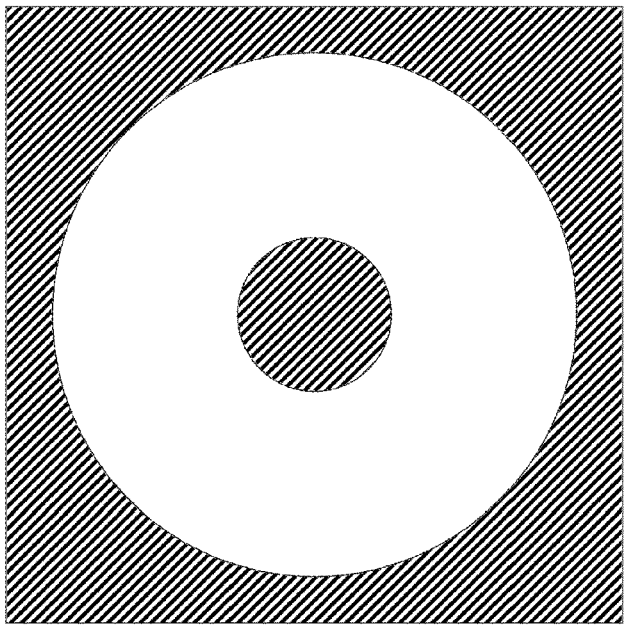
FIG. 34. An example of single diaphragm, the central part of which contains additional electrode in the cross-section.
Figure 35:
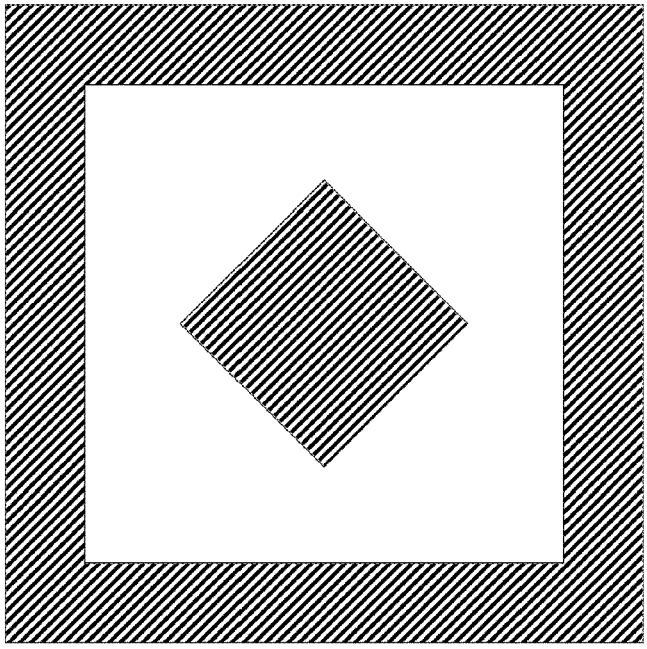
FIG. 35. An example of single diaphragm with the central part, wherein a number of uncoupled areas of capture of charged particles, and respectively, a number of independent parallel channels for charged particle transportation.
Figure 36:
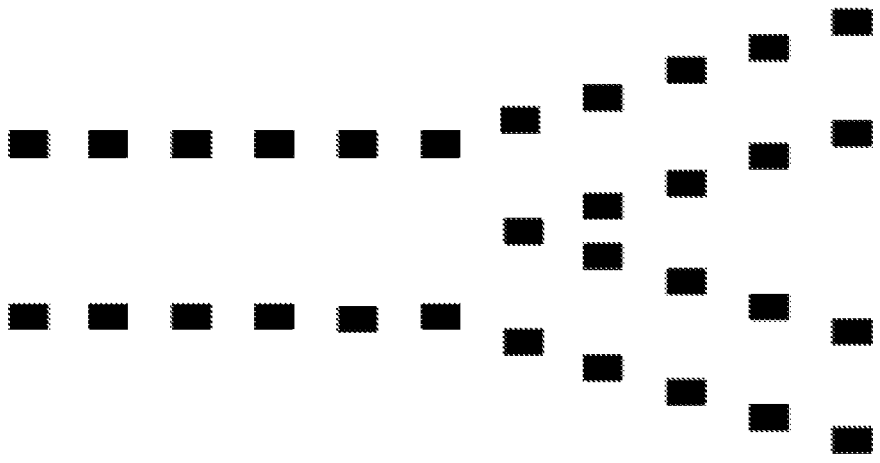
FIG. 36. An example of channel for charged particle transportation, with splitting into several parallel (daughter) channels. In this case, each channel can be adjusted to transport a well-defined mass range, "drawn" from the common transportation.
Figure 37:
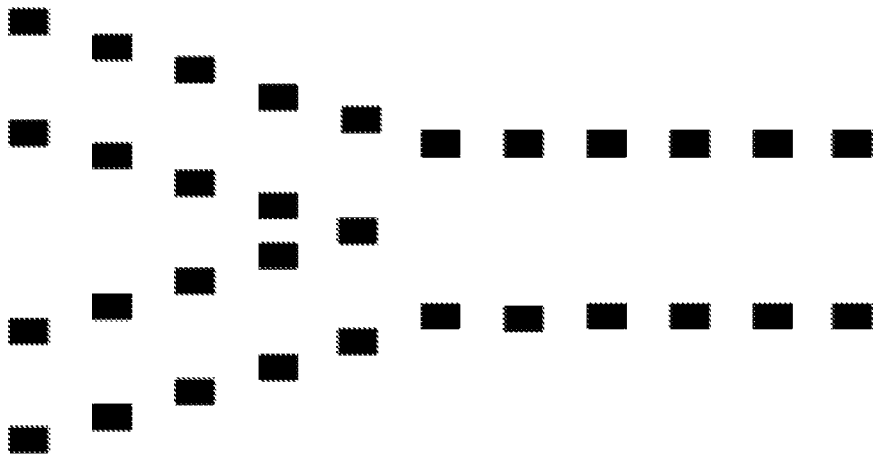
FIG. 37. An example of integration of several (daughter) channels for charged particle transportation, to form a single channel. In this case, dynamic switching between different sources of charged particles and/or mixing of different beams of charged particles into an integrated beam of charged particles can be implemented.
Figure 38:
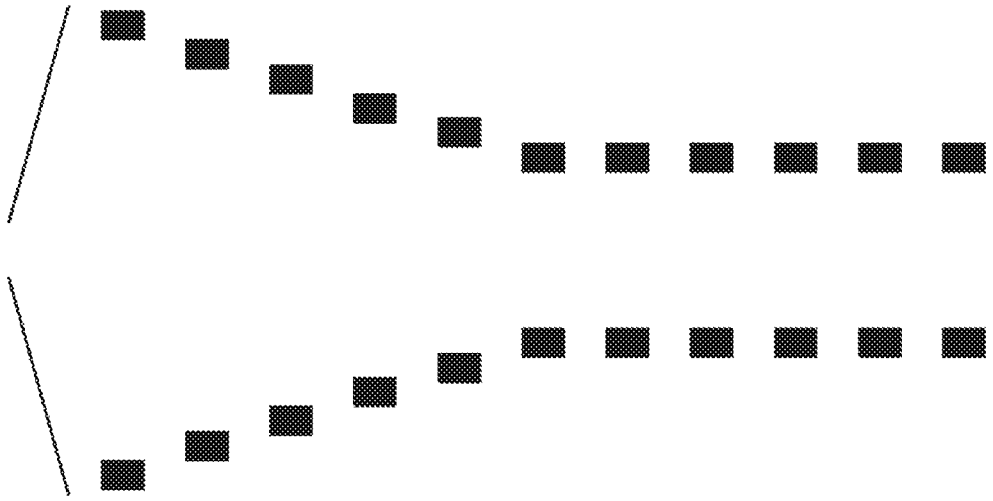
FIG. 38. An example of channel for charged particle transportation, where the channel's structure contains an area performing the function of storage volume for charged particles.
Figure 39:
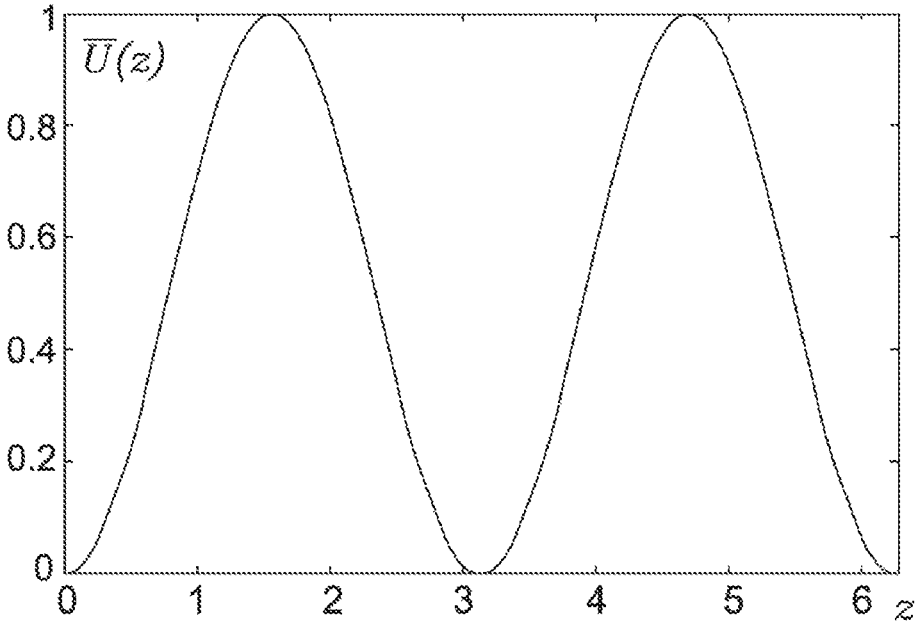
FIG. 39. An example of distribution of the pseudopotential $\overline{U}(z)$ along the channel for charged particle transportation (z-axis), having alternating maxima and minima, travelling along the channel for charged particle transportation. This pseudopotential corresponds to axial distribution of high-frequency electric field according to the law: $E_z(z,t)=(U_0/L)\cos(z/L-t/T)\cdot\cos(\omega t)$.
Figure 40:
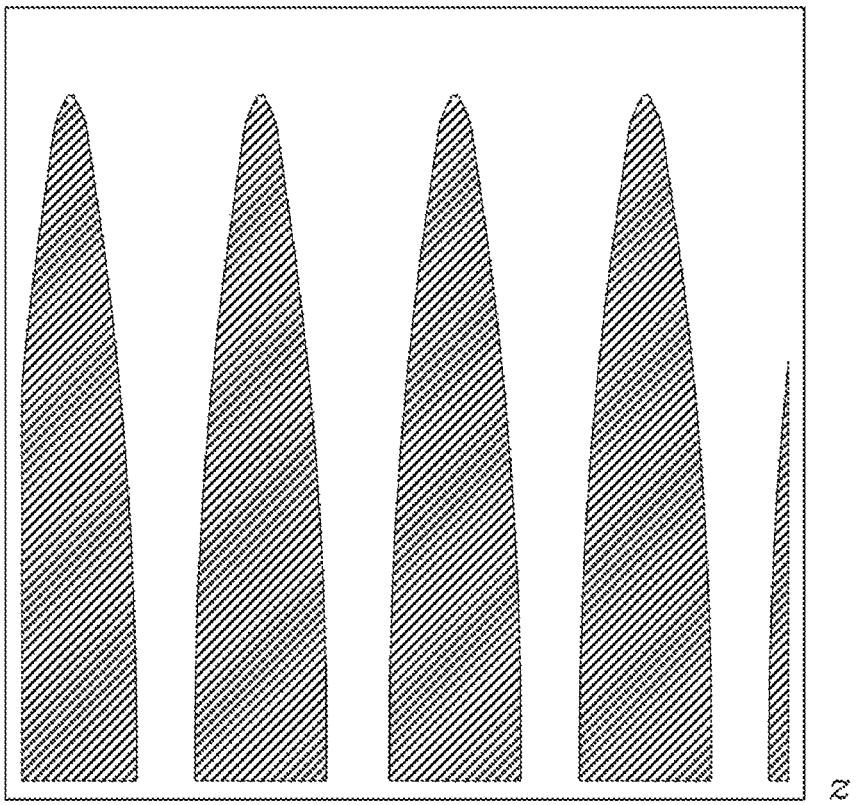
FIG. 40. Distribution of the areas of capture of charged particles along the channel for charged particle transportation (z-axis), corresponding to pseudopotential $\overline{U}(z)$, shown in FIG. 39.
Figure 41:
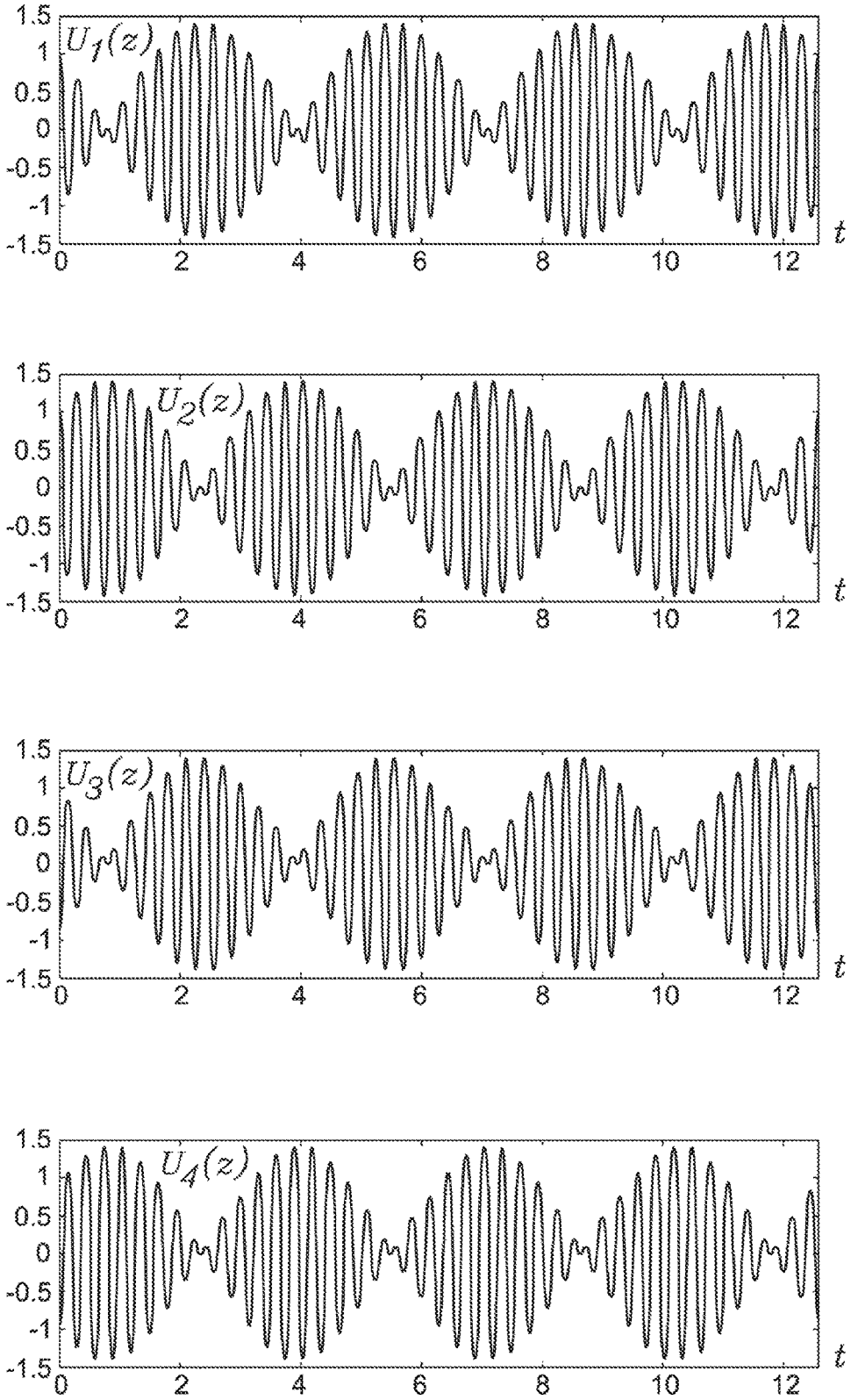
FIG. 41. Voltages $U_1(t)$, $U_2(t)$, $U_3(t)$, $U_4(t)$ applied to the $1^{st}$, $2^{nd}$, $3^{rd}$ and $4^{th}$ electrodes, respectively, in each group of four electrodes-diaphragms, for creation of high-frequency electric field with pseudopotential, as shown in FIG. 39.
Figure 42:
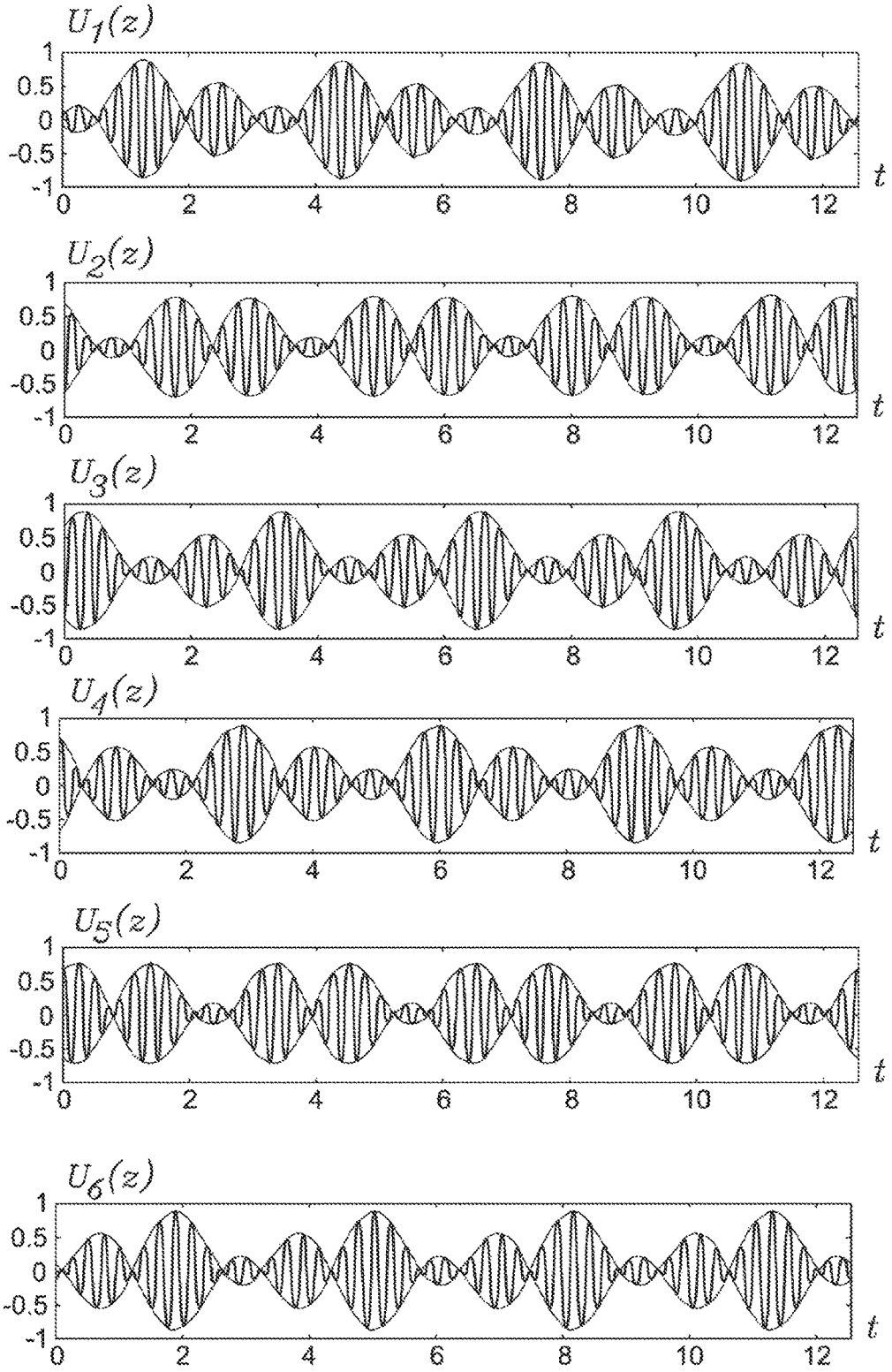
FIG. 42. Electric voltages $U_1(t)$, $U_2(t)$, $U_3(t)$, $U_4(t)$, $U_5(t)$, $U_6(t)$, which are required to be applied to repetitive groups of six electrodes-diaphragms for creation of high-frequency electric field, having axial distribution of pseudopotential in the form of $\overline{U}(z,t)=U_*[1-\cos(z/L-t/T)]^3$.
Figure 43:
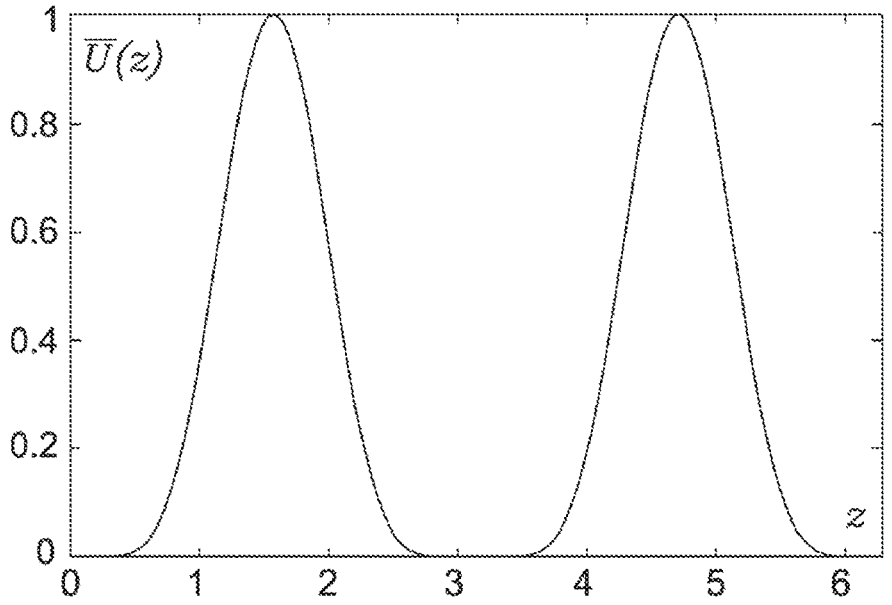
FIG. 43. Distribution of the pseudopotential $\overline{U}(z,t)=U_*[1-\cos(z/L-t/T)]^3$ along the channel for charged particle transportation (z-axis), corresponding to high-frequency electric field, generated by the voltages applied to the electrodes of the device shown in FIG. 42.
Figure 44:
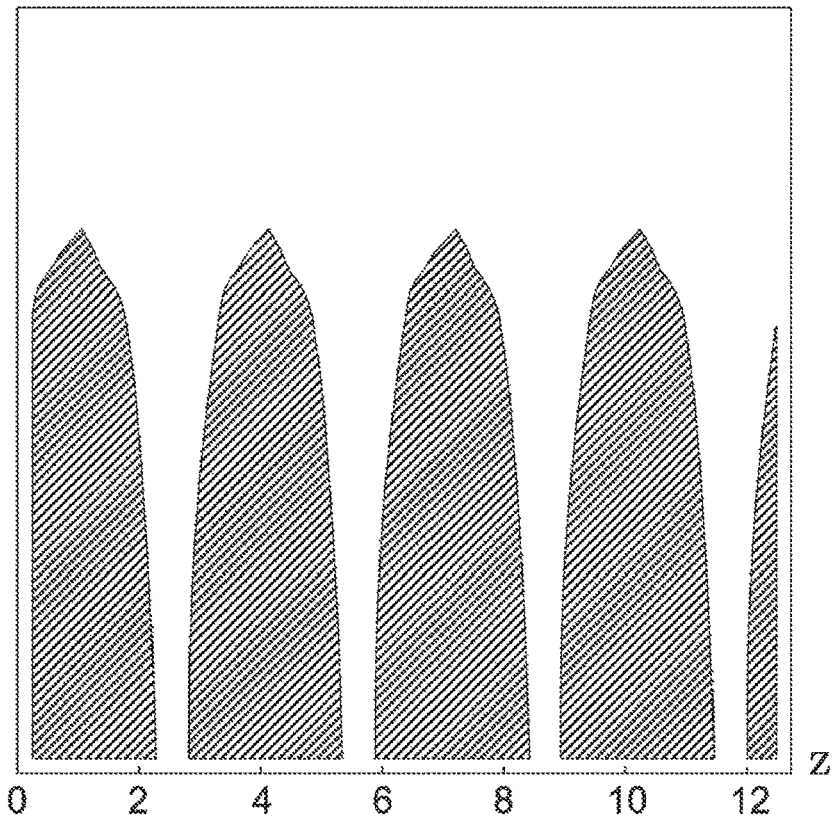
FIG. 44. Areas of capture of charged particles, corresponding to the pseudopotential $\overline{U}(z,t)=U_*[1-\cos(z/L-t/T)]^3$ along the channel for charged particle transportation (z-axis).
Figure 45:
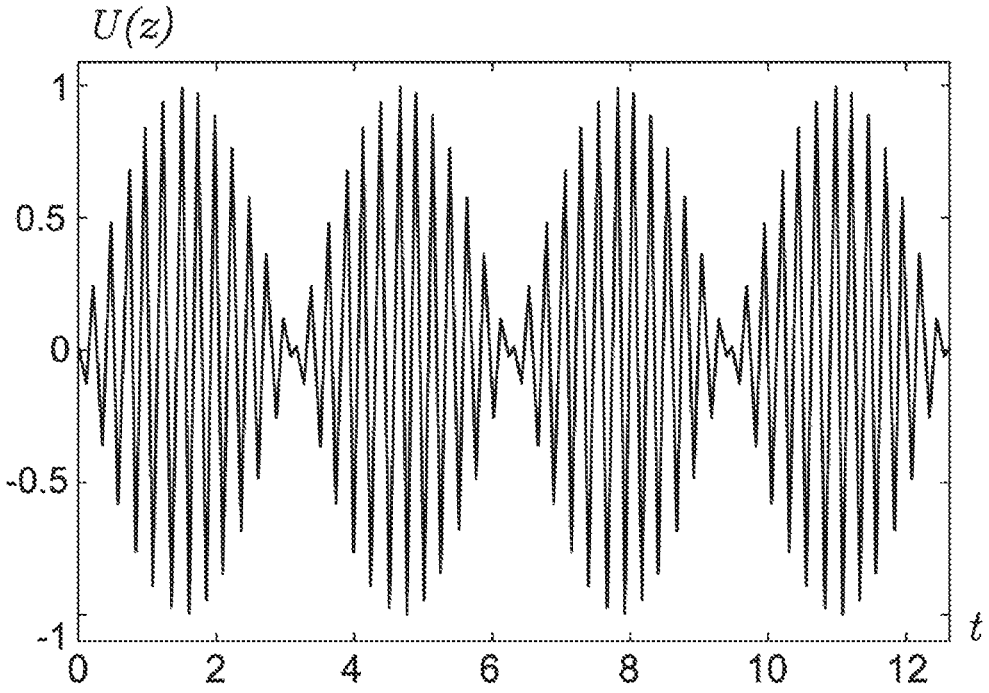
FIG. 45. An example of high-frequency voltage U(t), generated with the help of amplitude modulation of the voltage cos(ωt) using the function sin (t/T).
Figure 46:
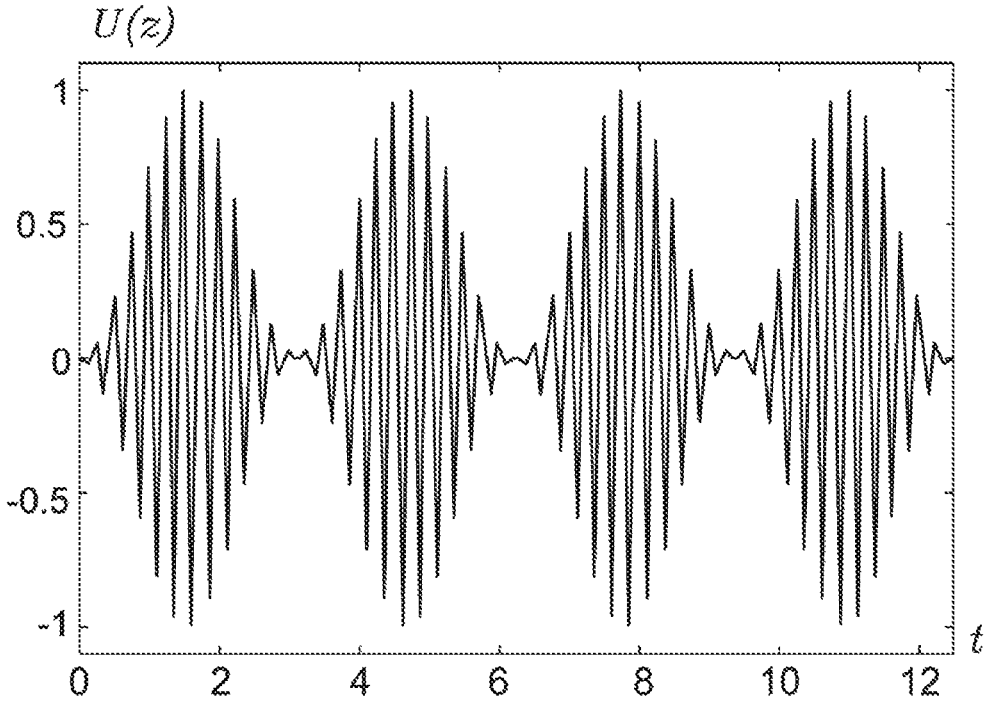
FIG. 46. An example of high-frequency voltage U(t), generated with the help of amplitude modulation of the voltage cos(ωt) using the function $\sin^2(t/T)=(1-\cos(2t/T))/2$.
Figure 47:
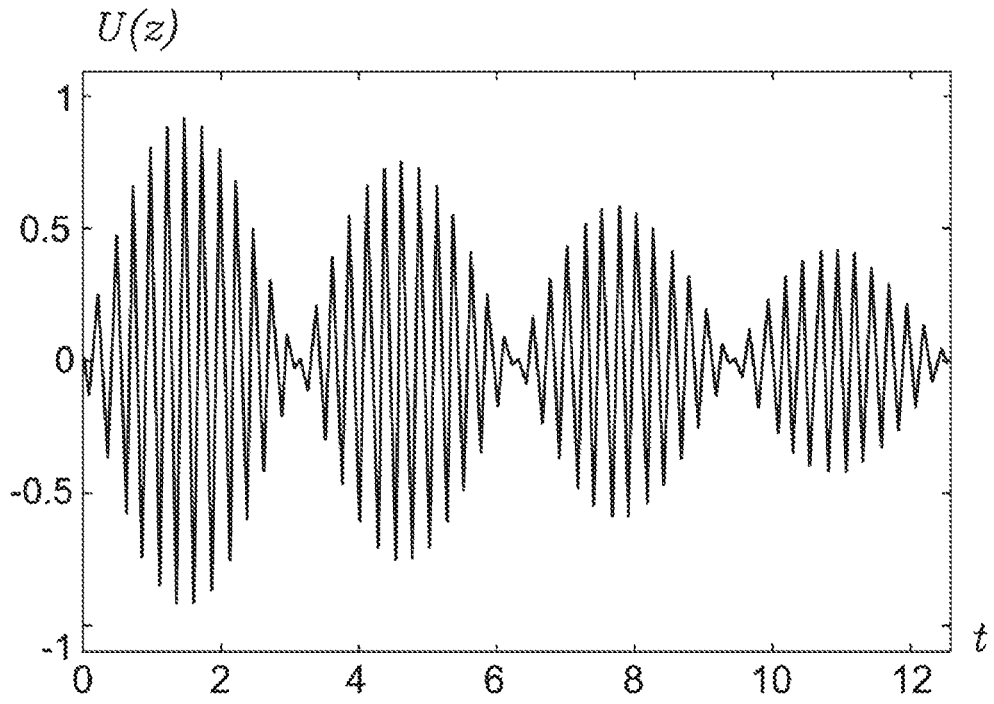
FIG. 47. An example of high-frequency voltage U(t), generated with the help of amplitude modulation of the voltage cos(ωt) using the function (1−γt/T)sin(t/T).
Figure 48:
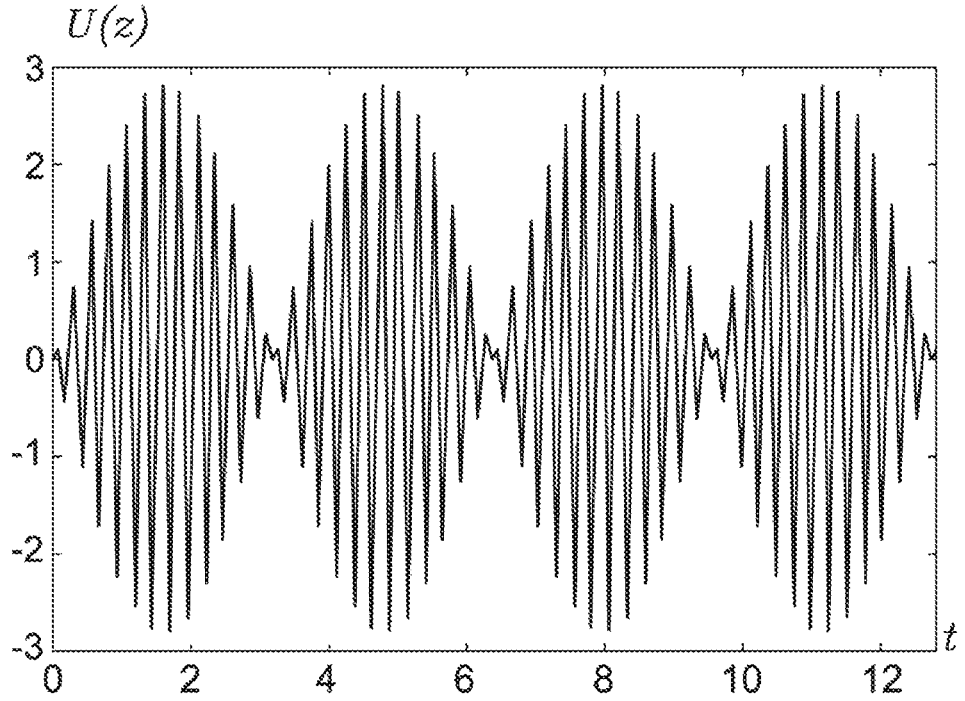
FIG. 48. An example of high-frequency voltage U(t) as a sum of four high-frequency voltages having different frequencies sin((ω+1/T)t)−sin((ω−1/T)t)+cos((ω+1/T)t)+cos((ω−1/T)t), phase-shifted for π/4.
Figure 49:
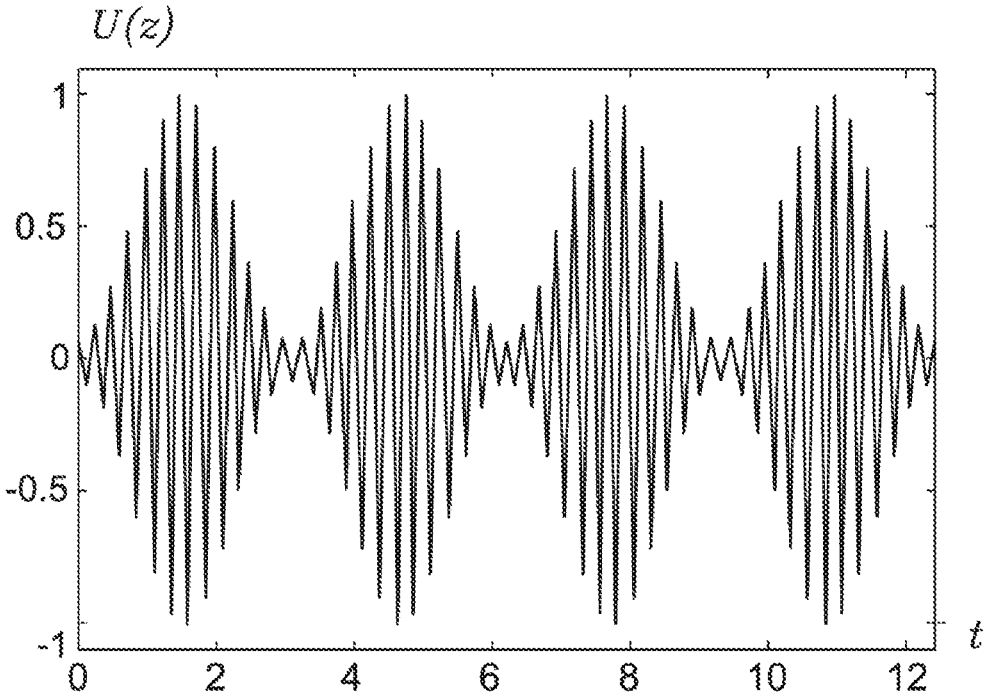
FIG. 49. An example of high-frequency voltage U(t) as a superposition of phase-modulated high-frequency voltages, defined by the formula: cos(ωt+cos(t/T))+cos(ωt−cos(t/T))−cos(ωt).
Figure 50:
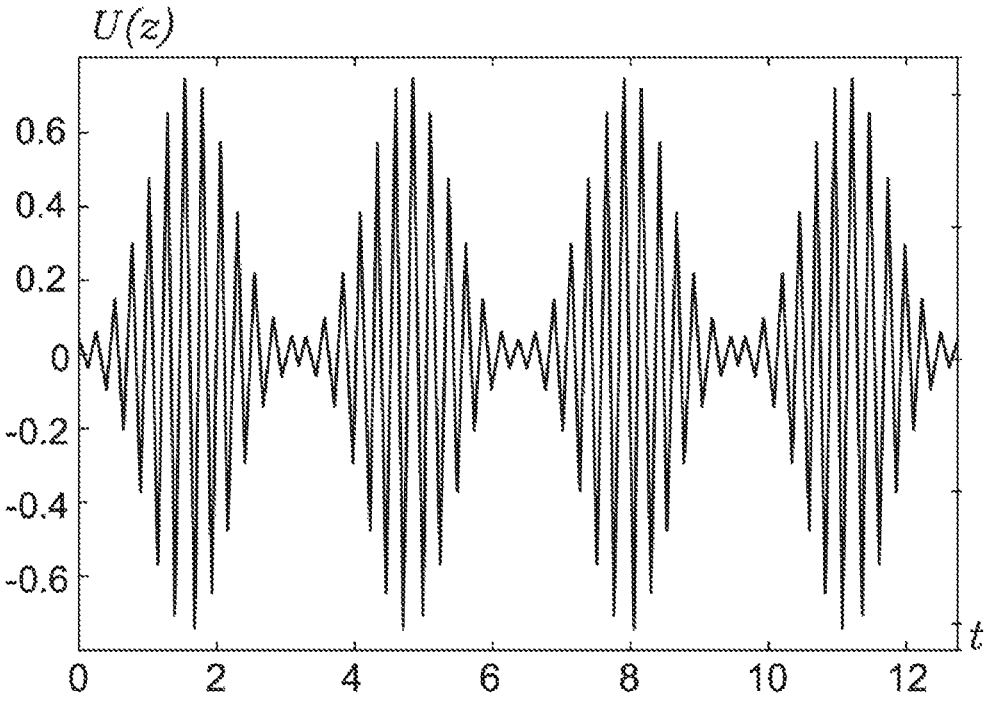
FIG. 50. An example of high-frequency voltage U(t) as a superposition of phase-modulated high-frequency voltages, defined by the formula: cos(ωt+sin(cos(t/T)))+cos(ωt−sin(cos(t/T)))−1.3 cos(ωt).
Figure 51:
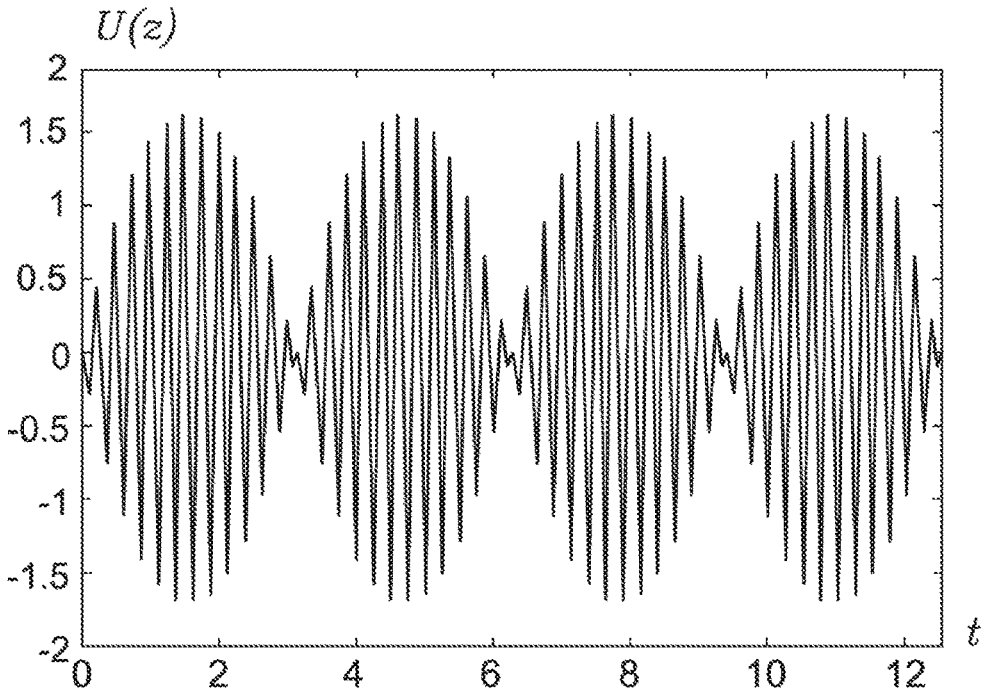
FIG. 51. An example of high-frequency voltage U(t), created by means of frequency modulation of high-frequency voltage cos(ωt) with the help of the function sin (t/T)/(t/T).
Figure 52:
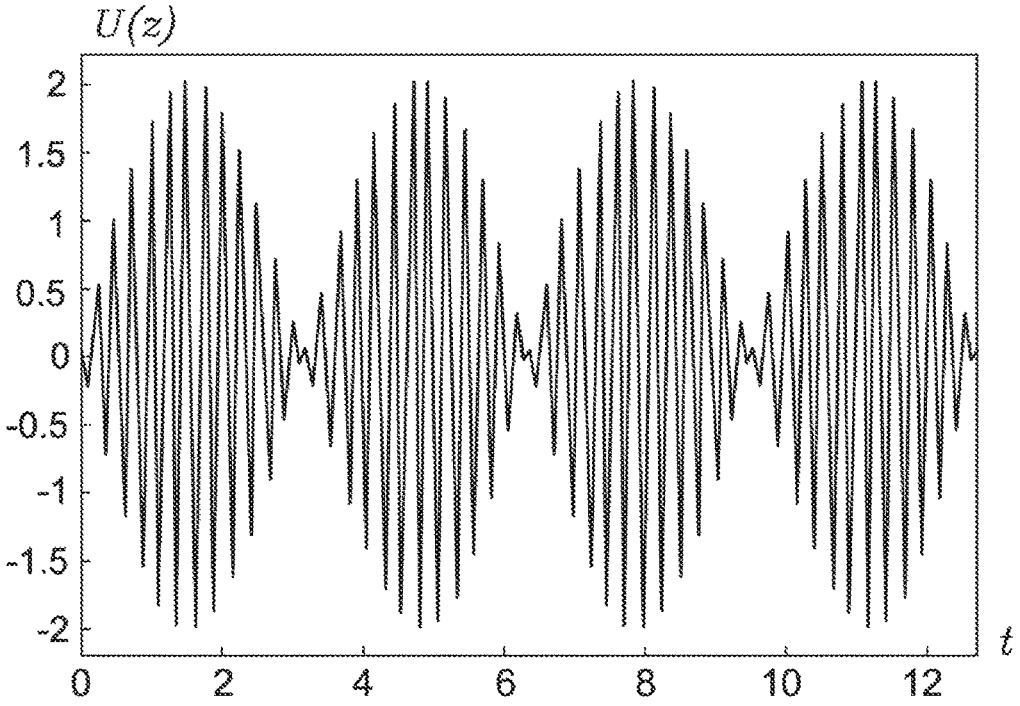
FIG. 52. An example of voltage я U(t), created by means of frequency modulation of high-frequency voltage cos(ωt) with the help of oscillating function.

The application of square waveforms (where the waveforms are not necessarily square ones but can have an arbitrary shape) provided by the digital method and applied to the present invention may be illustrated by the example where the device is formed by a system of electrodes representing a series of plates each having coaxial apertures, as illustrated in FIGS. 1, 2 53, 54 and 55, and the wavelength of the "Archimedes" wave repeats every 4 plate electrodes, as seen in profile in FIG. 2. Any of the following waveforms may be applied to provide the moving pseudopotential wells using the "square" waveforms provide by the digital method. The following tabulated waveforms are provided as an example, applied to the case where the Archimedes wave repeats after 4 electrodes. The digitally produce waveform may, for example, be non-symmetrical positive or negative pulses. In all cases "w" is the frequency of the digital waveform and "t" is time, and "V" is a discrete voltage level which defines the amplitude of the digitally synthesised waveform and "a" is the frequency of the Archimedes wave, and "fun( )" is the function that describes the digitally synthesised waveform which may be consist of single sided pulses of duty cycle ratio of 0.5 and mathematically defined over a single cycle as: fun(w*t)=V if 0<w*t<½, fun(w*t)=0 if ½<w*t<1. Or two side pulses of duty cycle ratio of 0.5 and mathematically defined over a single cycle as fun(w*t)=V if 0<w*t<½, fun(w*t)=−V if ½<w*t<1, or a three level waveform, may be defined over a single cycle as: fun(w*t)=V if 0<w*t<¼, fun(w*t)=0 if ¼<w*t<½, fun(w*t)=−V if ½<w*t<¾, fun(w*t)=0 if ¾<w*t<1. It should be understood that this is a small subset of possible digitally synthesised signals.

| Electrode number | Amplitude modulation | Combination of close frequencies | Pulse modulation With modulation function F(a * t) = 1 if 0 < a * t < ½, F(a * t) = 0 if (½) < a * t < 1 |
|---|---|---|---|
| 1 | cos(a * t) * fun[w * t] | fun[(w − a) * t] + fun[(w + a) * t] | F(a * t + 0/4) * fun[w * t] |
| 2 | sin(a * t) * fun[w * t] | fun[(w − a) * t] − fun[(w + a) * t] | F(a * t + ¼) * fun[w * t] |
| 3 | −cos(a * t) * fun[w * t] | −fun[(w − a) * t] − fun[(w + a) * t] | F(a * t + ½) * fun[w * t] |
| 4 | −sin(a * t) * fun[w * t] | −fun[(w − a) * t] + fun[(w + a) * t] | F(a * t + ¾) * fun[w * t] |

Similar functions may be derived for the phase or frequency modulated methods, or similarly waveforms may be derived where the Archimedes wavelength repeats every 3,5, 6,7, 8,9, 10,11, 12 or more electrodes. That is, any other number of reiterative electrodes, periodical or not. For the device with fixed repeating distance the speed of propagation is determined by parameter a, thus is controlled by the programmable digital signal generator. The application of digitally synthesised waveforms may equally be applied to all electrode structures described herein.

Figure 71:
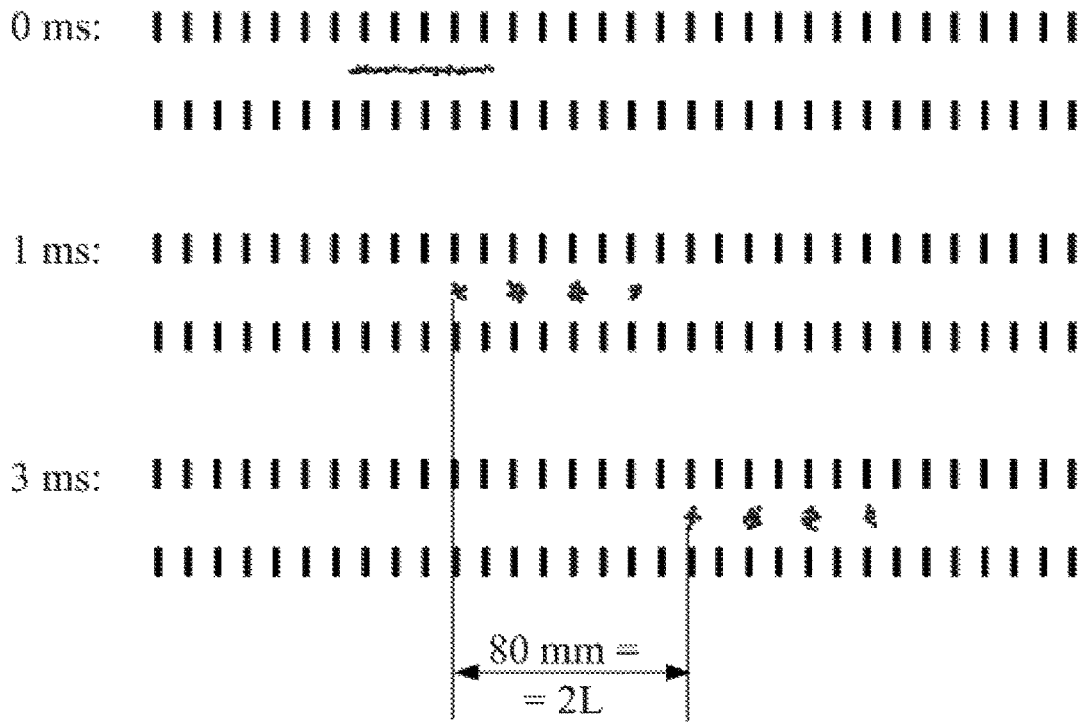
FIG. 71. Breaking-up of the initial ensemble of charged particles into spatially separated packets and transportation thereof along the channel for charged particle transportation in example 1.
Figure 85:
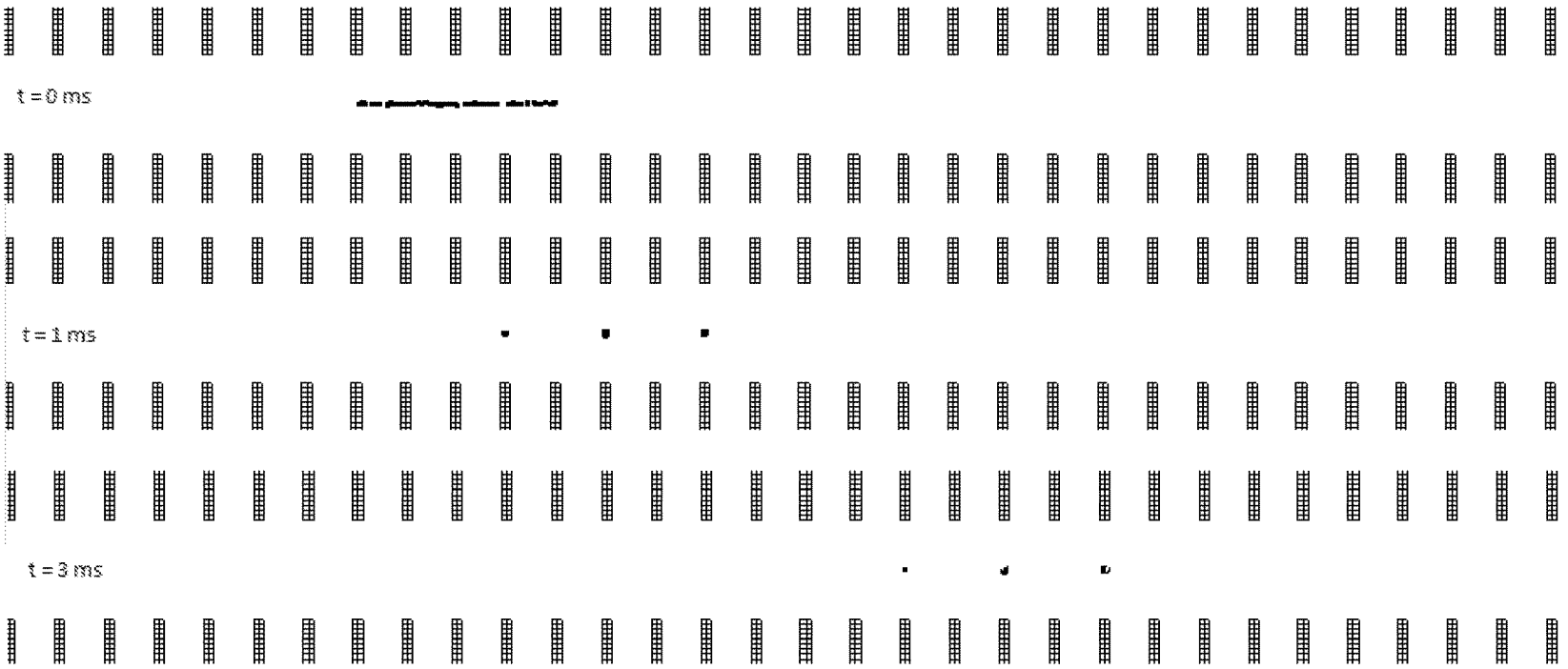
FIG. 85. Results of a simulation using digital waveforms, whereby ions initially distributed along the axis are formed into bunches and conveyed along the axis in bunches.

With reference to example 1 and FIG. 71, the bunching of ions may be equally achieved when the applied signals are digitally synthesised. FIG. 85 shows a further case in relation to example 1. This figure was achieved with the following parameters. Two sided square pulses of duty cycle ratio of 0.5, amplitude modulation method was also given by two side square pulses of duty cycle ratio of 0.5 with a frequency a, and using the following parameters w=1 MHz, a=1 kHz, V=1 kV, and a constant pressure in the device of 0.26 Pa, and ion mass of 609 Da. The simulation demonstrates that ions initially distributed along the axis are formed into bunches and conveyed along the axis in bunches.

Pressure gradient and Orthogonal Extraction

In embodiments, the device comprises means for preparing ions and extracting ions into a time of flight mass analyser, as discussed above. In particular for extracting ions in an orthogonal direction from the device, the technical advantages of extracting ions directly from a multipole ion guide are described in patent application PCT/GB2012/000248, whose contents are incorporated herein by reference, therein is described an ion guide with at least one extraction region for extracting ions into a direction orthogonal to the axis of the ion guide. The configuration describes therein the advantage of bunching the ions as they propagate the ion guide. The bunching confers the advantage of increased duty cycle and the increased operational scan-rate, and both aspects provide greater sensitivity and dynamic range and thus greater commercial value of the instrumentation compared to prior art ion-trap-ToF hybrid instruments.

Figure 86:
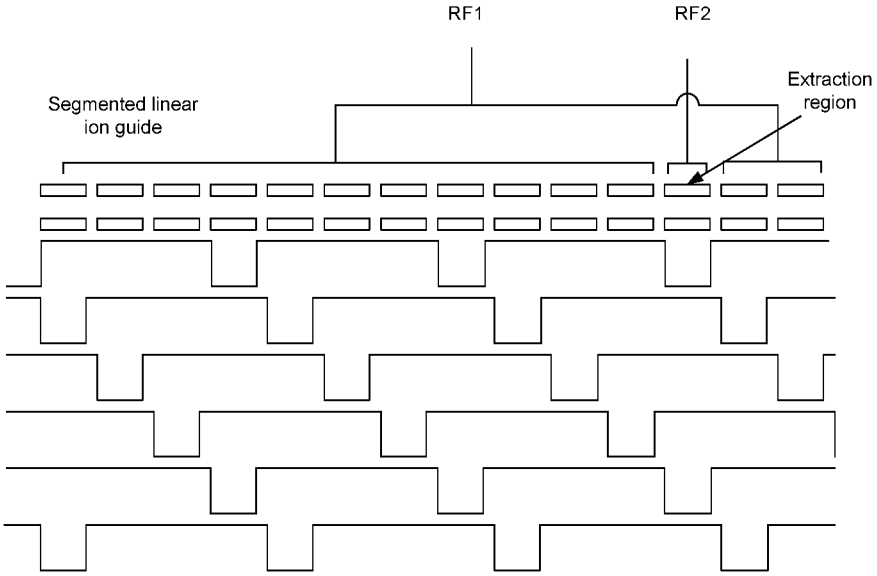
FIG. 86. Quasi-static bunching voltages, shown at several instances of time, for propagating ions along a device in bunches.

An embodiment of PCT/GB2012/000248 is reproduced in FIG. 86 for convenience, having a segmented ion guide, with one segment designated as an extraction segment. In this example taken from PCT/GB2012/000248, ion bunches are provided, by application of suitable quasi-static waveform so that ion bunches are spaced every 4th segment. The system is operated such as an ion bunch passes into the extraction region, the RF voltage, providing the radial confinement, is momentarily switched off and another voltages means applied, refer as an extraction voltage. In this example the extraction voltage supply means would be applied exactly one $4^{th}$ the frequency of the quasi-static ion conveying waveform. Practically this extraction waveform is applied as each potential well becomes aligned with the centre of the extraction regions. The extraction waveform causes ions to exit the ion guide in a substantially orthogonal direction. In preferred embodiments the extraction waveform is synchronised with the RF waveform in addition to the conveying or packeting waveform. An example is given therein the instrument at a scan rate of 4 KHz, the DC level of the quasi-static ion conveying waveform would be applied for a duration of 250 μs. That is the ion packets would progress one segment at a frequency of 4 kHz. It is noted by the inventors that for achieving the maximum efficiency of ion transport one set of rods of the segmented ion guide or alternatively auxiliary rods have shortened segmented such that the propagating ion bunch can be made shorter than the total length of the extraction region and preferably comparable to or less the length of the extraction located within the extraction segment. It is noted that such an embodiment can therefore not only provide fast scanning but also a 100% duty cycle. A further embodiment is described therein where the linear ion guide is constructed from a quadrupole rod set having continuous rods, in one plane (x) and segmented rods in the orthogonal plane (y) Thus, invention provide a linear ion guide, that receives ions in the form of a continuousion beam along its longitudinal axis, said linear ion guide having at least one segment configured as an extraction region and additionally having a ion packeting means effective to convert the continuous ion beam into bunches propagating in the axial direction. Wherein the ion packeting means is provided by segmented rods or segmented auxiliary electrodes located between or outside the main poles of the ion guide and wherein ion extraction pulses are synchronised to the ion packeting means. The auxiliary electrodes have DC voltages to define the axial DC ramp or packeting/bunching function, whereas the poles of the ion guide carry the RF trapping voltage.

PCT/GB2012/000248 further teaches that advantage of passing the ion guide through an region of elevated pressure that is located upstream and prior to an at least one extraction region. This arrangement is useful because the ions are preferably delivered cool into the extraction region, that is low energy and low energy spread of the ions, and preferably in or close to thermal equilibrium to the containing buffer gas, however, the pressure in the extraction region, in contradiction, is advantageously low, and preferable lower than $1\times10^{-3}$ mbar, so as to avoid scattering of ions with the buffer gas atoms during acceleration from the extraction region. Such scattering results in the undesirable loss of resolving power and mass accuracy in the ToF analyser. However, this pressure is not consistent with the pressure need to provide effective cooling, which is preferable higher than $1\times10^{-2}$ mbar.

Returning to an embodiment described in PCT/GB2012/000248 the extraction region of the ion guide has preferably a separate voltage supply means for effecting radial ion trapping, that is separate from the voltage supply means dedicated to other segments of the ion guide, this feature allows ions to be retained in other parts of the on guide at the same time as ions are removed from the extraction region. As noted above, an embodiment of PCT/GB2012/000248 is reproduced in FIG. 86 for convenience, having a segmented ion guide, with one segment designated as an extraction segment. The extraction segment is capable of transmitting ions or extraction ions and is an integral part of the ion guide. Also shown in FIG. 86 it is the quasi-static bunching voltages, repeated at several instances of time, for propagating ions along the device in bunches. The propagation of ions through multipole ions guides spanning region of differing pressure is also described in U.S. Pat. No. 5,652,427, and a stated application of the device is for delivering ions to a ToF device albeit in this case (U.S. Pat. No. 5,652,427) the pulsing device is physically separated from the multipole ion guide, and no bunching means is taught therein. Specifically U.S. Pat. No. 5,652,427 describes general apparatus, with at least two vacuum stages each having a pump means, the first of which is in communication with said ion source and subsequent chambers are in communication with each other via a multipole ion guide which is effectively located in a plurality of said vacuum stages. However, this patent does not teach how to move ions along the multipole device, without increasing the energy of the ions and in at least a practically useful transit time and nor in a time synchronised manner.

Both the above prior art devices exhibit the following limitation: although ions may be moved to a region of high pressure where efficient cooling may take place, and subsequently or progressively move ions to a second region of lower pressure, the static voltages (U.S. Pat. No. 5,652,427), or quasi-static (PCT/GB2012/000248) voltages necessarily re-introduce additional energy to the transported ions, that is transporting ions along the ion guide requires their acceleration in the axial direction, some of which is also redirected to lateral energy. Another document relating to orthogonal extraction of ions into ToF is GB2391697B. This document describes an ion guide that receives ions and traps them within axial trapping regions and translates them along the axial length of said ion guide and ions are then released from said one or more axial trapping regions so that ions exit said ion guide in a substantially pulsed manner to an ion detector which is substantially phase locked to the pulses of ions emerging from the exit of the ion guide. Therein is described only quasi-static voltage means for transporting ions, and as in U.S. Pat. No. 5,652,427 there in only described a means for pulsing ions that is external to the ion guide, inherent in this design is the need for phase locking to the external device to the exiting ion bunches. Whereas in embodiments of the present invention ions are ejected from the ion guide. This is a distinct advantage as there is no requirement for phase locking to an external ion detector or ToF analyser.

Thus embodiments of the present invention overcome the problem of the prior art and provide a means to transport ions at constant velocity, resulting in cool ions bunch when viewed in the lateral direction.

Indeed simulation shows ions that have reached thermal equilibrium with the buffer gas maybe transported without increasing of the energy or energy spread of the ions in the lateral direction. Thus by cooling the buffer gas, for example to liquid nitrogen or liquid helium temperatures, ions may be transported with very low effective temperature. Thus embodiments comprise a device for use in mass spectrometer applications (e.g. in a mass spectrometer) for delivering ions in/to a low pressure region in a cooled state. Wherein suitably the pressure is lower than $5\times10^{-3}$ mbar, preferably lower than $1\times10^{-3}$ mbar and further preferably lower than $5\times10^{-4}$ mbar.

Alternatively the device may be used to transport ions from low pressure region into a higher pressure region, at least where the buffer gas flow is characterised by molecular flow, that is where the quantity $L/\lambda$ is $<0.01$, where L is the dimension of the of guide and $\lambda$ is the mean free path of the gas atoms between collisions.

Accordingly, embodiments comprise a device for conveying ions from a gas pressure region into to a vacuum region, and still furthermore and in combination as a device, in particular, that can encompass several stages of differential pumping; in that way, the pressure of gas can vary essentially along the length of said device, and optionally injecting of ions into the mentioned device at higher pressure as compared with the ion outlet area of the mentioned device, furthermore in the device, in the course of operation thereof within the structure of the physical instrument under consideration, equalisation of kinetic energies of charged particles can take place, due to collisions and energy exchange between charged particles and neutral gas molecules and still furthermore and in combination, the device can be used, in particular, for the pulsed injection of ions into a mass analyser operating in a pulsed mode.

By way of specific example we describe a detailed ion optic simulation. The embodiment of the device as shown in FIG. 71 was used, in simulation to transport ions along a 300 mm long device. The pressure of the buffer gas in the device was 2.6×10-3 mbar, and in the given example the 609 Da ions were initiated in the entrance at thermal energy, 0.025 eV as recorded in a lateral direction, the ions were conveyed in a bunch along the device employing an Archimedean wave of frequency 2 kHz and providing at translational velocity of 80 $ms^{-1}$, further in this example the ion bunches are separated axially by 20 mm, thus an ion bunch is delivered to the proceeding device at the rate of 4 kHz. Ion were recorded at 100 mm, 200 mm and 300 mm from the entrance of the device, and the energy spread was recorded at 0.029 eV, 0.022 eV and 0.025 eV respectively when measured at suitable phases of the RF voltage.

In a second simulation a pressure gradient was imposed such that ions pass from high pressure of $2.6\times10^{-2}$ mbar to lower pressure of $2.6\times10^{-5}$ mbar, thus spanning three orders of magnitude of pressure. In this cases ion bunches were effective transported as discrete bunches and also without increase in the recorded lateral energy spread of ions.

In embodiments the invention can be used to deliver ions to a time of flight mass analyser as described above and in PCT/GB2012/000248, but overcoming the limitations so that ions maybe delivered in cooler to the extraction region than in the prior art, and additionally at a lower pressure within the extraction regions. These two distinctions provide for greater resolving power from the ToF analyser. Furthermore the invention provides for all necessary pulsed voltages for effective operation and high duty cycle and high scan speed as described within PCT/GB2012/000248. Thus in general the current invention provides a device for manipulations with charged particles, containing a series of electrodes located so as to form a channel used for transportation of charged particles; a power supply unit to provide supply voltages to be applied to said electrodes for the purpose of creation of a non-uniform high-frequency electric field within said channel; pseudopotential of said field having one or more local extrema along the length of said channel for transportation of charged particles, at least within a certain interval of time; whereas at least one of said extrema of the pseudopotential is transposed with time, at least within a certain interval of time, at least within a part of the length of the channel used for transportation of charged particles, and wherein: the supply voltages are in the form of periodic non-harmonic high-frequency voltages synthesised using a digital method, or otherwise, a superposition of the said voltages and wherein additional voltages are applied to electrodes; said voltages being DC voltages, and/or quasi-static voltages, and/or AC voltages, and/or pulsed voltages, and/or high-frequency voltages, thus providing control of time synchronisation of the transportation of packets of charged particles. Wherein the device maybe further configured so that the injection of ions into the device can takes place at a higher pressure compared to the ion outlet region. And wherein the device is further configured to be time-synchronised with the operation of a device for detection of charged particles. And wherein the device is configured at least one point along its length to extract charged particles in the direction orthogonal or slanting with respect to the direction of charged particle transportation.

Collision Cell

In embodiments, the device is used within (suitably forms part of) the structure of a cell for fragmentation of ions, wherein, the fragmentation of ions is caused by injecting of ions into said device with sufficiently high kinetic energy. The device overcomes a well understood problem of collision cell operationstanding for several years, which can be explained by means of the following example: In quantative analysis of known anlaytes, for example drug samples, one knows the species, under investigation, and the analysis seeks to find out how much of that drug exists relating to a particular circumstance. In such cases on uses a calibration standard at a constant concentration to provide a relative measure of the concentration of the drug under analysis. Frequently analysts use a Deuterated analogue of the drug as the calibration standard, that is a function group has Deuteron atoms instead of Hyrdrogen atoms. In such cases the analyte and the calibrant have a parent mass that differs by for example 2 Da, but both have a common fragment ion when the ions when the ions are submitted for analysis by MS2. MS2 analysis may be used in preference to MS1 for superior sensitivity and specivity. As the two species are chemically identical they co-elute from an LC column, and thus enter the mass spectrometer at the same time. In the case the physical instrument under consideration is a Triple quadrupole (QqQ) or a quadrupole ToF (Q-ToF). In either case the quadrupole is made to select or transmit the analyte and the calibrant precursor sequentially, typically switching periodically back and forth between the two ions for example at a rate of 50 or 100 or even 200 times a second, or in some cases preferably higher. The problem relates to the transit times of the fragment ions through the collision cell body once formed and after the energetic injection of the parent ion. Due to the high pressure within the collision cell, at least some fragment ions can be cooled to thermal energies and spend several 10s or even 100s of milli seconds to pass through the device and in the absence of any propelling means, and in some cased become trapped for considerably longer time. The detrimental effect is that the mass spectrometer measured the incorrect concentration because some calibrant ions are mistaken for analyte ions.

There are already several methods to address this problem, for example, in U.S. Pat. No. 6,111,250 a DC gradient is introduced by various means between the entrance and exit of the collision cell so as to keep fragment ions moving through the device and limiting residence time. U.S. Pat. No. 6,800,846 teaches the use of a transient DC applied to segmented rods to overcome the same problem using a different method. There are also other methods employed such as RF gradients, inclined rods, auxiliary rods, all aimed to reduce the transit times of fragment.

Embodiments of the present invention address the same problem, and provide additional improvement in performance: In preferred embodiments the device is used within the structure of the inlet intermediate device, within the structure of the of the collision cell and within the structure of the outlet intermediate device, hereafter referred as region 1, region 2 and region 3. The capabilities and features of the device hereto described, allow ions to be transmitted within bunches through all three regions of the said device. Fragmentation of the parent ions, is provided in the normal way, that is by injecting of ions into said device, that is from region 1 into region 2 with sufficiently high kinetic energy, resulting in excitation of internal energy of ions through multiple collisions with buffer has atoms. In another view a DC potential is applied between region 1 and region 2. Such a process is commonly known as Collision Induced Dissociation (CID). By application of the features of the present invention the bunches of parent ions propagate into the device confined within discrete bunches and the resulting fragment (or daughter ions) remain within the same propagating bunch as the parent they were derived from and without mixing with ions from the proceeding or proceeding bunches, where the confinement of ions can be realised due to aspects of the claimed device as previously described. Wherein suitably the device provides that the time interval between successive packets of charged particles may be matched to the time intervals required by an output device to perform further processing, to avoid losses of the charged particles. For the output device, one can use a device, which performs analysis of charged particles (for example, time-of-flight mass spectrometer or RF ion trap).

Further advantages may be understood with respect to the prior art, for example the speed of propagation of the Archimedean wave as it passes through the device may be suitably slowed, such that daughter ions are suitable cooled to gain or regain thermal equilibrium with the buffer gas, before transmission to the lower pressure region 3, and for onward processing or detection, a feature not available in any prior art device, for the reasons explained elsewhere. Thus the flexibility of the current invention provides physical simplification, for example the length of the device, and thus the physical size not only of the device itself, but the associated structure of the physical instrument. The reduction in the length also provides a reduction in the multiple of pressure and length, it may be made optionally lower than is possible in prior art device. See U.S. Pat. No. 5,248,875 for reference to the importance of this parameter.

Figure 57:
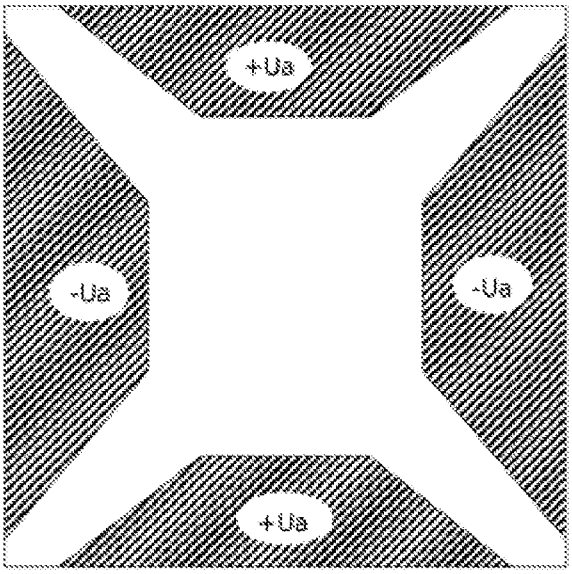
FIG. 57. Trapezoidal profile of the electrodes of single diaphragm, used for formation of a channel for charged particle transportation, as an example of profile for creation of electric field with the required distribution of pseudopotential along the axis of the device, containing quadrupole components.
Figure 58:
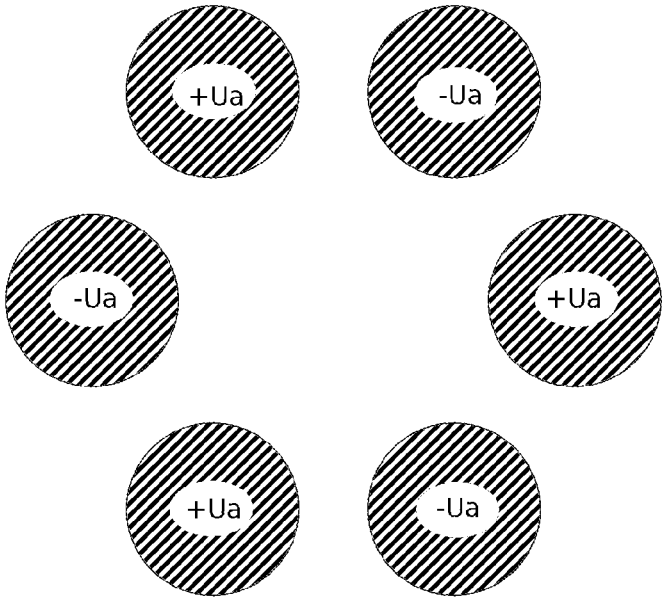
FIG. 58. An example of the profile of electrodes composed of slotted round rods, used for creation of high-frequency electric field with the required distribution of pseudopotential along the axis of the device, containing higher multipole (sextupole) components, in the channel for charged particle transportation.
Figure 87:
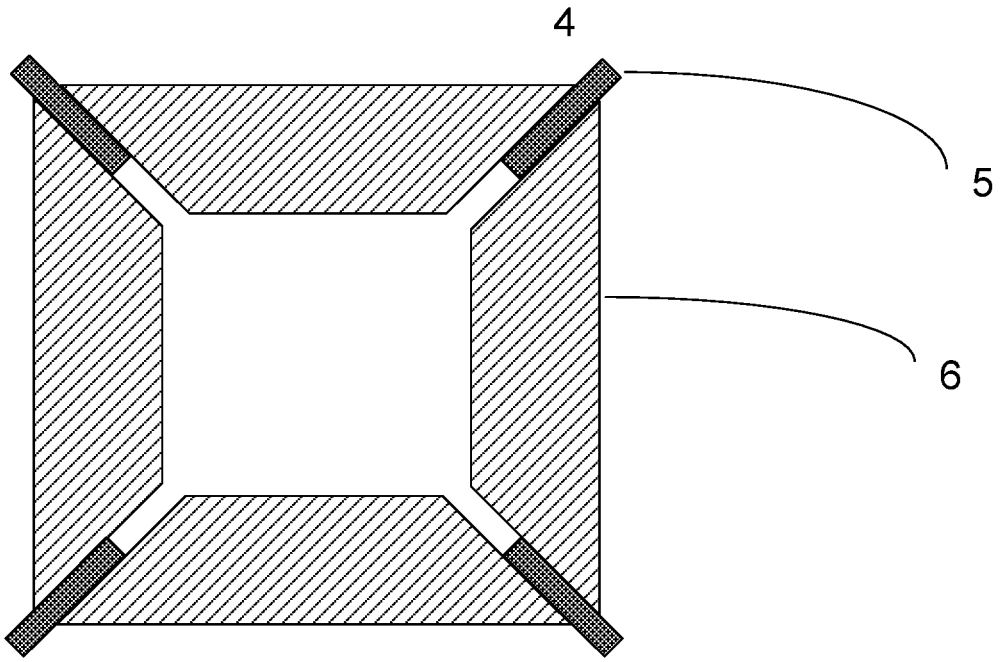
FIG. 87. Electrode arrangement comprising four electrodes (6) and four insulators where the four insulators (5) form part of a supporting structure.

The electrode structure of each region maybe selected from general types shown and previously described in FIGS. 1, 2, 31, 32, 33, 34, 35, 53, 54, 55, 56, 57, 58, 59, 60 and 79. One preferred embodiment is when the selected electrodes are of the type shown in FIG. 55, a quadrupole formed from planar electrodes. Another preferred embodiment is when the selected electrodes are of the type shown in FIG. 57, a quadrupole formed from triangular electrodes. These types, and similar types lend themselves most effectively to be enclosed by the electrically insulating supporting structure, as for example as shown in FIG. 87, which is formed from four electrodes (6) and four insulators where the four insulators (5) form part of a supporting structure.

Figure 88:
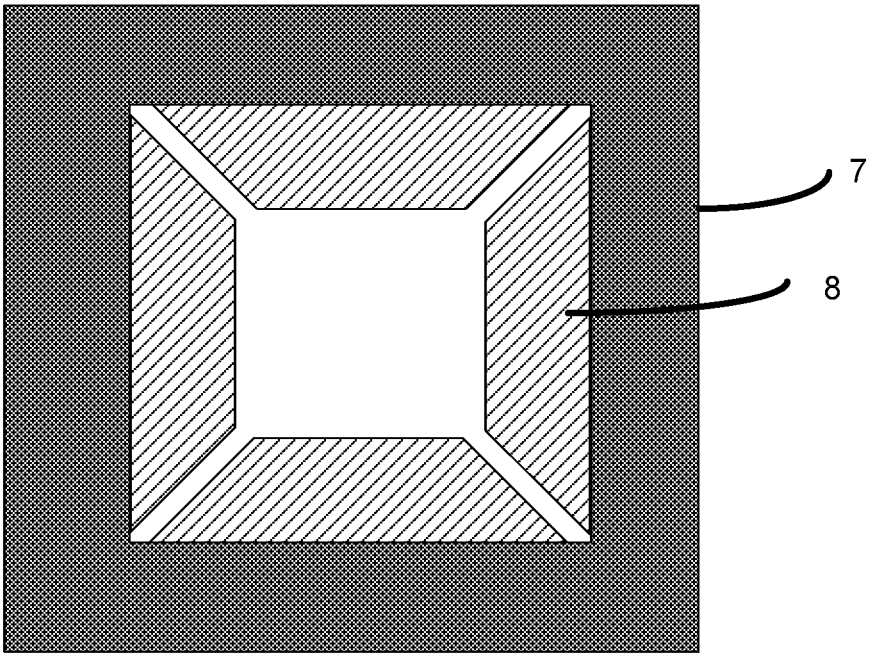
FIG. 88. Embodiment having four electrodes (8) and an insulator (7) where the insulator (7) forms the supporting structure.
Figure 89:
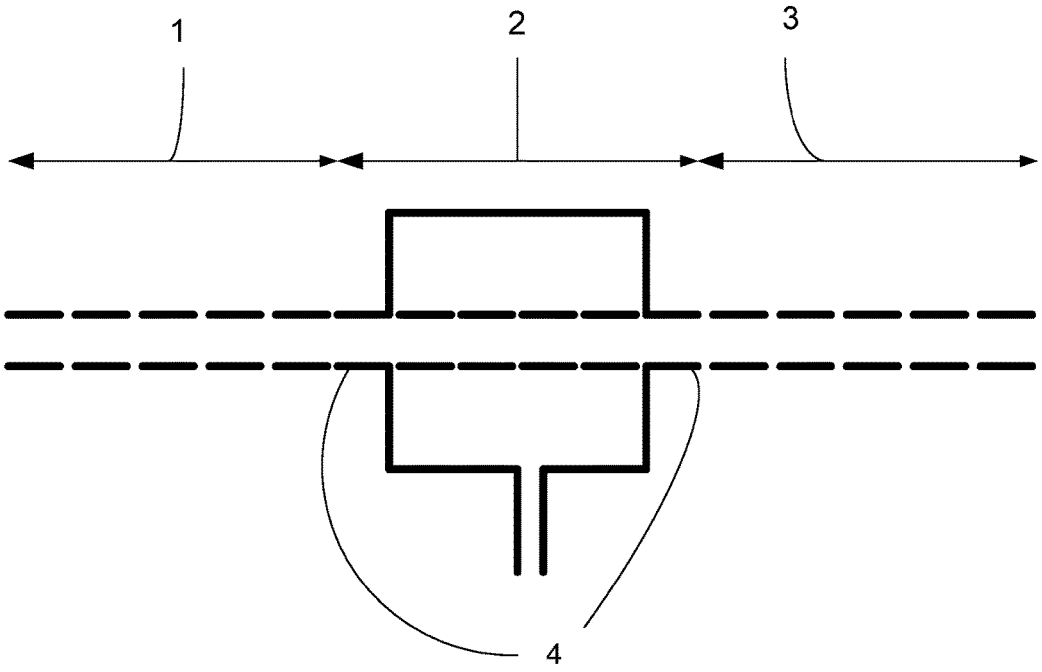
FIG. 89. Device located within the structure of a cell for fragmentation of ions, having regions 1 to 3, the central region 2 optionally being held at elevated pressure with respect to the said first and third regions.

Another preferred embodiment is shown in FIG. 88 having four electrodes (8) and an insulator (7) where the insulator (7) forms the supporting structure. These preferred embodiments of the claimed device provide the possibility in construction to designate one or more segments of the claimed device, as conductance segments and used for establishing pressure differentials within the device. Thus returning to the case that the device is used within the structure of a cell for fragmentation of ions, the said central region may be held at elevated pressure with respect to the said first and third regions, this one preferred embodiment is represented in FIG. 89 having regions 1 to 3, and region 2 having at least two conductance limiting segments (4). This physical construction of a collision cell when in combination with the device (e.g. in an instrument/apparatus) provides for the efficient transporting of ions between differing pressure regions compared to prior art collision cell device where apertures are used for proving the conductance limits. In a most preferred embodiment the arrangement represented in FIG. 89 is located within a single vacuum chamber having at least one vacuum pump for pumping away gas.

Figure 90:
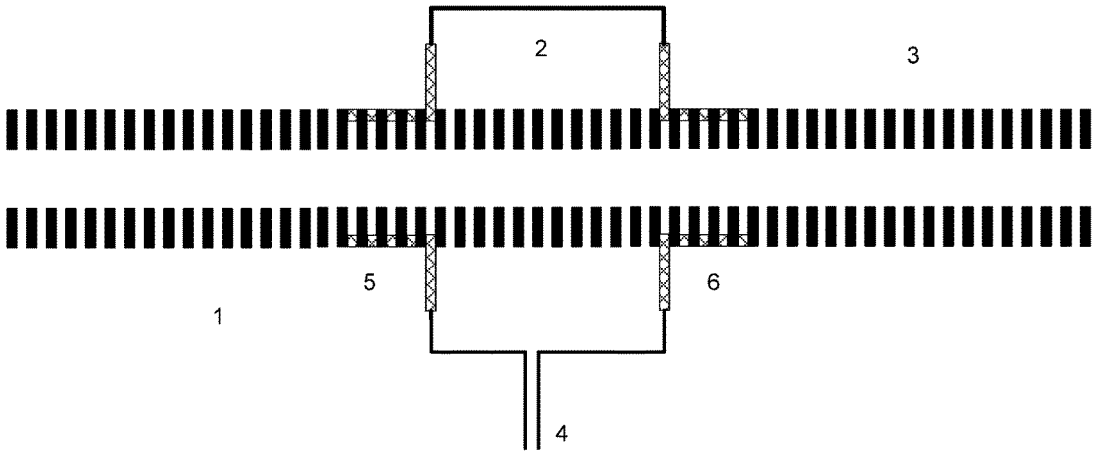
FIG. 90. Arrangement having regions 1 to 3 for conveying ions, where the region 2 is designated to be the collision cell region having a gas inlet 4, two conductance limiting sections which are connected by tube 7 such that the collision cell region 2 may be maintained at a higher pressure than regions 1 and 3, and further that regions 1 to 3 are located within a single vacuum chamber with at least one pump for pumping away gas.

When electrodes are formed from the type shown in FIG. 1, 34, 35 or 53, the conductance limiting segments may also be readily introduced in construction, see one embodiment in FIG. 90. Having regions 1 to 3 for conveying ions according to methods of the present invention, where the region 2 is designated to be the collision cell region having a gas inlet 4, two conductance limiting sections and which are connected by tube 7 such that the collision cell region 2 may be maintained at a higher pressure than regions 1 and 3, and further that regions 1 to 3 are located within a single vacuum chamber with at least one pump for pumping away gas.

Electron Transfer Dissociation (ETD)

In further embodiments, the device is used as (suitably is, or is part of) an ion-ion reaction cell. Features of the present invention may be advantageously applied to existing methods of ion-ion reaction cells providing additional improved characteristics and solving problems of prior art ETD devices. The most common method of ion fragmentation involving ion-ion reactions is that of Electron Transfer Dissociation (ETD). ETD is particularly applied to the fragmentation of protein and peptide ions. This method provides advantages in the field of protein sequencing as the fragmentation mechanism is largely independent of the amino acid sequence. ETD was previously implemented in commercial mass spectrometers, its implementation within an adapted Linear Ion Trap instrument is described within [John E. P. Syka et al., PNAS, vol. 101, No. 26, pp. 9528-9533]. Therein a method to trap positive (analyte) and negative (reactant) ions is described within a Linear Ion Trap (LIT) mass spectrometer. Confinement along the axis is achieved by establishing pseudo potential barriers in the end segments of the device. A reaction time of 10 ms or more is needed for the reaction to fully take place, that is for the generation of the product ions from the parent analyte ions. For this reason the implementation of ETD as described by Syka, is not suitable for application to high throughput mass spectrometers of the Q-ToF or QqQ configuration. These issues were addressed in part by EP1956635, where analyte ions and reactant ions are transmitted together in bunches by moving pseudo potential wells. Essentially, reactions take place as the ion bunches are moving along the ion guide, the resultant fragment ions thus delivered for analysis on arrival at a downstream mass analyser. This invention in principle provides the possibility to implement the ETD method with the Q-ToF or QqQ device without reduction in throughput or sensitivity, and is able to preserve the time order in which ion bunches entered the device, and thus may preserve chromatographic resolution when the physical instrument is to be employed in LCMS applications. All details for effective implementation are not taught within EP1956635. There is described therein a device those structure is limited to a plurality of electrodes each having a circular hole opened therein, and the method of providing the moving pseudo potential wells is limited to amplitude modulated sinusoidal RF waveforms.

EP1956635 does not teach methods to introduce ions of both polarity to the device with high efficiency, or to match the ETD device to the proceeding device, the output intermediate device, nor to time synchronize to an output device, nor does it teach the most practical methods for its implementation. The generalised methods taught by the present invention and devices described may be applied to provide a high throughput ETD method applicable for a wide range of devices and instrument formats. The present invention provides methods for overcoming the limitations within EP1956635. In principle any reaction time may be accommodated in the high throughput device by proper choice of the device length and the speed of propagation of the pseudo potential wells through the device. The requirements of the output device may also dictate the length of the device with regard the frequency of operation of the output intermediate device. For example, if the reaction time is 50 ms and the output devices has a frequency of operation of 1000 Hz, then there must be 50 bunches simultaneously transmitting at any one time. Thus for a wavelength of the Archimedean wave fixed at 40 mm, at total length in the prior art device would be 40×50 mm or 2 m in length, which in practice is much too long. As one aspect of the current invention is to provide for variation of the repetition distance of ion bunches within the device as they propagate. Thus in the currently discussed application of ETD the separation of the ion bunched can be spaced at the entrance and exit regions for the effective matching to the requirements of intermediate input and output devices, but may be made significantly smaller in the central region such that the overall device length may be reduced, that means that ion bunches would move slower but would become more closed space along the axis and thus the residence time may be maximised for a given device length. Similarly the frequency of the Archimedean waveform could alternatively be adjusted, that is reduced in the central portion. Alternatively in the case long reaction times must be accommodated in a high throughput device, an curved or semi-circular ion guide of the form illustrated in FIG. 32 may be employed, equally for providing a compact device. All these measures provide a high throughput ETD device, with minimised space the requirements within an instrument.

Viscous Flow

Figure 91:
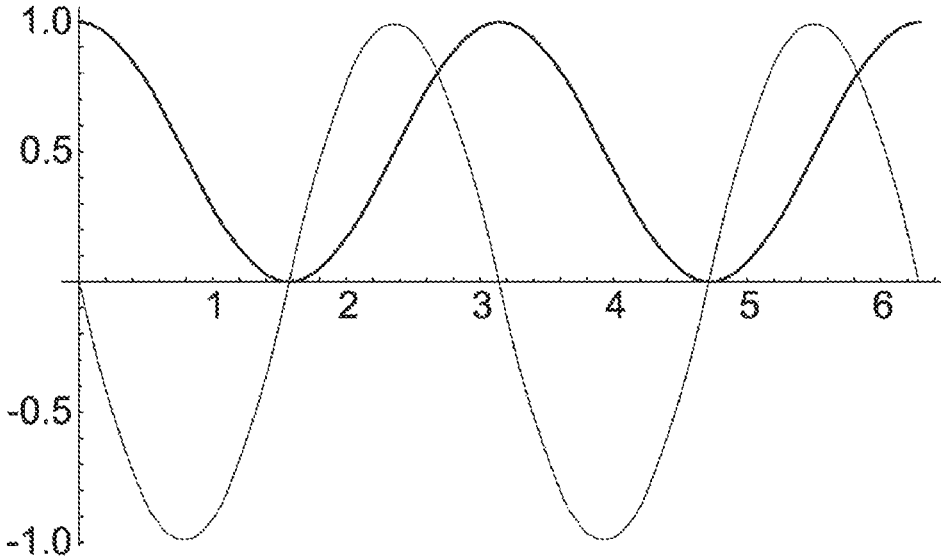
FIG. 91. Normalized Archimedean pseudopotential (thick line) and its normalized gradient (thin line) in normalized coordinates.

An important application Archimedean device is the transport of ions through viscous gases, define by pressures that give rise to the quantity $L/\lambda>0.01$, where L is the dimension of the of guide and $\lambda$ is the mean free path. By particular example the device may be applied/used to transporting ions from the interface region of high pressure ion sources, or in the transporting of ions to, from and within analytical devices operating under viscous flow conditions such as ion mobility or differential ion mobility devices. There will be several apparent advantages of those skilled in the art. One apparent advantage, compared to prior art methods, is in the transport of fragile ions, such as those commonly encountered in organic mass spectrometer. These molecular ions forced to move through gas media by electrical field may readily fragment due to increasing of their internal energy. Prior art systems attempting to focus ions by static localized in space fields, particularly in the interface region between chambers of differing pressures. Such focusing schemes subjected them to short impulse forces, and the voltages that may be applied is limited by the onset of fragmentation of the transported molecular ions. In contract the current device may apply a continuous field to accomplish the focusing and thus may achieve high transport efficiency at lower field strength and thus reduce fragmentation than prior art devices The following passage teaches the parameters relating an Archimedean device that must be considered to transport ions in bunches taking into account the gas flow and viscosity. The following examples illustrate the correct parameter in use independent of gas pressure and flow velocity. While for low gas pressures the gas media performs the cooling of ions and nearly does not influence their transitional movement, for higher gas pressures this is not so. Let us first consider the transportation in a motionless gas. With reasonably good approximation the ion movement in a gas media can be represented by the effective Stokes' force (or drag force) proportional to the difference between the ion velocity and gas velocity. For the motionless gas media the only velocity is the ion's velocity induced by the Archimedean wave with the pseudopotential $\overline{U}(z,t)=(qU_{RF}^2/4m\ L^2\omega^2)\cos^2(z/L-t/T)$, where $U_{RF}$ is the amplitude of the amplitude-modulated RF voltages applied to the electrodes, L is the characteristic length between the electrodes and between the local Archimedean wells, $\omega$ is the frequency of the RF voltages, T is the characteristic time of the amplitude modulation which controls the characteristic time of the Archimedean wave shift, q is the ion's charge, m is the ion's mass, z is the coordinate along the axis, t is time (FIG. 91). The pseudopotential's minima points at time t have the coordinates $z_k=t(L/T)+\pi L(k+½)$. The maximal driving pseudo force corresponding to the k-th minima is near the trailing front end of the wave at $\overline{z}_k=(-\pi/4)+t(L/T)+\pi L(k+½)$, and it is equal to $\overline{F}=(q^2U_{RF}^2/4m\ L^3\omega^2)$. However, the velocity of the pseudopotential wall at this point is equal to $\dot{z}=L/T$. If the ion is moving at least with the same velocity, as the Archimedean wave trailing front end does, the Stokes' frictional force acting on it is given by $F=-\gamma\dot{z}=-\gamma L/T$, where $\gamma$ is an effective friction coefficient characterizing the influence of collisions with the neutral gas molecules. It can be seen that when $\gamma(L/T)>(q^2U_{RF}^2/4mL^3\omega^2)$ the ion cannot move with the same velocity as the Archimedean wave does. That is, for sufficiently big $\gamma$ (for sufficiently dense gas media) the ion cannot follow the Archimedean wave in a synchronized way, its velocity is lower.

The following figures correspond to the model simulations performed in normalized coordinates. It is most informative to illustrate the behavior in normalized coordinates because in this way it is possible to separate the important characteristic features of the movement from the unimportant ones. By introducing the normalized variables $x=L_d\cdot X$, $y=L_d\cdot Y$, $z=L_d\cdot Z$, $U=L_u\cdot u$, $t=L_t\cdot\tau$, $V_x=L_v\cdot v_x$, $V_y=L_v\cdot v_y$, $V_z=L_v\cdot v_z$, $\gamma=L_g\cdot g$, where $L_d$, $L_u$, $L_t$, $L_g$, etc., are some scaling coefficients and X, Y, Z, u, $\tau$, $v_x$, $v_y$, $v_z$, g, etc., are the corresponding dimensionless variables, in particular, for the Archimedean wave described by the pseudopotential $\overline{U}(z,t)=(qU_{RF}^2/4mL^2\omega^2)\cos^2(z/L-t/T)$, where $U_{RF}$ is the amplitude of the amplitude-modulated RF voltages applied to the electrodes, L is the characteristic length between the electrodes and between the local Archimedean wells, a is the frequency of the RF voltages, T is the characteristic time of the amplitude modulation which controls the characteristic time of the Archimedean wave shift, q is the ion's charge, m is the ion's mass, z is the coordinate along the axis, t is time, it is useful to select the scaling coefficients like $L_t=T/2\pi$, $L_d=L/2\pi$, $L_u=mL^2/qT^2$, $L_v=L/T$, $L_g=2\pi m/T$.

In this case the voltages applied to the electrodes are represented as $\pm u_{RF}\cos(2\pi\tau)\cos(\Omega\tau+\varphi)$, $\pm u_{RF}\sin(2\pi\tau)\cos(\Omega\tau+\varphi)$ where $u_{RF}$ is the dimensionless voltage applied to the electrodes and $\Omega=\omega T/2\pi=vT$ is the dimensionless RF circular frequency, the Archimedean wave is represented as $\overline{u}_0\cos^2(2\pi(Z-\tau))$, where $\overline{u}_0\sim(u_{RF}^2/4\Omega^2)$ is the dimensionless pseudopotential amplitude, etc. In particular, the dimensionless equations of motion are represented as $\ddot{X}=(\partial u/\partial X)-g(\dot{X}-v_x)$, $\ddot{Y}=(\partial u/\partial Y)-g(\dot{Y}-v_y)$, $\ddot{Z}=-(\partial u/\partial Z)-g(\dot{Z}-v_z)$ and the motion depends on dimensionless values $u_{RF}$, $\Omega$, g, $v_x$, $v_y$, $v_z$ only. This enables scaling of geometrical sizes and/or to scale the amplitudes and frequency of the RF voltages applied to the electrodes, and or the A-wave velocity in a wide range.

The following examples are illustrated for the simplified case where $\gamma=q/K$ where mobility data is widely available both theoretically and experimentally. This limits the present treatment to values of ratio of electrical field strength to number density to <20 Townsends. More general the viscosity should be considered as by $\gamma(\omega)\approx\text{const}_1+\text{const}_2\cdot w$ where $w=\sqrt{(\dot{x}-V_x)^2+(\dot{y}-V_y)^2+(\dot{z}-V_z)^2}$ is the relative velocity between the ion and the gas flow. However, limitation is not important for the purpose of current teaching. The invention is not limited to constant viscosity region, but may expanded to more general case where $\gamma(w)$ is dependent on the relative velocity between the ion and the gas flow.

Figure 92:
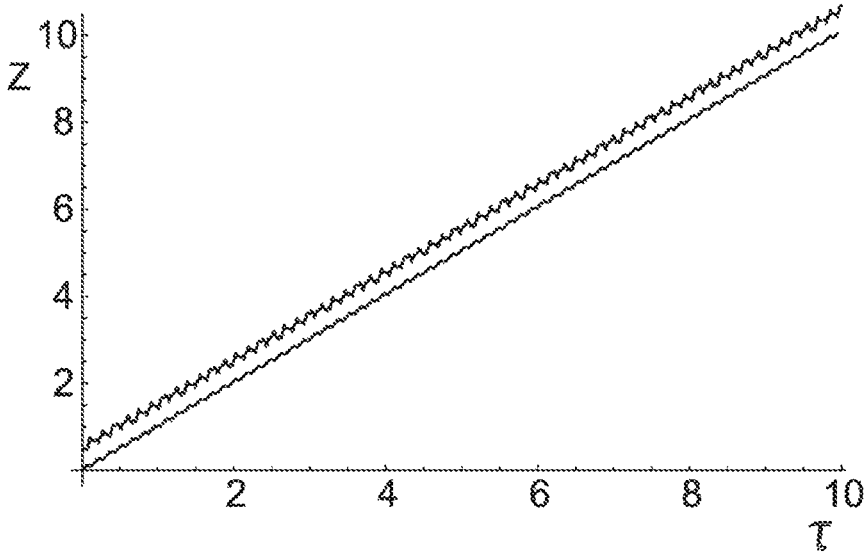
FIG. 92. Two ions moving inside separated Archimedean wells when the gas pressure is zero. Normalized time ($\tau$) is plotted on the Abscissa, Normalized axial ion position is plotted on the Ordinate (Z).
Figure 93:
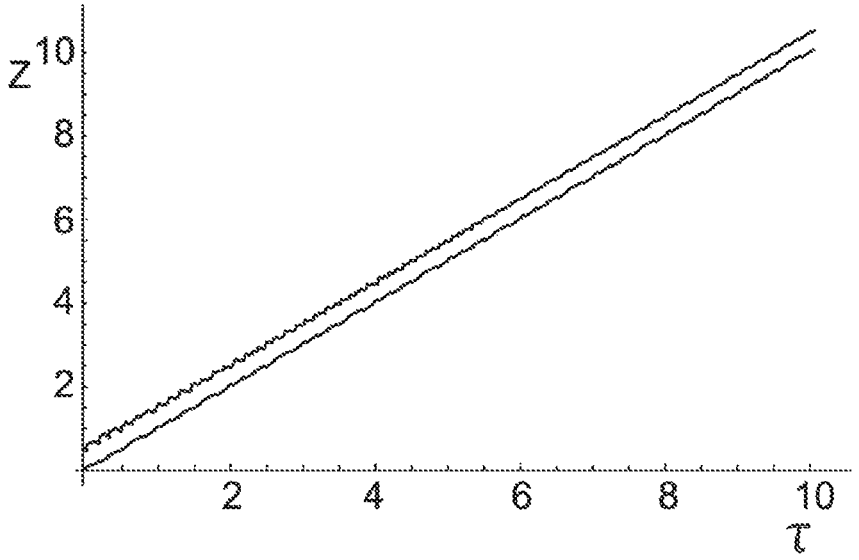
FIG. 93. Two ions moving inside separated Archimedean wells when the gas pressure is small (normalized viscosity coefficient is 1.0). Normalized time ($\tau$) is plotted on the Abscissa, Normalized axial ion position is plotted on the Ordinate (Z).
Figure 94:
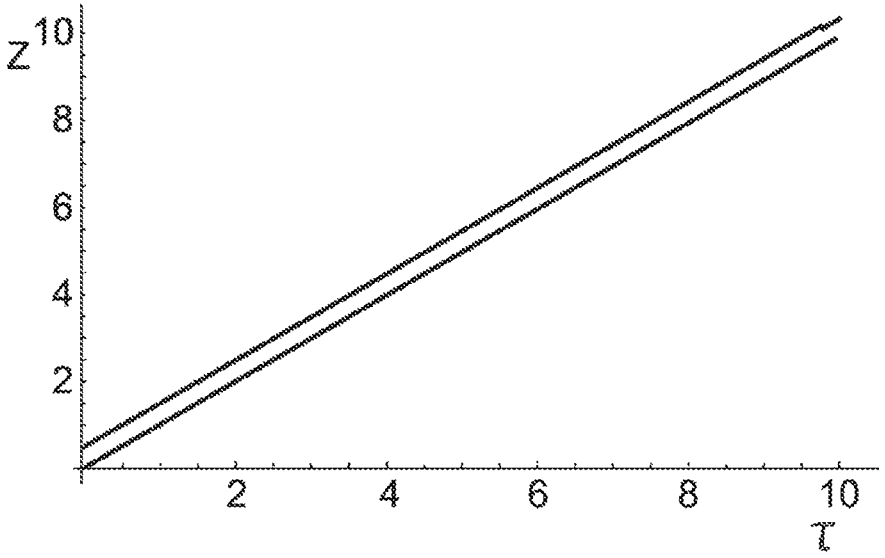
FIG. 94. Two ions moving inside separated Archimedean wells when the gas pressure is medium (normalized viscosity coefficient is 50.0). Normalized time ($\tau$) is plotted on the Abscissa, Normalized axial ion position is plotted on the Ordinate (Z).
Figure 95:
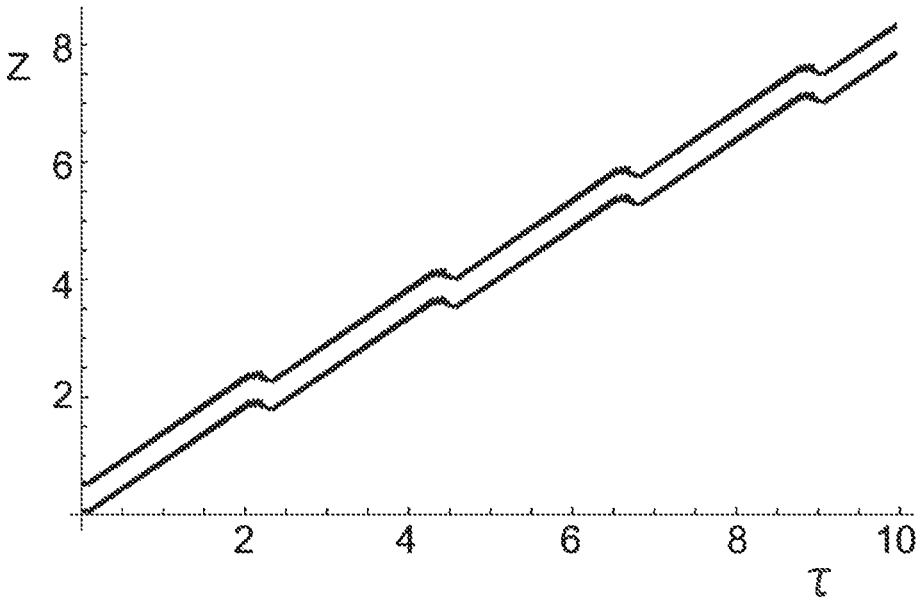
FIG. 95. Two ions breaking away the Archimedean wells where the gas pressure is large (normalized viscosity coefficient is 73.0). Normalized time ($\tau$) is plotted on the Abscissa, Normalized axial ion position is plotted on the Ordinate (Z).
Figure 96:
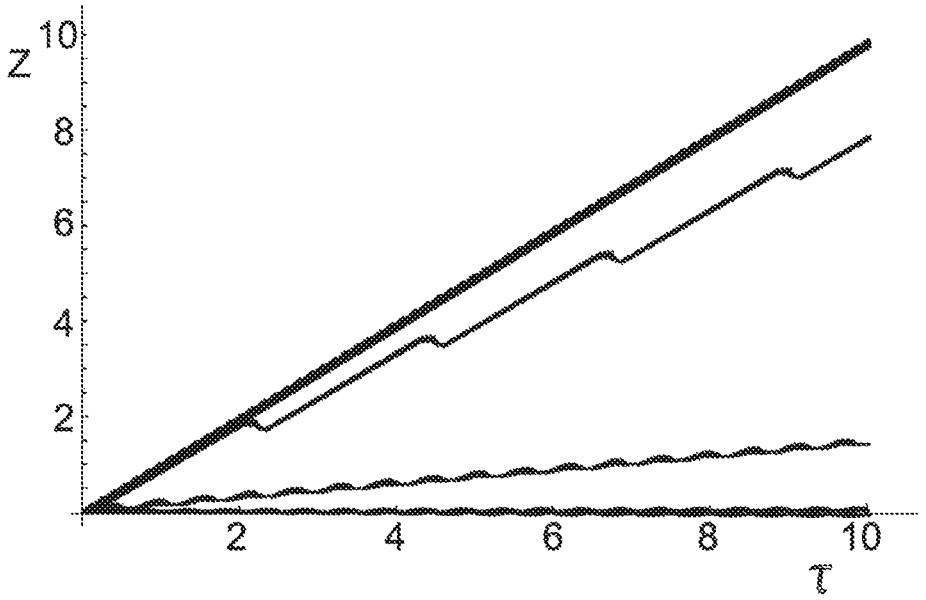
FIG. 96. Ion movement at various pressures. Normalized time ($\tau$) is plotted on the Abscissa, Normalized axial ion position is plotted on the Ordinate (Z).

Further aspects of the invention will become apparent by way of example FIG. 92 shows the movement of two ions placed inside neighboring Archimedean wells when the gas pressure is zero. It can be seen that the ions move with the same constant averaged velocities making oscillations inside the local Archimedean wells, as it should be in according with the theory. FIG. 93 shows the same ions at some gas pressure (normalized gas viscosity is 10), transported within motionless gas media. It can be seen that here the ions also move with the same constant averaged velocities making oscillations inside the local Archimedean wells, however, more detailed view discloses that the viscous Archimedean wave velocity is damped here proportionally to the damping coefficient characterizing the pseudopotential in a gas media. FIG. 94 shows the same system at higher gas pressure (normalized gas viscosity is 50), and it can be seen that here the ions do not follow the Archimedean wave, but they continue to move from entry to exit with some independent and non-uniform velocities (lower than that stimulated by the Archimedean wave). However, FIG. 95 shows that for higher gas pressure (normalized gas viscosity is 73) ion can no longer move with the Archimedean wave, every two cycles ion slit to the preceding well. At a critical value of normalized gas viscosity is 162, the ions stop moving altogether, making only the oscillations near some equilibrium position. FIG. 96 shows the movement of a sample ion at various gas pressures, it demonstrates the dependence of the effective velocity of an ion on the gas pressure values.

Similar effect happens when there is a gas flow that forces the ions to move with its velocity (due to gas viscosity) while the Archimedean wave tries to synchronize the ion movement with its own velocity. The Archimedean wave $\overline{U}(z,t)=(qU_{RF}^2/4m\,L^2\omega^2)\cos^2(z/L-t/T)$ here is the same as that in the previous example; however, here we are looking for the retarding force at the leading edge of the wave (FIG. 91). The maximal retarding pseudo force corresponding to the k-th minima is near the leading front end at $\overline{z}_k=(+\pi/4)+t(L/T)+\pi L(k+½)$ and it is equal to $\overline{F}=(q^2U_{RF}^2/4m\,L^3\omega^2)$. However, the velocity of the pseudopotential wall at this point is equal to $\dot{z}=L/T$, and if the ion is moving with a velocity which is not greater than that for the Archimedean wave leading front edge, the driving Stokes' frictional force is no less than $F=\gamma(V-\dot{z})=\gamma(V-L/T)$, where $\gamma$ is an effective friction coefficient characterizing the influence of collisions with the neutral gas molecules and V is the velocity of the gas flow. It can be seen that when $V>(q^2U_{RF}^2/4mL^3\omega^2)/\gamma+L/T$ the ion cannot move with the same velocity as the Archimedean wave. It means that for sufficiently big V (for sufficiently strong gas flow) and/or for sufficiently big $\gamma$ (for sufficiently dense gas media) the ion cannot follow the Archimedean wave in a synchronized manner, to do so the velocity of the Archimedean wave should be greater, or the maximal retarding pseudo force should be greater. Similar effects takes place for the retarding gas flows: the ions are away from the wave because they are too strongly forced to follow the gas flow due to the viscosity effects.

Figure 97:
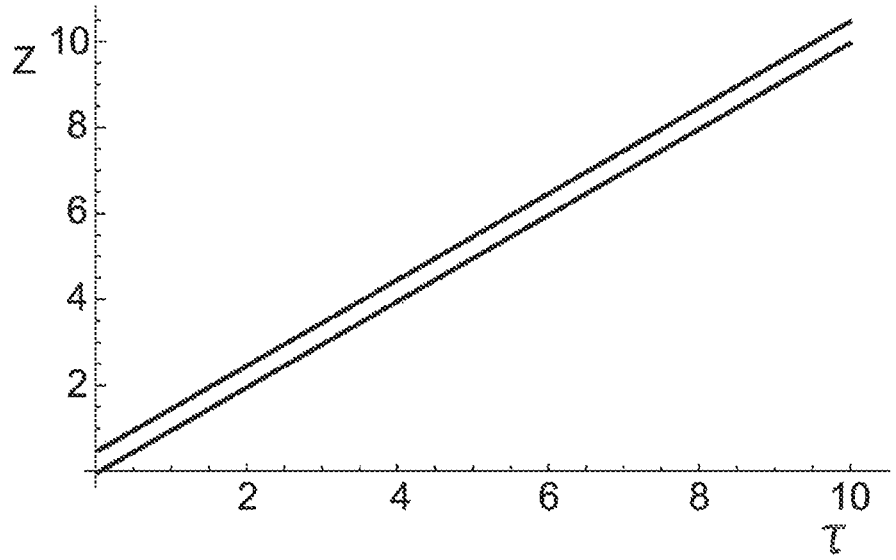
FIG. 97. Two ions moving inside neighboring Archimedean wells where the gas flow is zero (normalized viscosity coefficient is 50.0, normalized gas flow is 0.0).
Figure 98:
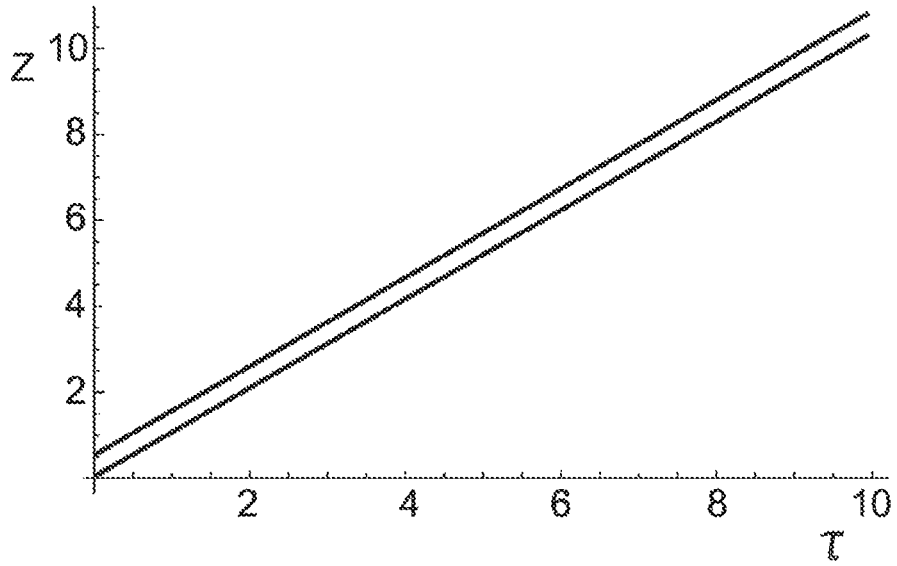
FIG. 98. Two ions moving inside neighboring Archimedean wells where the gas flow is non-zero in an assisting direction (normalized viscosity coefficient is 50.0, normalized gas flow is 2.0).
Figure 99:
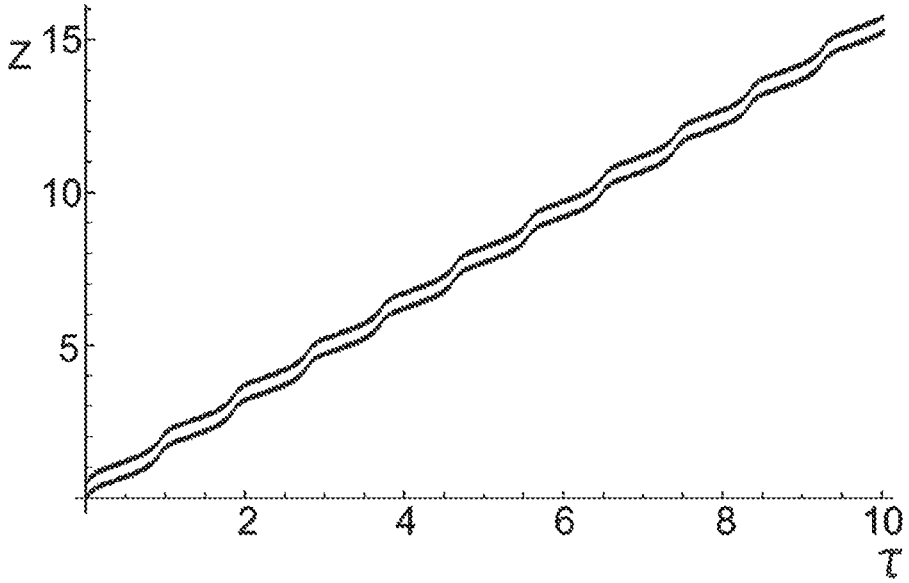
FIG. 99. Two ions moving inside neighboring Archimedean wells when the stability is lost due to non-zero gas flow (normalized viscosity coefficient is 50.0, normalized gas flow is 2.7).
Figure 100:
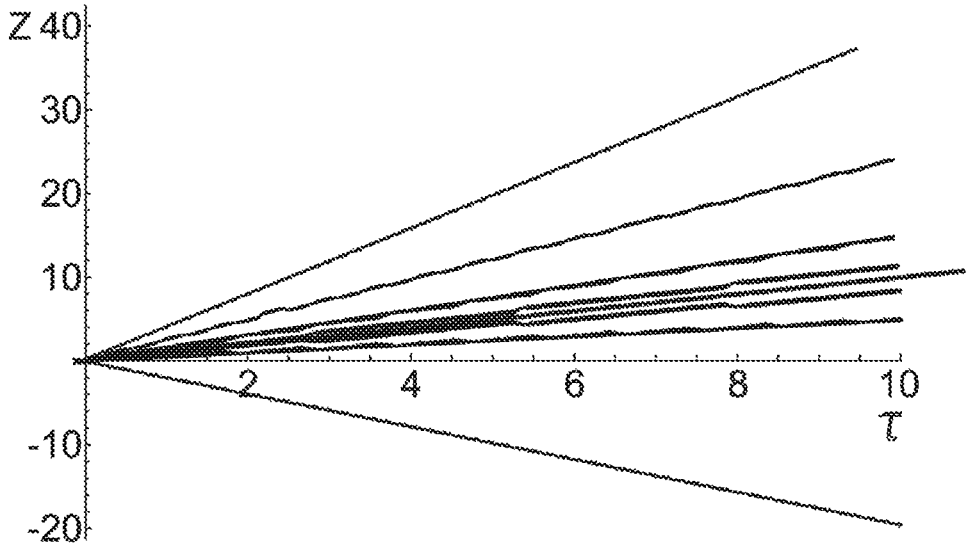
FIG. 100. Ion movement at various gas flow velocities (assisting and opposing).

The following figures illustrate this effect. FIG. 97 shows the movement of two ions characterized by slightly different viscosity coefficients (corresponding to slightly different mobility data) placed inside neighboring Archimedean wells while the gas flow is zero. It can be seen that the ions move with the same constant averaged velocities making small oscillations inside the local Archimedean wells, as it should be in accordance with the theory. FIG. 98 illustrates the behavior of the system at the same gas pressure with a non-zero assisting gas flow in the same direction as that of the Archimedean wave (the normalized gas flow velocity is 2.0, and is greater than that of the Archimedean wave itself). Under these conditions the –wave effect is conserved in this case but the equilibrium position is shifted by +0.05 from the well minimum in normalized units. FIG. 99 shows the same ions at a higher assisting gas flow (normalized gas velocity is 50 and normalized gas flow of 2.7), the gas flow velocity is above a critical and the Archimedean wave effect is destroyed, the equilibrium point is shifted too much and the gas flow pushes the ions through the RF barriers of the Archimedean wave and forces the ions to jump forward between the local Archimedean wells. At still higher normalized gas flow the Archimedean-Wave effect becomes negligible as compared to the gas flow. FIG. 100 demonstrates the dependence of the asymptotic velocity of the sample ion for different gas flow velocities.

These examples demonstrate that for transporting ions in bunches defined bunches using an Archimedean wave the Archimedean wave properties should be chosen according to the gas viscosity and the gas velocity, this is important when the Archimedean ion guide is used to transport the ions from the high pressure region to the low pressure region (or to the vacuum region), may be by passing several stages of the differential pumping. The same examples demonstrate that when the parameters of the Archimedean wave are controlled correctly, the Archimedean effect exists and can be utilized effectively for high pressure transporting of ions, even when there is a flowing gas.

Furthermore in embodiments the device is used in (suitably is part of or is) an interface for transportation of charged particles from gas-filled ion sources into mass analyser, and in the case of its application in an interface for transportation of charged particles into mass analyser, and in particular, when the device transports through several stages of differential pumping, and wherein the parameters of Archimedean wave are adjusted in at least some of one or more said stages, so as to maintain bunched ion transport in all of one or mare stages.

The invention claimed is:

1. A device for manipulating charged particles, the device comprising:

a series of electrodes arranged so as to form a channel for transportation of the charged particles;

a power supply unit adapted to provide supply voltages to said electrodes so as to create a non-uniform high-frequency electric field within said channel, the pseudopotential of said field having two or more local maxima along the length of said channel for transportation of charged particles, at least within a certain interval of time, wherein transportation of the charged particles along the length of the channel is provided by transposition of the at least two of said maxima of the pseudopotential such that the at least two of said maxima are caused to travel with time along the channel, at least within a certain interval of time and at least within a part of the length of the channel, wherein the supply voltages are high-frequency voltages;

wherein a first region of said channel forms part of an inlet intermediate device that is configured to inject ions into a collision cell containing buffer gas with sufficiently high kinetic energy to cause fragmentation of ions in the collision cell through collisions with the buffer gas;

wherein a second region of said channel forms part of the collision cell;

wherein a third region of said channel forms part of an outlet intermediate device configured to receive ions transported out from the collision cell.

2. A device according to claim 1, wherein the device is configured to propagate discrete bunches of parent ions into the collision cell such that daughter ions resulting from fragmentation of each bunch of parent ions substantially remain within the same bunch of propagating ions as the parent ions from which they derived due to confinement by the non-uniform high-frequency electric field.

3. A device according to claim 1, wherein the second region of the channel is maintained at a higher pressure than the first and third regions of the channel.

4. A device according to claim 1, wherein first, second and third regions are located within a single vacuum chamber with at least one pump for pumping away gas.

5. A device according to claim 1, wherein the collision cell has a gas inlet and at least two segments designated as conductance limiting segments, wherein each conductance limiting segment is configured to establish a pressure differential within the device.

6. A device according to claim 5, wherein each of the at least two segments is formed from four electrodes and four insulators where the four insulators form part of a supporting structure.

7. A device according to claim 1, wherein said channel has a variable profile along the length of the channel such that its cross section varies along its length.

8. A device according to claim 7, wherein the area of the cross section of the channel varies along the length of the channel.

9. A device according to claim 1, wherein some or all of the electrodes have a multipole profile.

10. A device according to claim 9, wherein the multipole profile is a coarsened multipole profile formed by any one or combination of: plane, stepped, piecewise-stepped, linear, piecewise-linear, circular, rounded, piecewise-rounded, curvilinear, or piecewise-curvilinear profiles.

11. A device according to claim 1, wherein some or all of the electrodes are formed from metallic films deposited on a non-conductive substrates.

12. A device according to claim 1, wherein the channel is:

a rectilinear channel, a curvilinear channel, or is closed to form a ring-shaped channel.

13. A device according to claim 1, wherein the channel comprises a plurality of channels, wherein the plurality of channels are configured to operate in parallel.

14. A device according to claim 13, wherein each channel of the plurality of channels is configured to transport ions with a defined mass range.

15. A device according to claim 1, wherein the buffer gas comprises nitrogen.

16. A device according to claim 1, wherein said channel is enclosed within a tube.

* * * * *